US012704050B1

(12) United States Patent
El Mallawany et al.

(10) Patent No.: US 12,704,050 B1
(45) Date of Patent: Aug. 11, 2026

(54) FLOW CONTROL ASSEMBLY, METHOD AND WELL SYSTEM EMPLOYING A SLIDING PISTON ASSEMBLY

(71) Applicant: Halliburton Energy Services, Inc., Houston, TX (US)

(72) Inventors: Ibrahim El Mallawany, Dhahran (SA); Luis Herrera-Cruz, Dhahran (SA); Abdullah Adam Abdulhalim, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/223,255

(22) Filed: May 30, 2025

(51) Int. Cl.
*E21B 43/12* (2006.01)
*E21B 34/06* (2006.01)

(52) U.S. Cl.
CPC ..... *E21B 43/12* (2013.01); *E21B 34/06* (2013.01)

(58) Field of Classification Search
CPC ..... E21B 34/06; E21B 43/12
See application file for complete search history.

(56) References Cited

U.S. PATENT DOCUMENTS 7,775,283 B2 8/2010 Coronado et al.
8,807,215 B2 8/2014 Holderman et al.
9,206,669 B2 12/2015 Holderman
11,041,360 B2 6/2021 Penno et al.
11,066,909 B2 7/2021 Yin et al.
2009/0151925 A1 6/2009 Richards et al.
2011/0198097 A1* 8/2011 Moen ..... E21B 34/08 166/324
2012/0186829 A1 7/2012 Watson
2013/0000740 A1 1/2013 Veit
2013/0220632 A1 8/2013 Greci et al.
2013/0284452 A1 10/2013 Franklin et al.
2014/0338922 A1* 11/2014 Lopez ..... E21B 34/066 166/373
2015/0075800 A1* 3/2015 Allen ..... E21B 34/08 166/320
2015/0308239 A1* 10/2015 Langlais ..... E21B 43/08 166/278
2021/0156235 A1* 5/2021 Yin ..... E21B 33/12
2021/0324715 A1 10/2021 Yin et al.
(Continued)

FOREIGN PATENT DOCUMENTS

CN 114575772 A 6/2022

*Primary Examiner* — Shane Bomar
(74) *Attorney, Agent, or Firm* — Scott Richardson; Parker Justiss. P.C.

(57) ABSTRACT

Provided is a flow control assembly, a method and a well system. The flow control assembly, in one aspect, includes a sliding piston assembly located in a piston chamber, the sliding piston assembly movable between a run-in-hole state and an activated state. In at least one aspect, the sliding piston assembly is configured to: 1) keep a flow control housing plug member within a flow control housing flow nozzle chamber and prevent fluid flow from an annulus of a wellbore to an inside diameter (ID) of a downhole tubular when the sliding piston assembly is in a run-in-hole state; and 2) allow the flow control housing plug member to traverse into the piston chamber and allow fluid flow from the annulus of the wellbore to the inside diameter (ID) of the downhole tubular when the sliding piston assembly is in the activated state.

30 Claims, 61 Drawing Sheets

(56) References Cited

U.S. PATENT DOCUMENTS

| | | | | |
|---|---|---|---|---|
| 2024/0117718 | A1* | 4/2024 | El Mallawany | E21B 34/10 |
| 2024/0392651 | A1 | 11/2024 | El Mallawany et al. | |
| 2025/0215767 | A1* | 7/2025 | El Mallawany | E21B 23/06 |
| 2025/0277427 | A1* | 9/2025 | El Mallawany | E21B 34/066 |

* cited by examiner

FLOW CONTROL ASSEMBLY, METHOD AND WELL SYSTEM EMPLOYING A SLIDING PISTON ASSEMBLY

BACKGROUND

In the process of completing an oil or gas well, a tubular is run downhole into a wellbore and used to direct produced hydrocarbon fluids from a downhole formation to the surface.

Typically, this tubular is coupled to a flow control assembly that has a screen assembly that controls and limits debris, such as gravel, sand, and other particulate matter, from entering the tubular as the fluid passes through the screen assembly. The flow control assembly generally also includes a flow control device (e.g., flow control nozzle) that controls fluid flow into the tubular from the wellbore. Further, the flow control assembly may include a washpipe free feature used to set packer assemblies while still permitting fluid flow from the flow control device to flow into the tubular. These features (e.g., the flow control device and the washpipe free feature) are generally connected through complex housing, piping, and/or the like, which may be costly.

BRIEF DESCRIPTION

Reference is now made to the following descriptions taken in conjunction with the accompanying drawings, in which.

DETAILED DESCRIPTION

Figure 1:
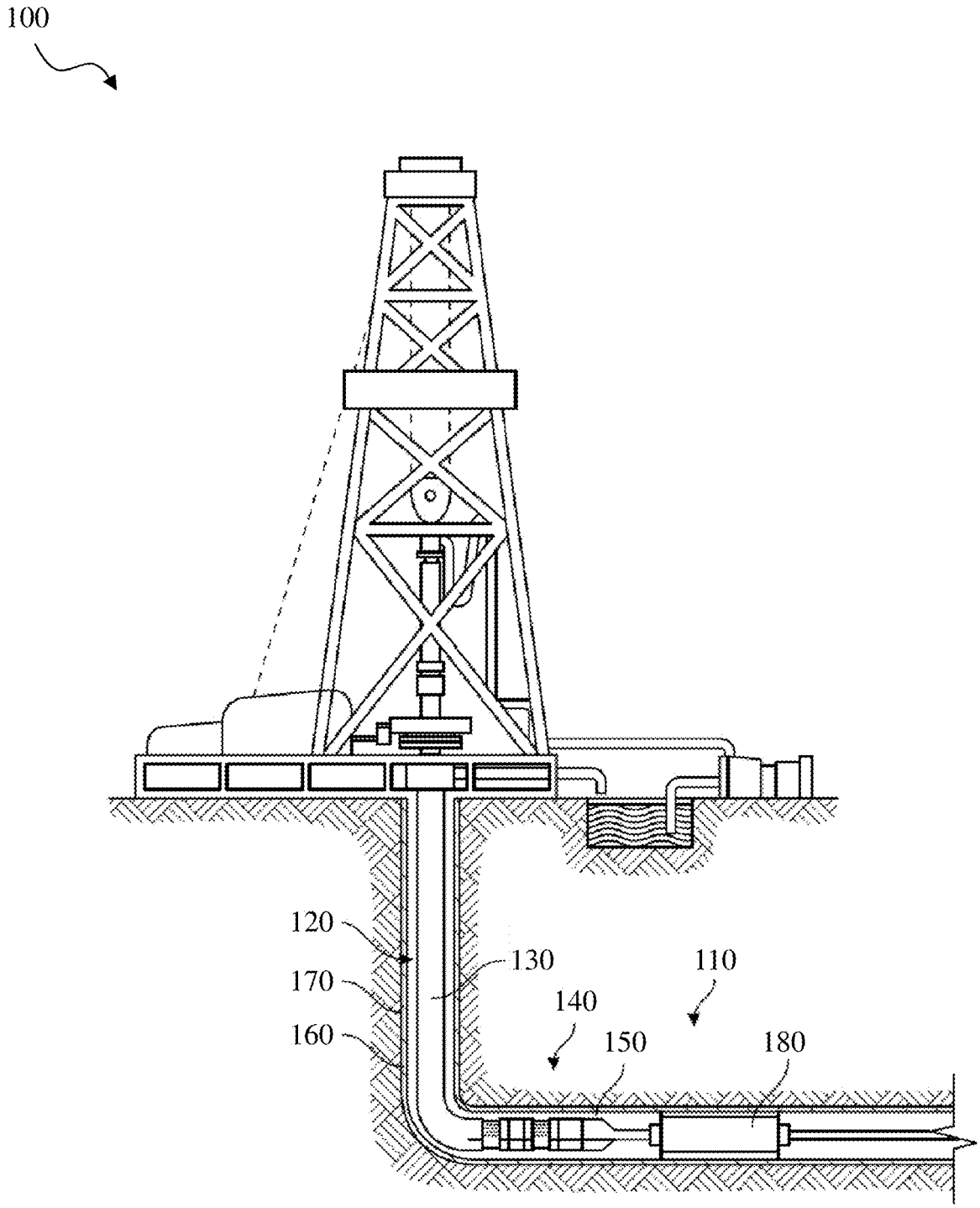
FIG. 1 illustrates a side elevation, partial cross-sectional view of an operational environment for a well system designed, manufactured and/or operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

Various values and/or ranges are explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The term "substantially XYZ," as used herein, means that it is within 10 percent of perfectly XYZ. The term "significantly XYZ," as used herein, means that it is within 5 percent of perfectly XYZ. The term "ideally XYZ," as used herein, means that it is within 1 percent of perfectly XYZ. The monicker "XYZ" could refer to parallel, perpendicular, alignment, or other relative features disclosed herein.

Disclosed herein is a flow control assembly (e.g., washpipe free feature) of a lower completion assembly having various components for blocking fluid flow from an inside diameter (ID) (e.g., central bore) of a downhole tubular toward an annulus of the wellbore as the lower completion assembly is run-in-hole, while at the same time blocking fluid flow from an annulus of the wellbore toward the central bore of a tubular either as the lower completion assembly is run-in-hole, or until the flow control assembly is moved to an activated state. In particular, the flow control assembly includes a sliding piston assembly located in a piston chamber, the sliding piston assembly movable between a run-in-hole state and an activated state. In at least one embodiment, the sliding piston assembly is configured to: 1) keep a flow control housing plug member within a flow control housing flow nozzle chamber and prevent fluid flow from the annulus of the wellbore to the inside diameter (ID) of the downhole tubular when the sliding piston assembly is in the run-in-hole state; and 2) allow the flow control housing plug member to traverse into the piston chamber and allow fluid flow from the annulus of the wellbore to the inside diameter (ID) of the downhole tubular when the sliding piston assembly is in the activated state.

FIG. 1 illustrates a side elevation, partial cross-sectional view of an operational environment for a well system 100 designed, manufactured and/or operated according to one or more embodiments of the disclosure. In the illustrated embodiment, the well system 100 include a lower completion assembly 110 that is run into a wellbore 120 (e.g., extending through one or more subterranean formations) via a downhole tubular 130 or other suitable conveyance. The lower completion assembly 110, in one or more embodiments, includes at least one flow control assembly 140 for controlling fluid flow between an annulus 150 of the wellbore 120 and an inside diameter (ID) of the downhole tubular 130 (e.g., base pipe in one embodiment), and vice versa. As illustrated, the annulus 150 may be formed between the downhole tubular 130 and a casing 160 (e.g., cemented against a wellbore wall 170). In some embodiments, the annulus 150 may be formed between the downhole tubular 130 and the wellbore wall 170. Further, the lower completion assembly 110 may include a packer assembly 180, a latch subassembly, or any other suitable assembly.

As set forth in detail below, the at least one flow control assembly 140 may restrain (e.g., permit little to no) fluid flow from the annulus 150 to the downhole tubular 130 as the lower completion assembly 110 is run-in-hole. In at least one embodiment, the flow control assembly cuts fluid flow from the annulus 150 to the downhole tubular 130 as the lower completion assembly 110 is run-in-hole by at least 50 percent. In at least one other embodiment, the flow control assembly cuts fluid flow from the annulus 150 to the downhole tubular 130 as the lower completion assembly 110 is run-in-hole by at least 80 percent. In even yet another embodiment, the flow control assembly cuts fluid flow from the annulus 150 to the downhole tubular 130 as the lower completion assembly 110 is run-in-hole by at least 90 percent, if not by at least 95 percent, if not by at least 99 percent, if not by 100 percent. Similarly, the at least one flow control assembly 140 may restrain fluid flow from the downhole tubular 130 to the annulus 150 as the lower completion assembly 110 is run-in-hole.

Once the lower completion assembly 110 is positioned at a desired location in the wellbore 120, fluid may be pumped through the downhole tubular 130 through the flow control assembly 140. The pressure inside the downhole tubular 130 may increase to a threshold pressure (e.g., first lesser predetermined threshold pressure) for sliding the sliding piston assembly from its run-in-hole state to its actuated state. The pressure inside the downhole tubular 130 may increase to a setting pressure (e.g., second greater predetermined threshold pressure) for actuating the packer assembly 180. With the packer assembly 180 set, and the sliding piston assembly in its actuated state, the flow control assembly 140 allows open fluid flow between the annulus 150 and the downhole tubular 130. As such, fluids may flow openly through the flow control assembly 140 during production operations and/or injection.

Figure 2A:
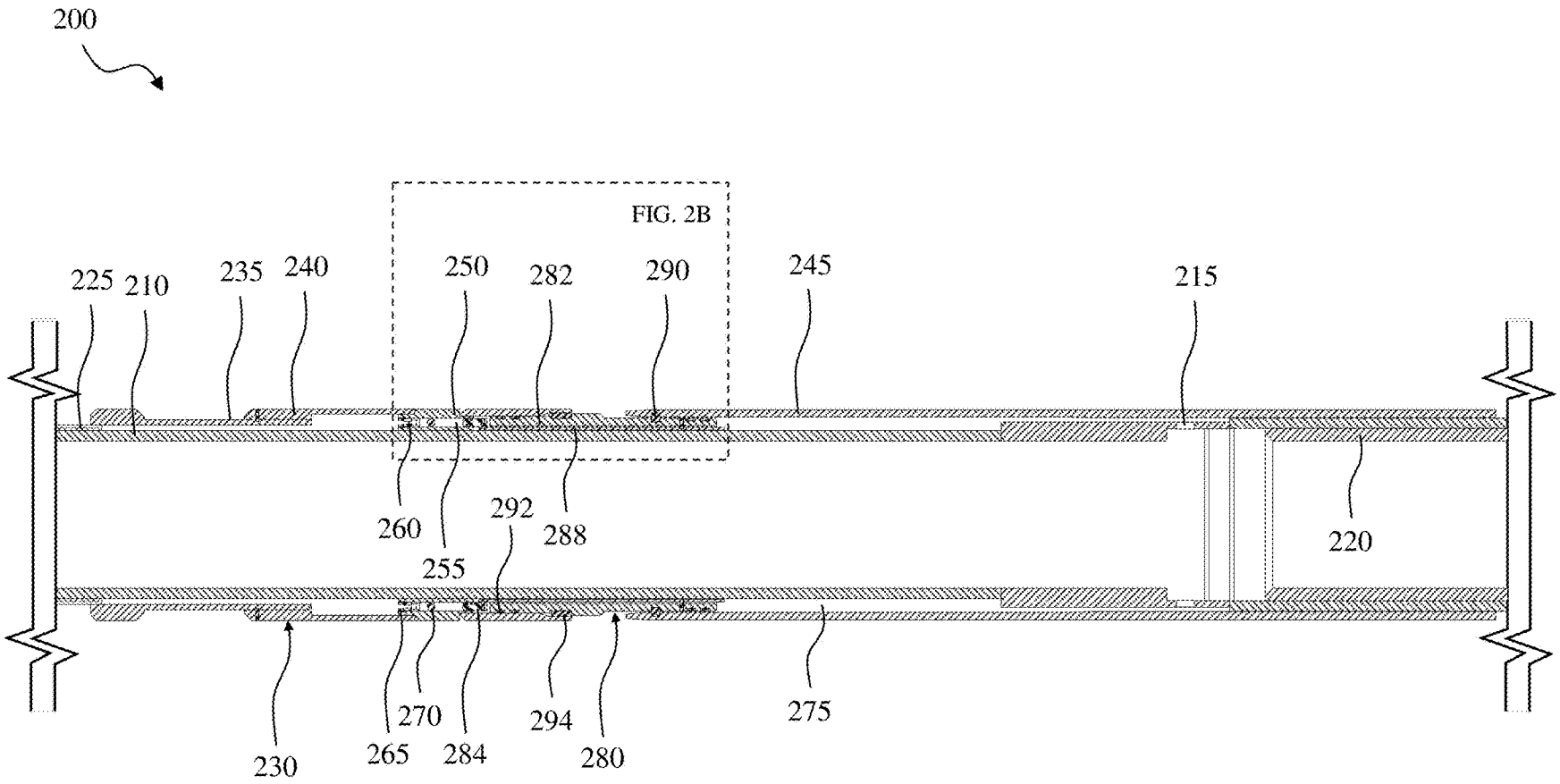
FIGS. 2A through 2C illustrate various different cross-sectional views of a flow control assembly designed, manufactured and/or operated according to one or more embodiments of the disclosure.
Figure 2B:
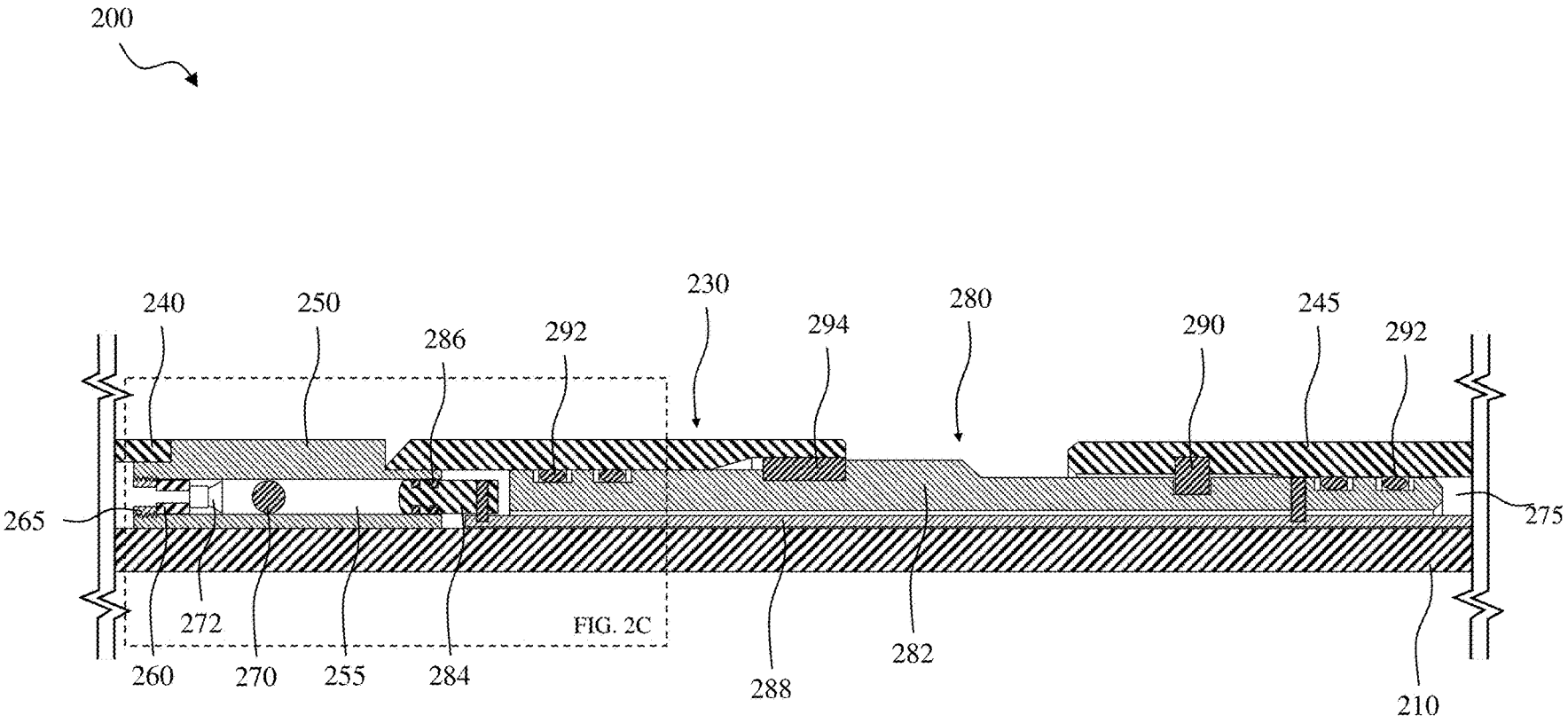
Figure 2C:
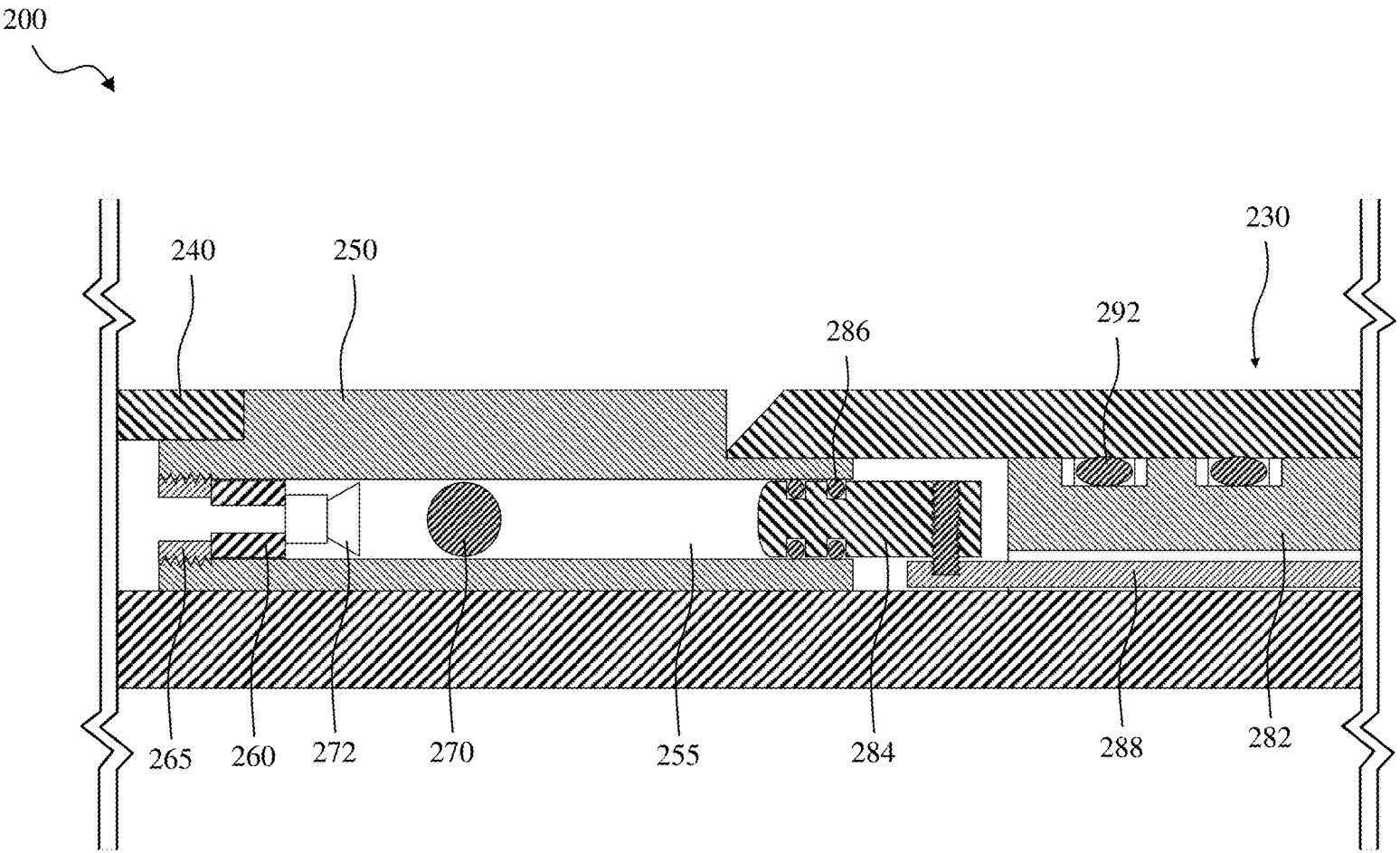

Turning to FIGS. 2A through 2C, illustrated are various different cross-sectional views of a flow control assembly 200 designed, manufactured and/or operated according to one or more embodiments of the disclosure. In at least one embodiment, the flow control assembly 200 includes various different components for controlling fluid flow between an annulus of a wellbore surrounding the flow control assembly 200, and an inside thereof. For example, in at least one embodiment, the flow control assembly 200 includes a downhole tubular 210 (e.g., a metal (e.g., steel) downhole tubular in one embodiment) having an inside diameter (ID) and an outside diameter (OD). The downhole tubular 210, in at least one embodiment, may be considered a base pipe. In at least one embodiment, the downhole tubular 210 includes a downhole tubular opening 215 coupling the inside diameter (ID) of the downhole tubular 210 and the outside diameter (OD) of the downhole tubular 210.

In at least one other embodiment, such as shown in FIGS. 2A through 2C, the flow control assembly 200 further includes a downhole tubular inner sleeve 220 located radially inside of the downhole tubular 210. In at least one embodiment, the downhole tubular inner sleeve 220 is configured to slide between an open state exposing the downhole tubular opening 215 to allow fluid flow between the inside diameter (ID) of the downhole tubular 210 and the outside diameter (OD) of the downhole tubular 210 (e.g., as shown in FIGS. 2A through 2C), and a closed state covering the downhole tubular opening 215 to prevent fluid flow between the inside diameter (ID) of the downhole tubular 210 and the outside diameter (OD) of the downhole tubular 210. In at least one other embodiment, the downhole tubular inner sleeve 220 is moved from the open state to the closed state, for example if there were a desire to entirely close the flow control assembly 200. Nevertheless, in at least one embodiment, the downhole tubular inner sleeve 220 is positioned in the open state during the run-in-hole state and activated state of the flow control assembly 200, and will only be shifted (e.g., using a shifting tool, such as a shifting tool extending from a surface of the wellbore) when there is a desire to entirely close the flow control assembly 200.

In at least one embodiment, such as that shown, the flow control assembly 200 additionally includes a screen assembly 225 positioned in a fluid flow path between an annulus of the wellbore and the inside diameter (ID) of the downhole tubular 210 (e.g., between the annulus of the wellbore and a flow control housing flow nozzle chamber of the downhole tubular 210). In at least this one embodiment, the screen assembly 225 is configured to filter debris out of fluids flowing from the annulus of the wellbore toward the inside diameter (ID) of the downhole tubular 210. Unless otherwise noted, the present disclosure should not be limited to any specific type of screen assembly.

In at least one embodiment, such as that shown, the flow control assembly 200 further includes an outer housing 230 disposed about the downhole tubular 210. The outer housing 230, in at least one embodiment, includes one or more of a flow ring housing 235, an adjustment ring housing 240, a sleeve housing 245, and a flow control housing 250. In at least one embodiment, the flow ring housing 235, adjustment ring housing 240, sleeve housing 245, and flow control housing 250 are assembled uphole, and then disposed downhole as shown in FIGS. 2A through 2C.

In one or more embodiments, such as that shown, the flow control housing 250 includes a flow control housing flow nozzle chamber 255. For example, in one or more embodiments, the flow control housing flow nozzle chamber 255 is configured to provide a fluid path between the inside diameter (ID) of the downhole tubular 210 and the annulus of the wellbore. Further to one or more embodiments, the flow control assembly 200 may additionally include a flow control housing flow control device 260 positioned within the flow control housing flow nozzle chamber 255. In one or more embodiments, the flow control housing flow control device 260 is configured to control a fluid flow rate through the flow control housing flow nozzle chamber 255. Moreover, in at least one embodiment, the flow control housing flow control device 260 is a flow control housing nozzle, and is adjustable/replaceable. For example, in at least one embodiment the flow control assembly 200 further includes a flow control device retainer 265, the flow control device retainer 265 configured to disengage from the flow control housing flow nozzle chamber 255 to allow an adjustment, removal and/or replacement of the flow control housing flow control device 260. In at least one embodiment, this is accomplished uphole, for example by at least partially disassembling the adjustment ring housing 240 (e.g., unscrewing the adjustment ring housing 240 to expose the flow control device retainer 265 and ultimately the flow control housing flow control device 260).

In at least one embodiment, the flow control assembly 200 additionally includes a flow control housing plug member 270, for example positioned within the flow control housing flow nozzle chamber 255. In accordance with the disclosure, as discussed above, the flow control housing plug member 270 is moveable to plug the flow control housing flow nozzle chamber 255. For example, in at least one embodiment, the flow control housing plug member 270 is moveable to plug the flow control housing flow nozzle chamber 255 in response to fluid flow from the inside diameter (ID) of the downhole tubular 210 towards the annulus of the wellbore, for example in one embodiment engaging with a flow control housing plug member seat 272 to accomplish such. In at least one other embodiment, as will be discussed in an alternative embodiment below, the flow control housing plug member 270 is also moveable to plug the flow control housing flow nozzle chamber 255 in response to fluid flow from the annulus of the wellbore towards the inside diameter (ID) of the downhole tubular 210.

In one or more embodiments, the flow control assembly 200 additionally includes a piston chamber 275 defined between the outer housing 230 and the downhole tubular 210. In at least this one embodiment, the piston chamber 275 is in fluid communication with the flow control housing flow nozzle chamber 255 and the inside diameter (ID) of the downhole tubular 210. In at least one embodiment, the piston chamber 275 is defined between the sleeve housing 245 and flow control housing 250 of the outer housing 230, and the downhole tubular 210. The piston chamber 275, in one or more embodiments, is also in fluid communication with the inside diameter (ID) of the downhole tubular 210 via the downhole tubular opening 215.

In accordance with one or more aspects of the disclosure, the flow control assembly 200 additionally includes a sliding piston assembly 280 located in the piston chamber 275. In at least one embodiment, the sliding piston assembly 280 is movable between a run-in-hole state (e.g., as shown in FIGS. 2A through 2C) and an activated state (e.g., further shown below with regard to the embodiment of FIGS. 3G through 30). In accordance with one embodiment of the disclosure, as disclosed above, the sliding piston assembly 280 is configured to: 1) keep the flow control housing plug member 270 within the flow control housing flow nozzle chamber 255 and prevent fluid flow from the annulus of the wellbore to the inside diameter (ID) of the downhole tubular 210 when the sliding piston assembly 280 is in the run-in-hole state; and 2) allow the flow control housing plug member 270 to traverse into the piston chamber 275 and allow fluid flow from the annulus of the wellbore to the inside diameter (ID) of the downhole tubular 210 when the sliding piston assembly 280 is in the activated state.

For example, in at least one embodiment, the sliding piston assembly 280 includes a sliding piston assembly sleeve 282 located in the piston chamber 275, and a sliding piston assembly flow nozzle chamber stopper 284 coupled to the sliding piston assembly sleeve 282. In accordance with this embodiment, the sliding piston assembly flow nozzle chamber stopper 284 is configured to: 1) keep the flow control housing plug member 270 within the flow control housing flow nozzle chamber 255 and prevent fluid flow from the annulus of the wellbore to the inside diameter (ID) of the downhole tubular 210 when the sliding piston assembly 280 is in the run-in-hole state; and 2) allow the flow control housing plug member 270 to traverse into the piston chamber 275 and allow fluid flow from the annulus of the wellbore to the inside diameter (ID) of the downhole tubular 210 when the sliding piston assembly 280 is in the activated state. In the illustrated embodiment of FIGS. 2A through 2C, the sliding piston assembly flow nozzle chamber stopper 284 is a solid stopper, and thus does not include any flow ports coupling an uphole end and a downhole end thereof. Accordingly, when the sliding piston assembly 280 is located within the flow control housing flow nozzle chamber 255, it prevents fluid flow from the annulus of the wellbore to the inside diameter (ID) of the downhole tubular 210.

In at least one embodiment, the flow control assembly 200 additionally includes one or more sliding piston assembly flow nozzle chamber stopper seals 286. In one or more embodiments, such as that shown in FIGS. 2A through 2C, the one or more sliding piston assembly flow nozzle chamber stopper seals 286 are configured to form a seal between the sliding piston assembly flow nozzle chamber stopper 284 and the flow control housing flow nozzle chamber 255, for example to prevent fluid flow from the annulus of the wellbore to the inside diameter (ID) of the downhole tubular 210 when the sliding piston assembly 280 is in the run-in-hole state. In at least one embodiment, the one or more sliding piston assembly flow nozzle chamber stopper seals 286 are located in one or more seal grooves located in the flow control housing flow nozzle chamber 255, and thus are axially fixed relative the outer housing 230. In yet another embodiment, the one or more sliding piston assembly flow nozzle chamber stopper seals 286 are located in one or more seal grooves located in the sliding piston assembly flow nozzle chamber stopper 284, and thus are axially movable relative the outer housing 230. Any type of sealing member may be used for the one or more sliding piston assembly flow nozzle chamber stopper seals 286 and remain within the scope of the disclosure.

In at least one embodiment, the flow control assembly 200 may additionally include a sliding piston assembly bar 288 located radially inside and coupled to the sliding piston assembly sleeve 282. In at least one embodiment, the sliding piston assembly bar 288 is circumferentially discontinuous, such that it may provide a fluid flow path around the sliding piston assembly sleeve 282 (e.g., between the sliding piston assembly sleeve 282 and the downhole tubular 210). In the illustrated embodiment of FIGS. 2A through 2C, the sliding piston assembly bar 288 couples the sliding piston assembly flow nozzle chamber stopper 284 to the sliding assembly piston sleeve 282, such that any movement of the sliding assembly piston sleeve 282 also moves the sliding piston assembly flow nozzle chamber stopper 284.

The flow control assembly 200, in at least one embodiment, further includes a sliding piston assembly shear feature 290. In at least one embodiment, the sliding piston assembly shear feature 290 (e.g., a shear bolt in one embodiment) is configured to shearingly hold the sliding piston assembly 280 in the run-in-hole state. In one or more embodiments, the flow control assembly 200 may additionally include one or more sliding piston assembly seal feature(s) 292 positioned radially between the outer housing 230 and the sliding piston assembly 280, the one or more sliding piston assembly seal feature(s) 292 configured to provide a seal area (e.g., uphole larger seal area) for the predetermined threshold pressure from the downhole tubular 210 to engage with and move the sliding piston assembly 280 from the run-in-hole state (e.g., as shown in FIGS. 2A through 2C) to the activated state (e.g., as shown in FIGS. 3G through 30). In this embodiment, the sliding piston assembly shear feature 290 is configured to shear in response to a predetermined threshold pressure from the downhole tubular 210 being applied to the seal area of the sliding piston assembly 280.

Further to the embodiment of FIGS. 2A through 2C, the flow control assembly 200 may additionally include a sliding piston assembly lock feature 294. The sliding piston assembly lock feature 294, in one or more embodiments, is configured to allow the sliding piston assembly 280 to move toward and then lock into the activated state, for example after the sliding piston assembly shear feature 290 has sheared in response to the seal area of the sliding piston assembly 280 receiving the predetermined threshold pressure from the downhole tubular 210. Any type of lock feature may be used for the sliding piston assembly lock feature 294 and remain within the scope of the disclosure. Nevertheless, in the embodiment of FIGS. 2A through 2C the sliding piston assembly lock feature 294 is a sliding piston assembly snap ring located in a sliding piston assembly snap ring groove.

In operation, one or more of the flow control assemblies 200 of FIGS. 2A through 2C would be positioned within a wellbore in a first step, for example along with one or more wellbore packers. During this first step, the sliding piston assemblies 280 would be configured in the run-in-hole state, and thus the sliding piston assembly 280 would prevent the flow control housing plug member 270 from exiting the flow control housing flow nozzle chamber 255. Furthermore, during this first step the fluid flow is restricted from the annulus of the wellbore to the inside diameter (ID) of the downhole tubular 210 (e.g., using the sliding piston assembly flow nozzle chamber stopper), as well as from the inside diameter (ID) of the downhole tubular 210 to the annulus of the wellbore, for example using the flow control housing plug member 270 and the flow control housing plug member seat 272.

With the one or more flow control assemblies 200 of FIGS. 2A through 2C positioned at desired locations within the wellbore, the one or more of the flow control assemblies 200, as well as one or more wellbore packers located there above or there below, may be subjected to the predetermined threshold pressure. This predetermined pressure, in certain embodiments, both moves the sliding piston assemblies 280 of the one or more flow control assemblies 200 from their initial run-in-hole state to a subsequent activated state, as well as sets the one or more wellbore packers. In at least one embodiment, the predetermined pressure includes a first lower predetermined pressure configured to move the sliding piston assembly 280 and a second higher predetermined pressure configured to set the one or more wellbore packers, or vice versa.

As understood above, in at least one embodiment, the moving of the sliding piston assemblies 280 of the one or more flow control assemblies 200 from their initial run-in-hole state to a subsequent activated state withdraws the related sliding piston assembly flow nozzle chamber stoppers 284 from their associated flow control housing flow nozzle chambers 255, which in turn allows the flow control housing plug members 270 to traverse into the piston chambers 275 and allow fluid flow from the annulus of the wellbore to the inside diameter (ID) of the downhole tubular 210 (e.g., when the sliding piston assembly 280 is in the activated state).

Turning now to FIGS. 3A through 30, illustrated are certain different cross-sectional views of a flow control assembly 300 positioned within a wellbore 390 at various different operational states. The flow control assembly 300 of FIGS. 3A through 30 is similar in many respects to the flow control assembly 200 of FIGS. 2A through 2C. Accordingly, like reference numbers have been used to indicate similar, if not identical, features.

Figure 3A:
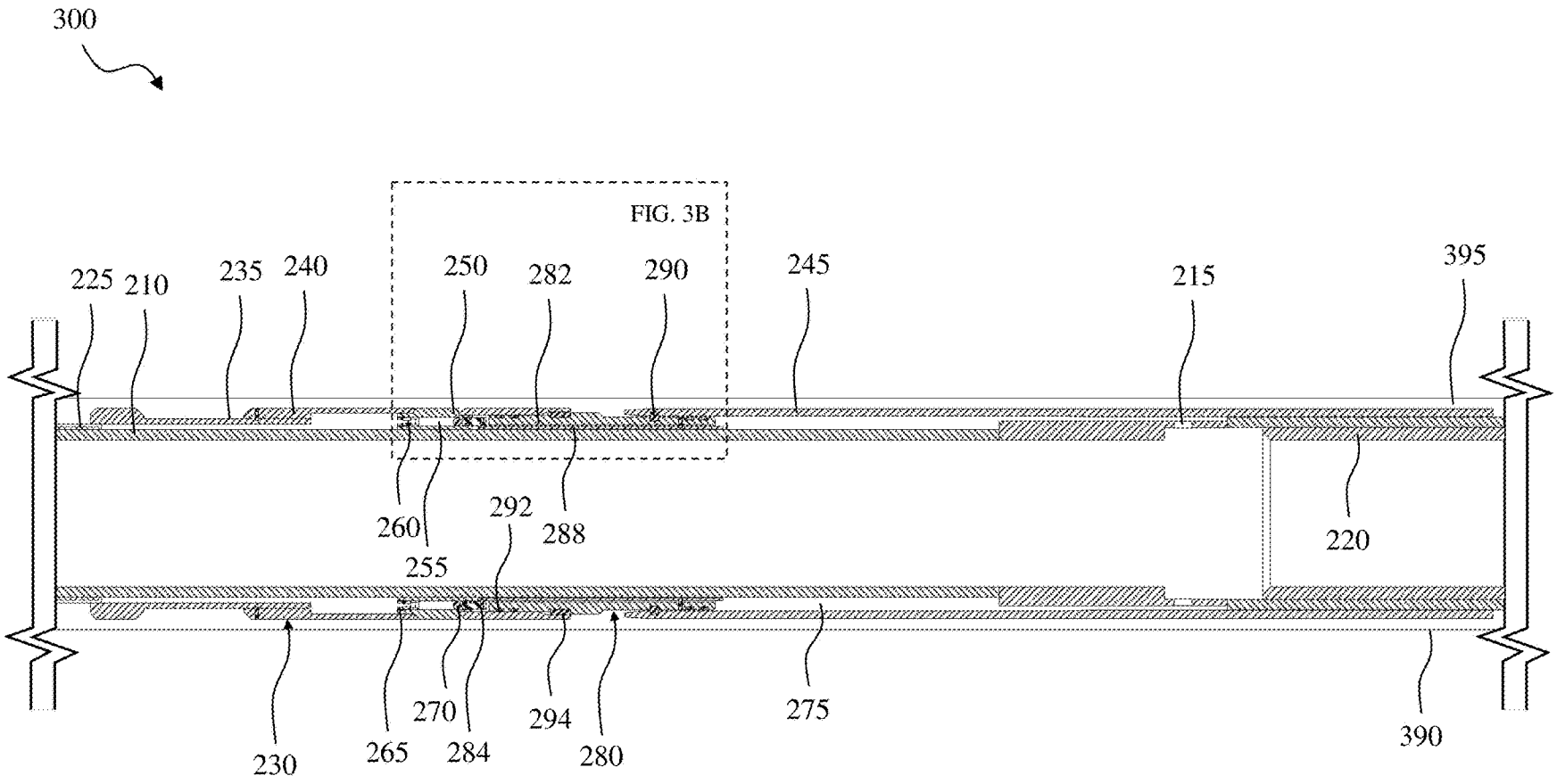
FIGS. 3A through 3O illustrate certain different cross-sectional views of a flow control assembly positioned within a wellbore and various different operational states.
Figure 3B:
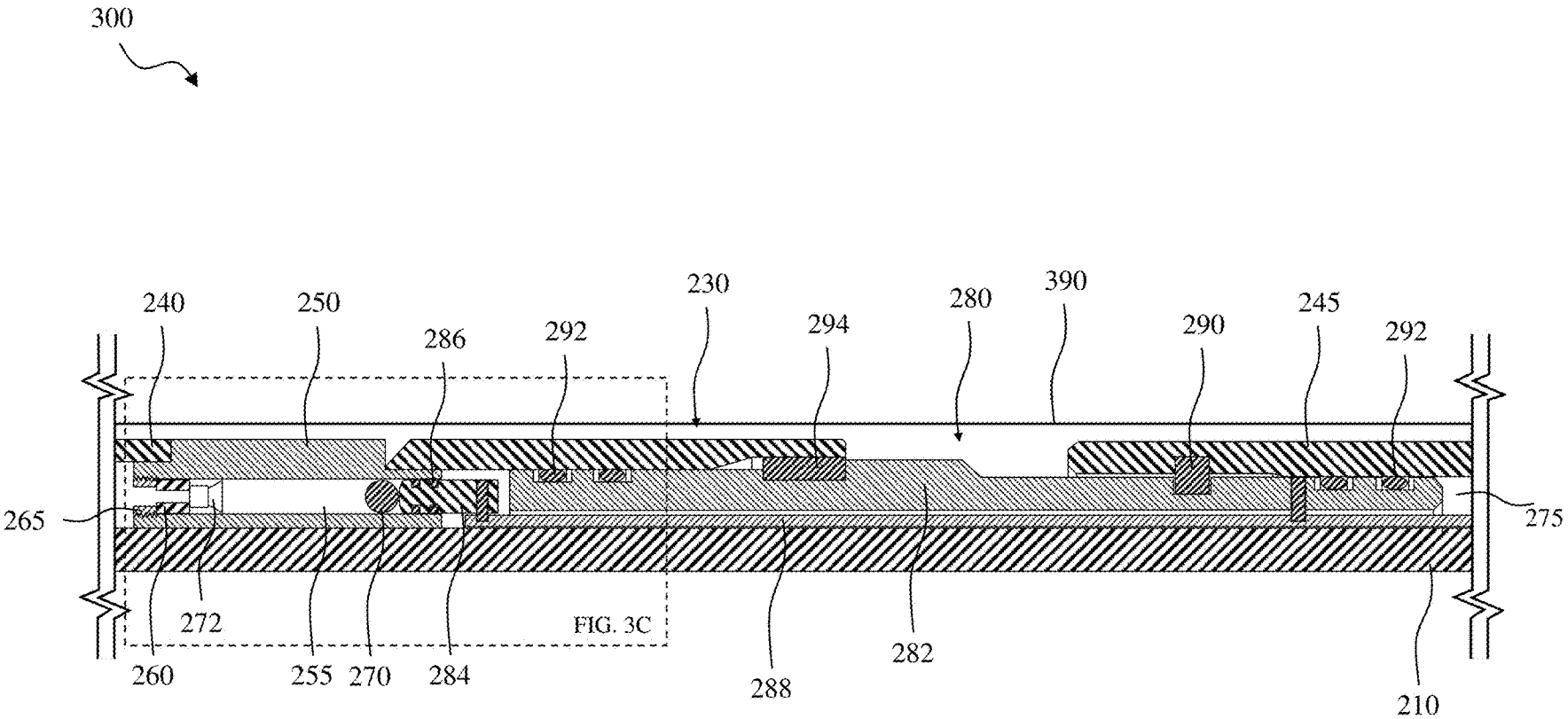
Figure 3C:
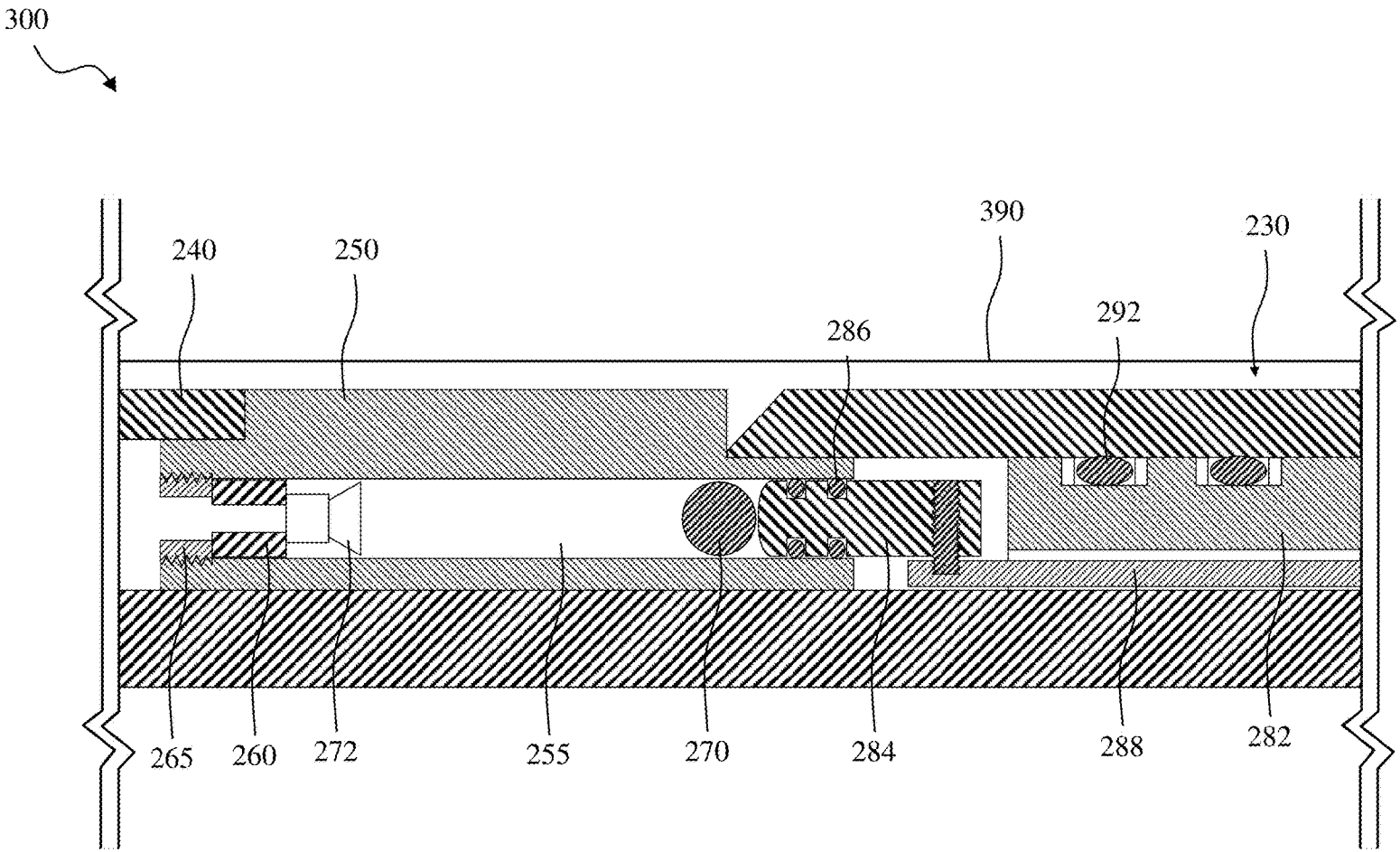

With initial reference to FIGS. 3A through 3C, illustrated is the flow control assembly 300 as it would initially be positioned within the wellbore 390 (e.g., at its run-in-hole state), for example creating an annulus 395 therebetween. As illustrated in FIGS. 3A through 3C, the sliding piston assembly 280 is in its run-in-hole state, and thus the sliding piston assembly flow nozzle chamber stopper 284 is located within and seals the flow control housing flow nozzle chamber 255. Similarly, the sliding piston assembly flow nozzle chamber stopper 284 keeps the flow control housing plug member 270 within the flow control housing flow nozzle chamber 255 and prevents fluid flow from the annulus of the wellbore 390 to the inside diameter (ID) of the downhole tubular 210.

Figure 3D:
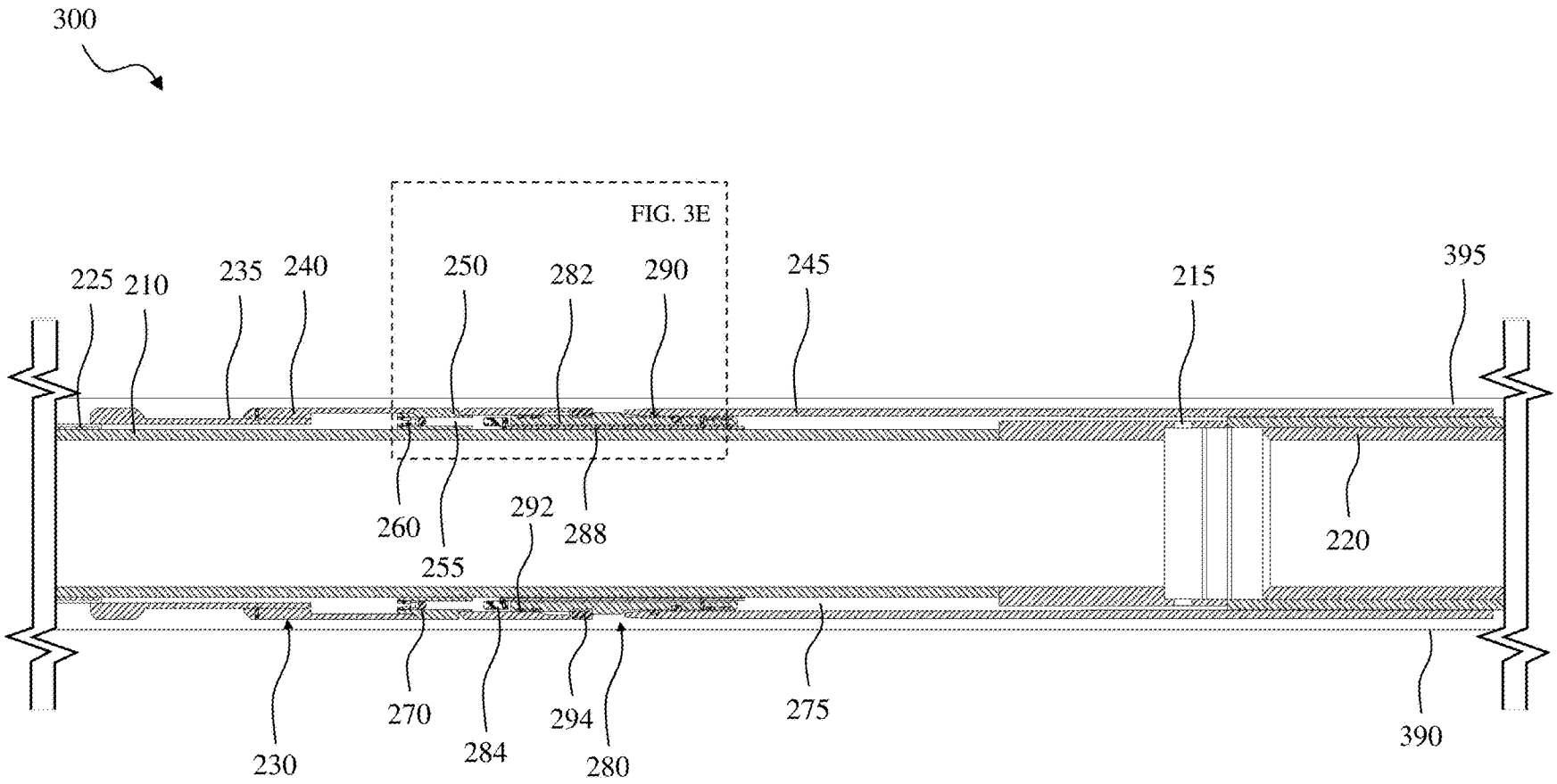
Figure 3E:
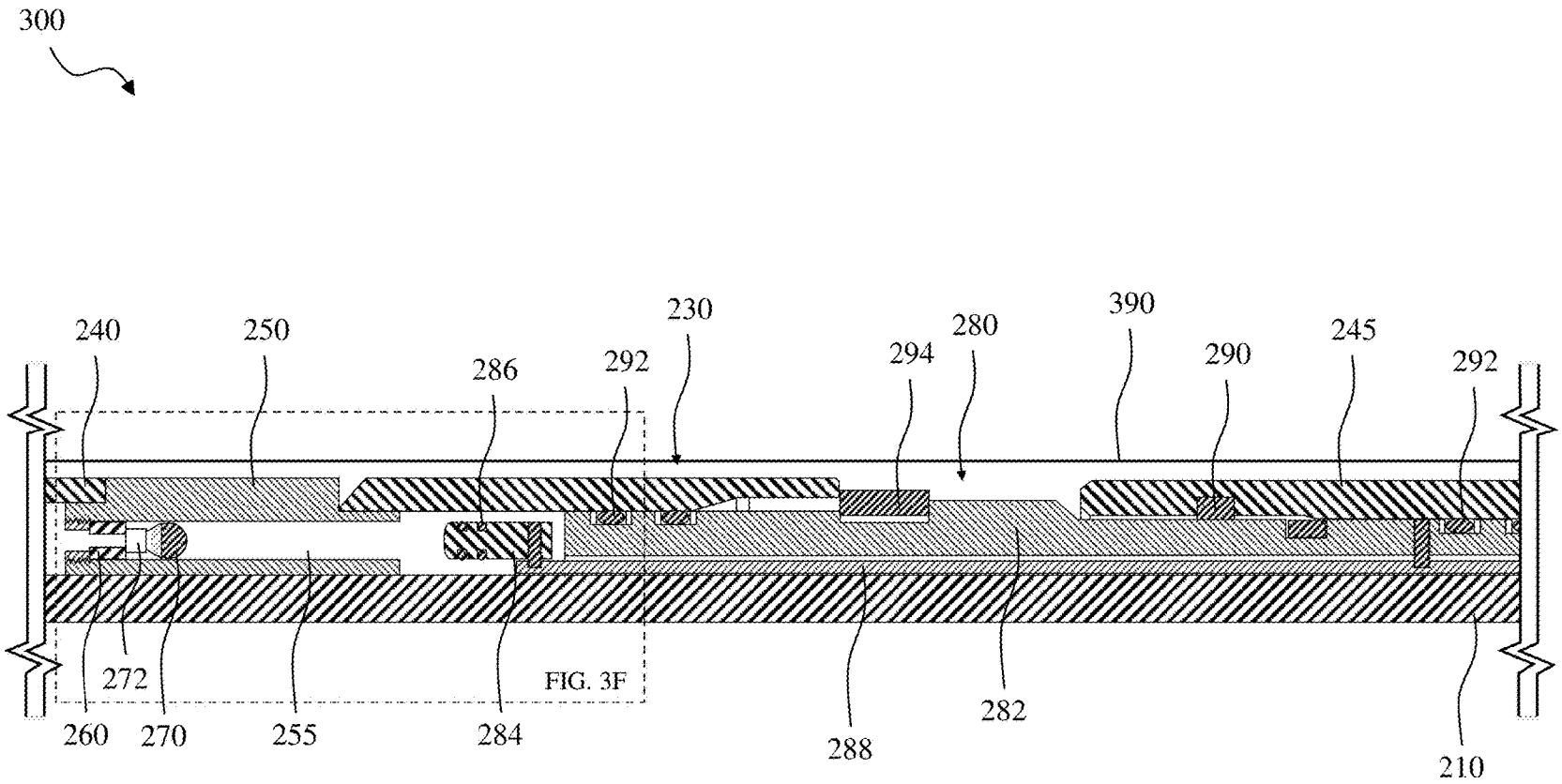
Figure 3F:
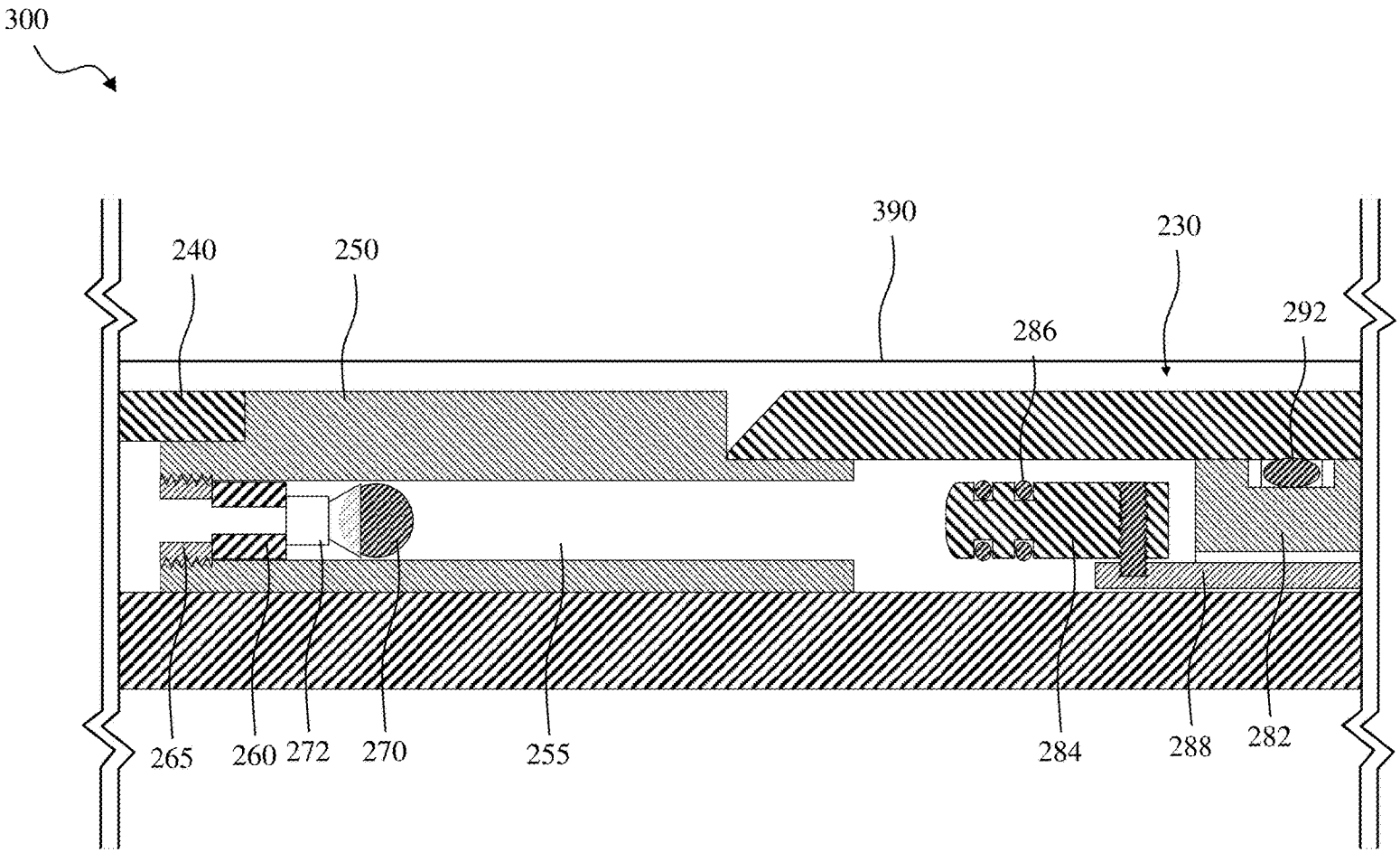

Turning to FIGS. 3D through 3F, illustrated is the flow control assembly 300 of FIGS. 3A through 3C after subjecting the flow control assembly 300 to a first lower predetermined threshold pressure, the first lower predetermined threshold pressure sliding the sliding piston assembly 280 from the run-in-hole state of FIGS. 3A through 3C to the activated state of FIGS. 3D through 3F. As there is pressure below the flow control housing plug member 270, the flow control housing plug member 270 is urged toward the flow control housing plug member seat 272, which in turn prevents fluid flow from the inside diameter (ID) of the downhole tubular 210 to the annulus 395.

Figure 3G:
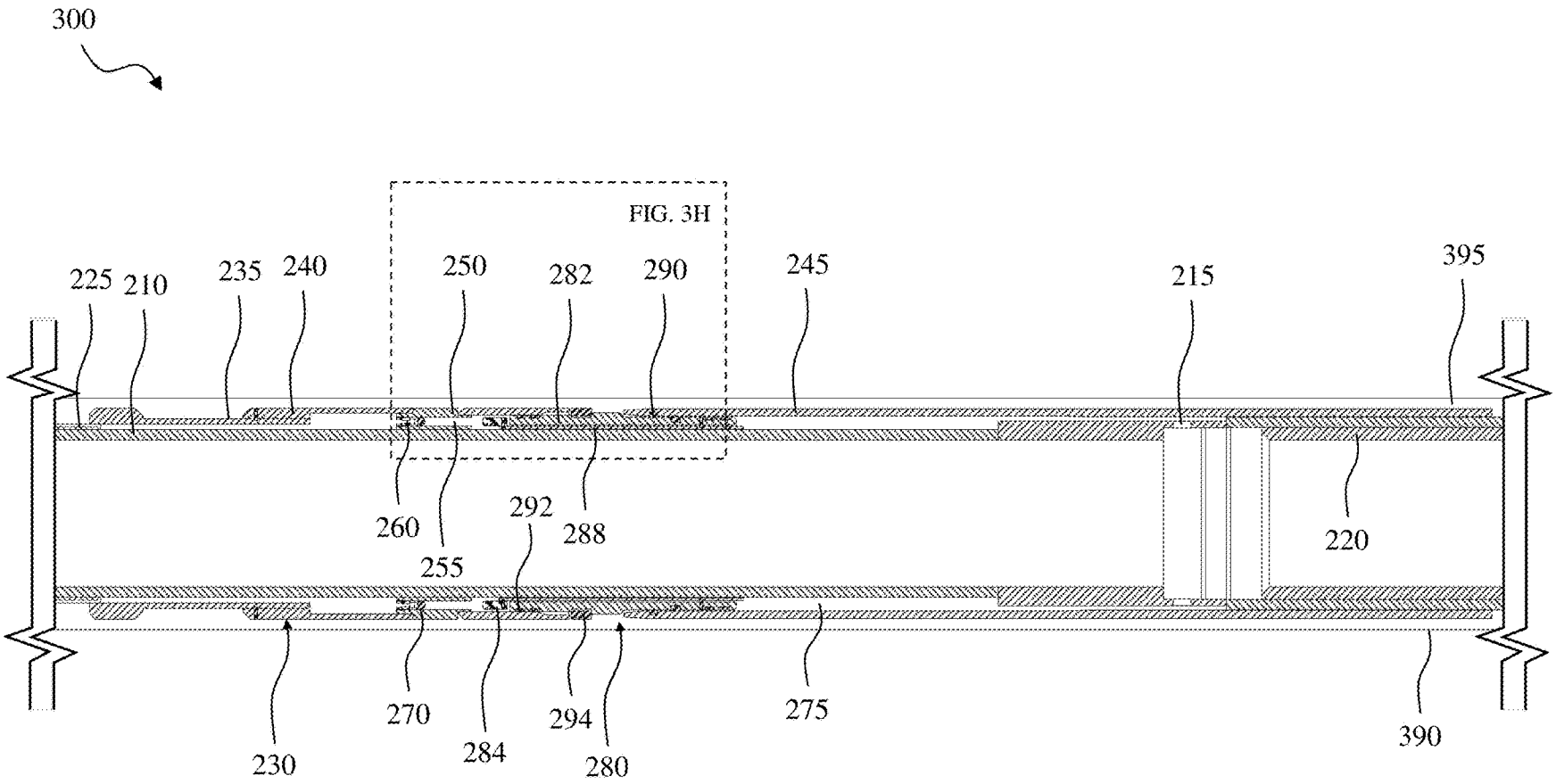
Figure 3H:
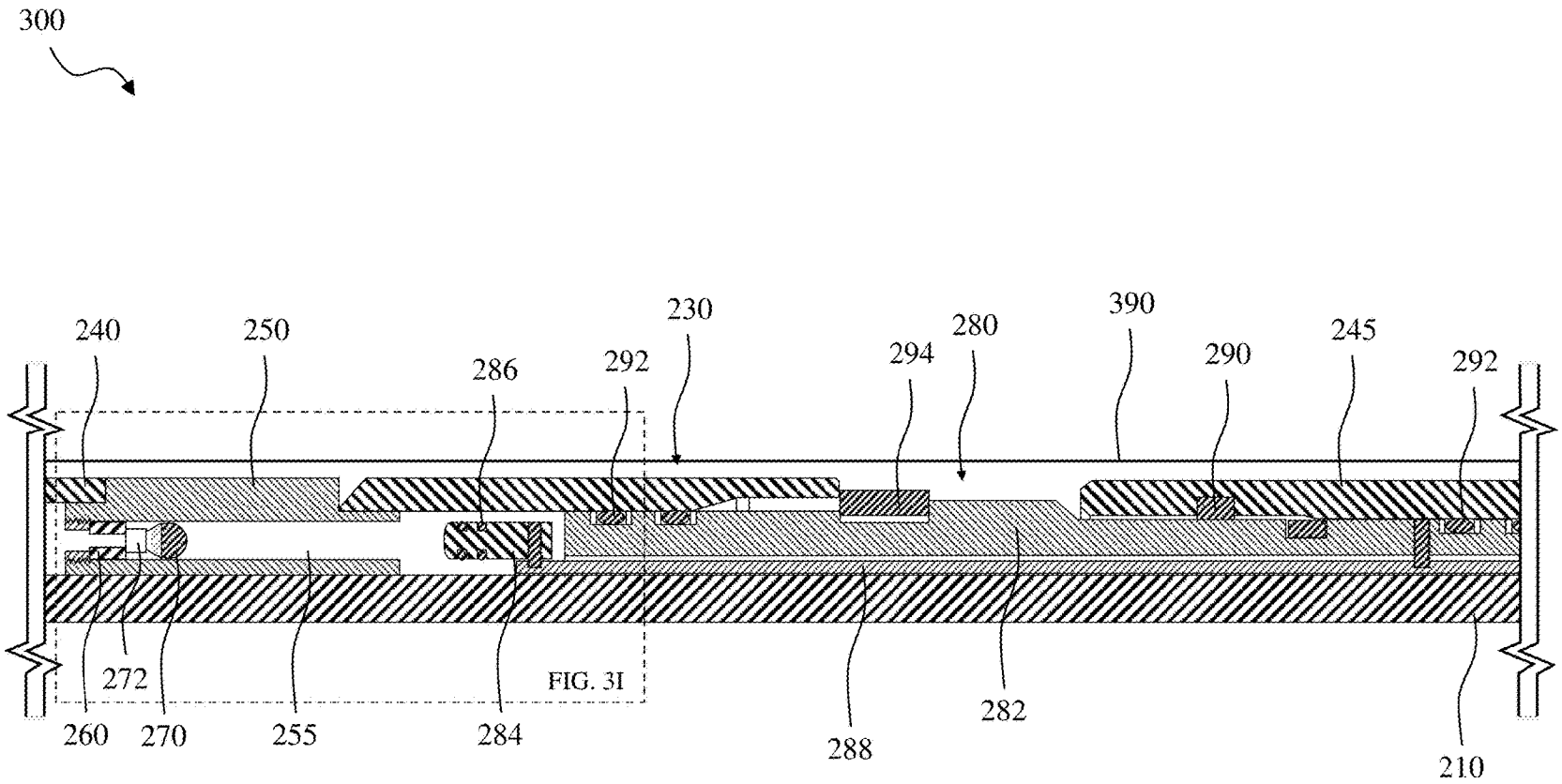
Figure 3I:
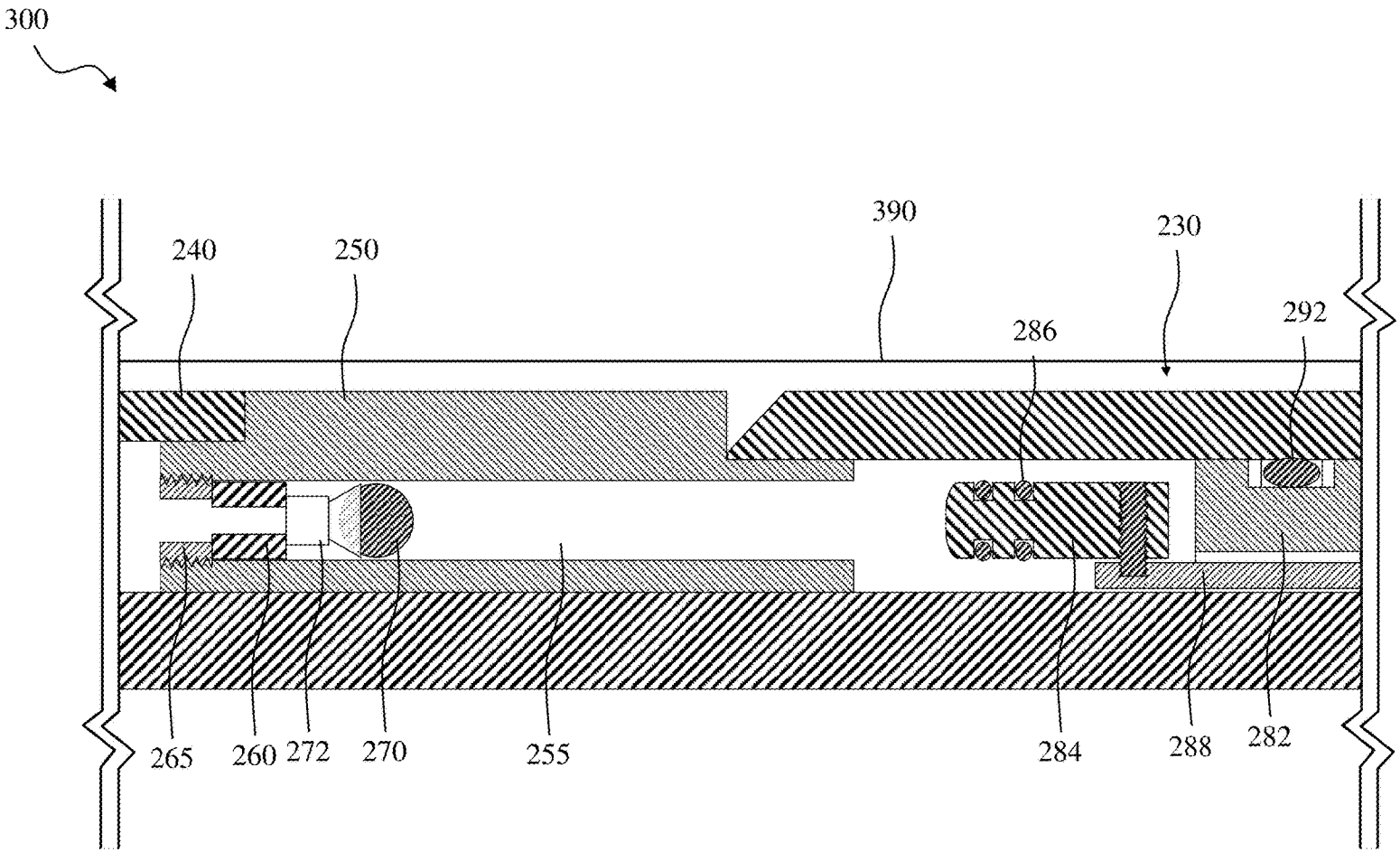

Turning to FIGS. 3G through 3I, illustrated is the flow control assembly 300 of FIGS. 3D through 3F after subjecting the flow control assembly 300 to a second higher predetermined threshold pressure. In this embodiment, the second higher predetermined threshold pressure is configured to set the one or more wellbore packers.

Figure 3J:
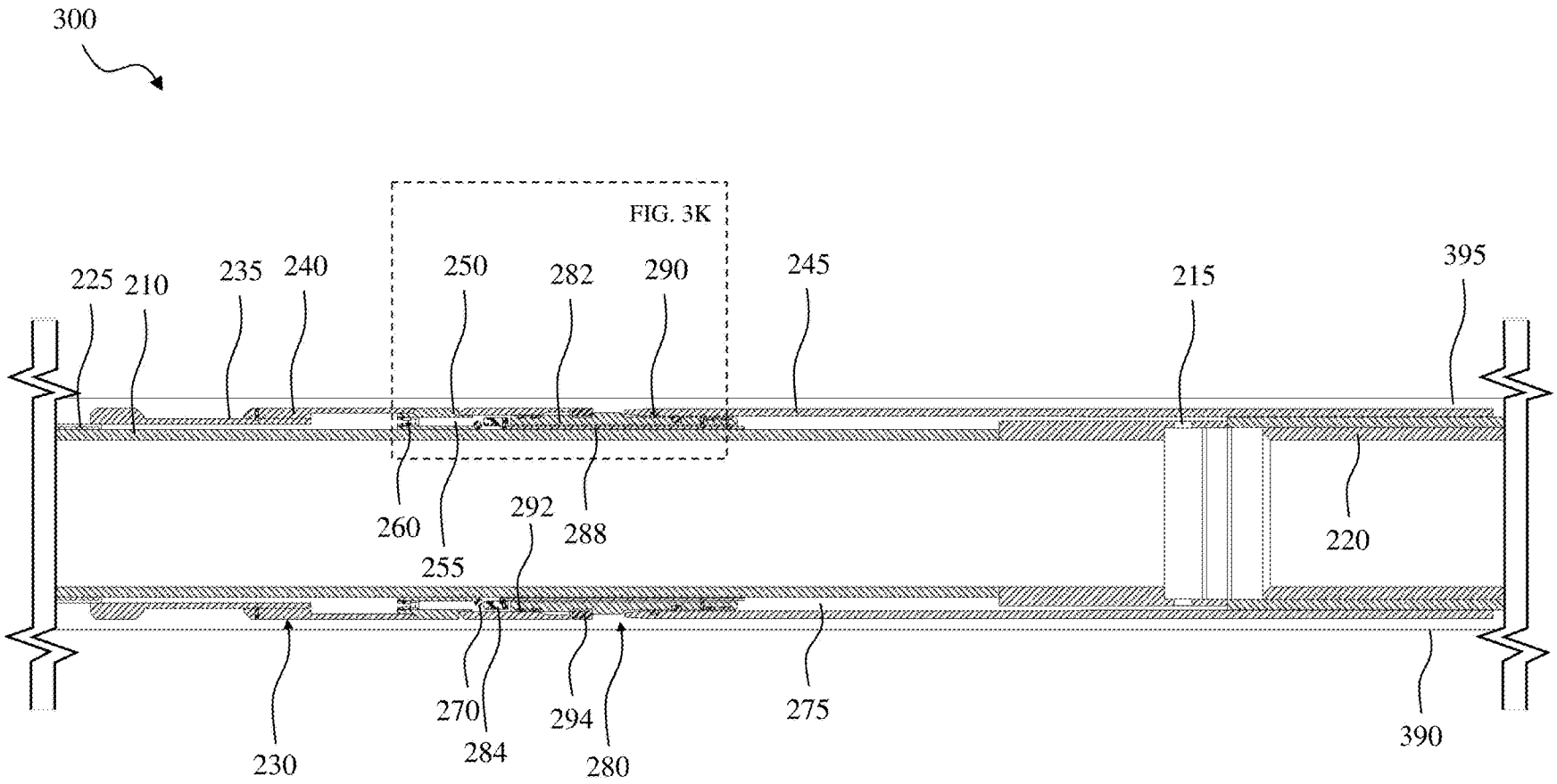
Figure 3K:
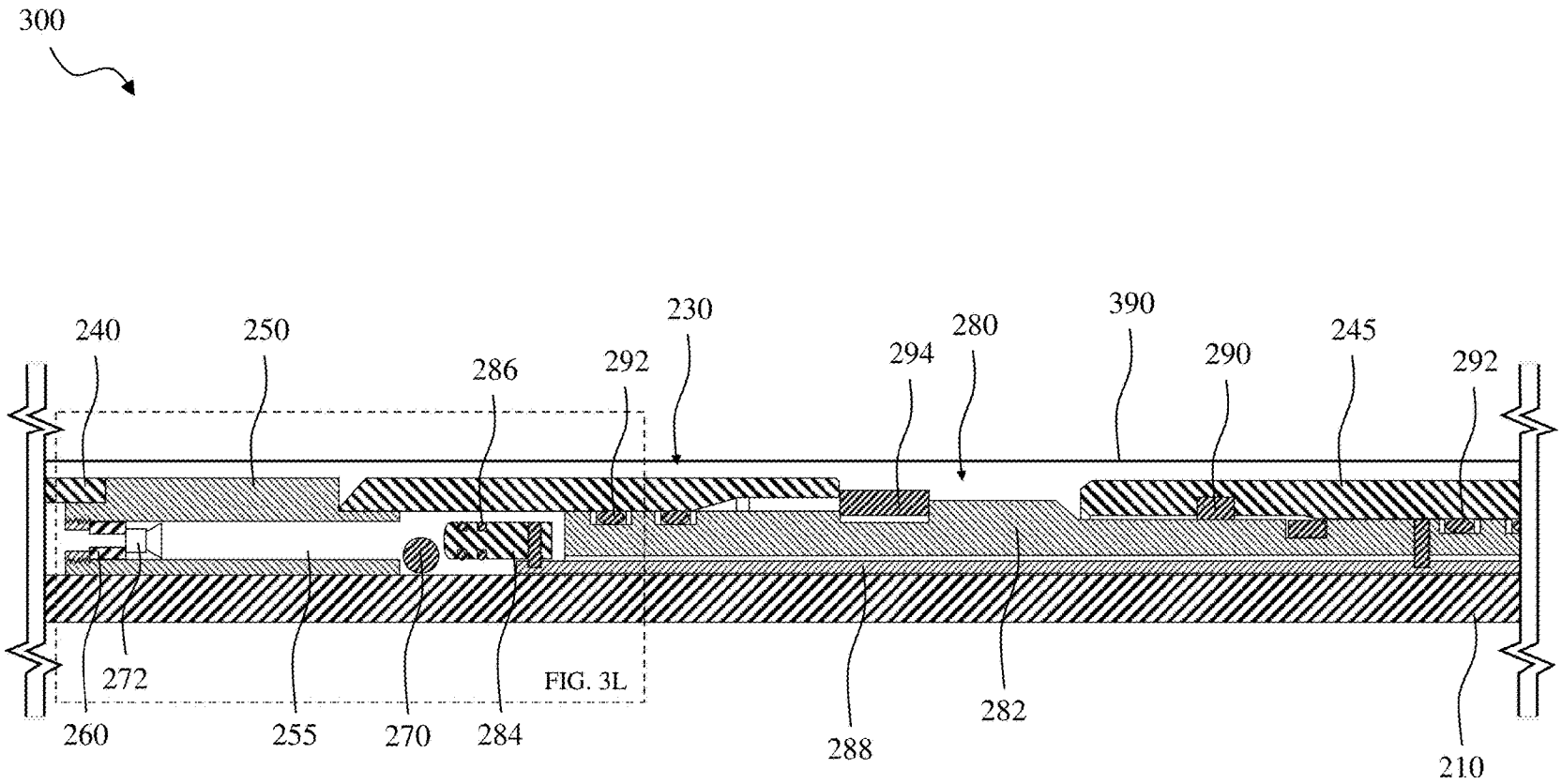
Figure 3L:
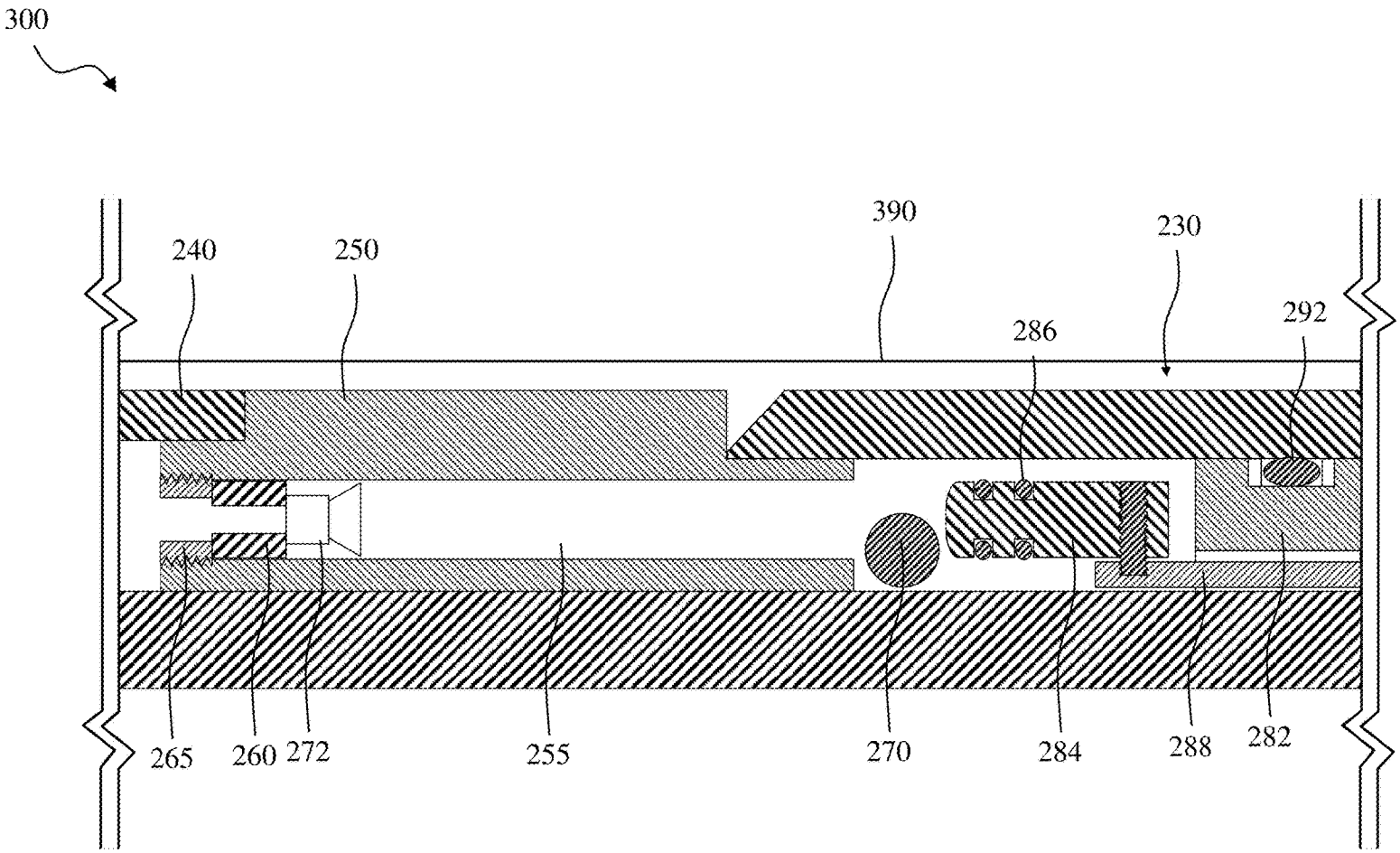
Figure 3M:
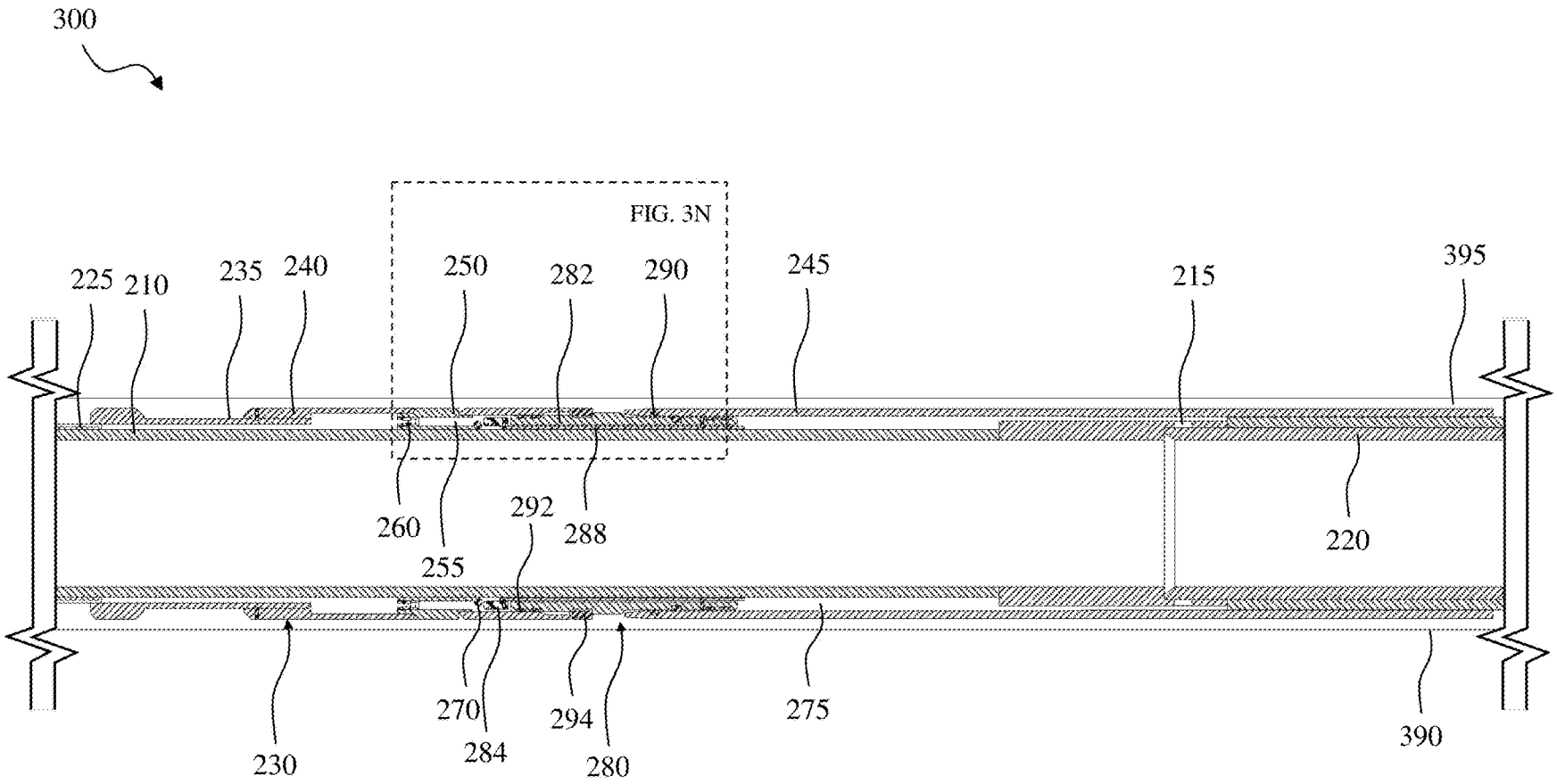
Figure 3N:
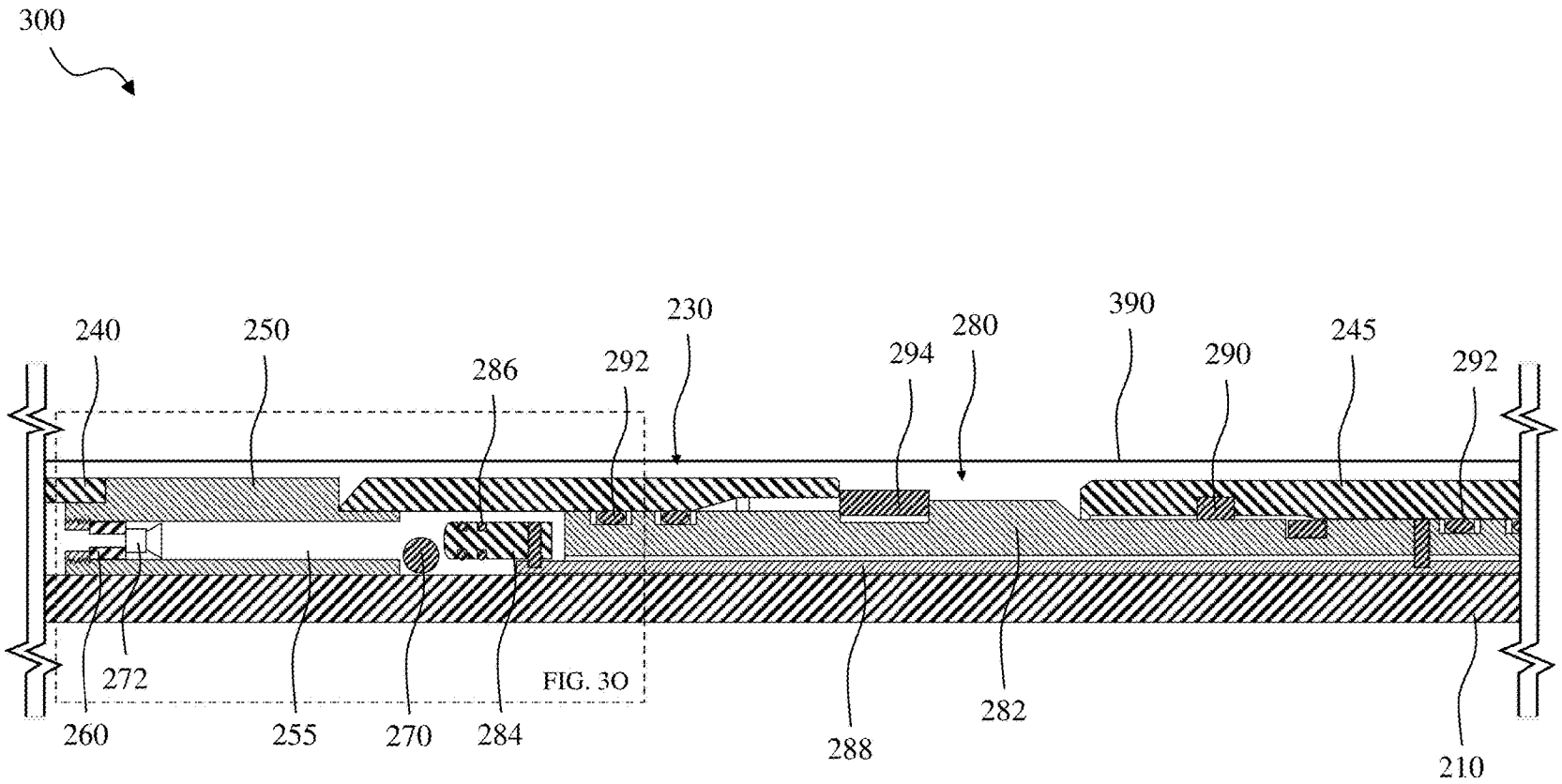
Figure 3O:
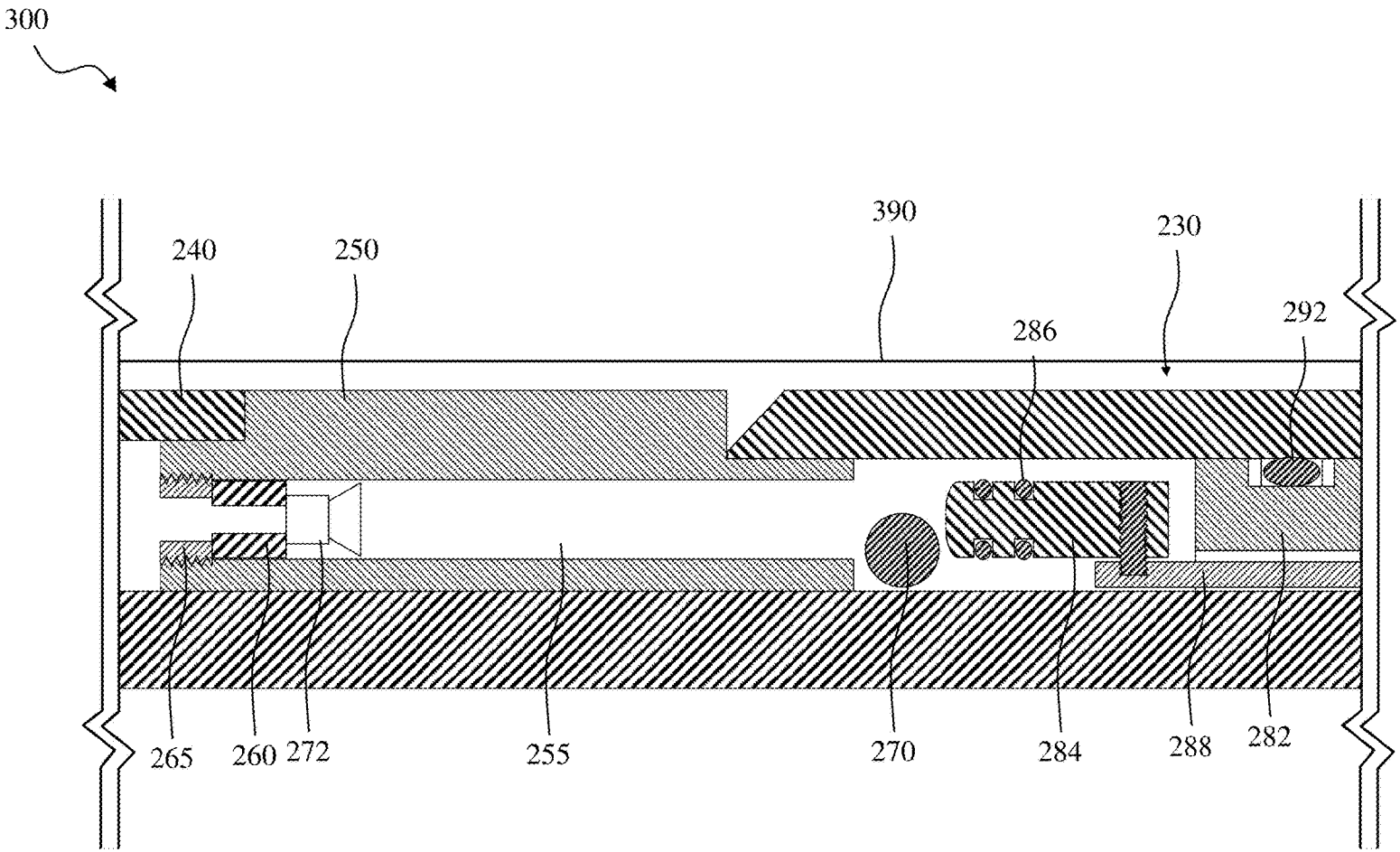

Turning to FIGS. 3J through 3L, illustrated is the flow control assembly 300 of FIGS. 3G through 3I after reducing the pressure being applied to the flow control assembly 300, which in turn allows the flow control housing plug member 270 to traverse into the piston chamber 275 and allow fluid flow from the annulus 395 of the wellbore 390 to the inside diameter (ID) of the downhole tubular 210.

Turning to FIGS. 3M through 30, illustrated is the flow control assembly 300 of FIGS. 3J through 3L after shifting the downhole tubular inner sleeve 220 (e.g., located radially inside of the downhole tubular 210) from the open state (e.g., exposing the downhole tubular opening 215 to allow fluid flow between the inside diameter (ID) of the downhole tubular 210 and the outside diameter (OD) of the downhole tubular 210) to the closed state (e.g., covering the downhole tubular opening 215 to prevent fluid flow between the inside diameter (ID) of the downhole tubular 210 and the outside diameter (OD) of the downhole tubular 210).

Figure 4A:
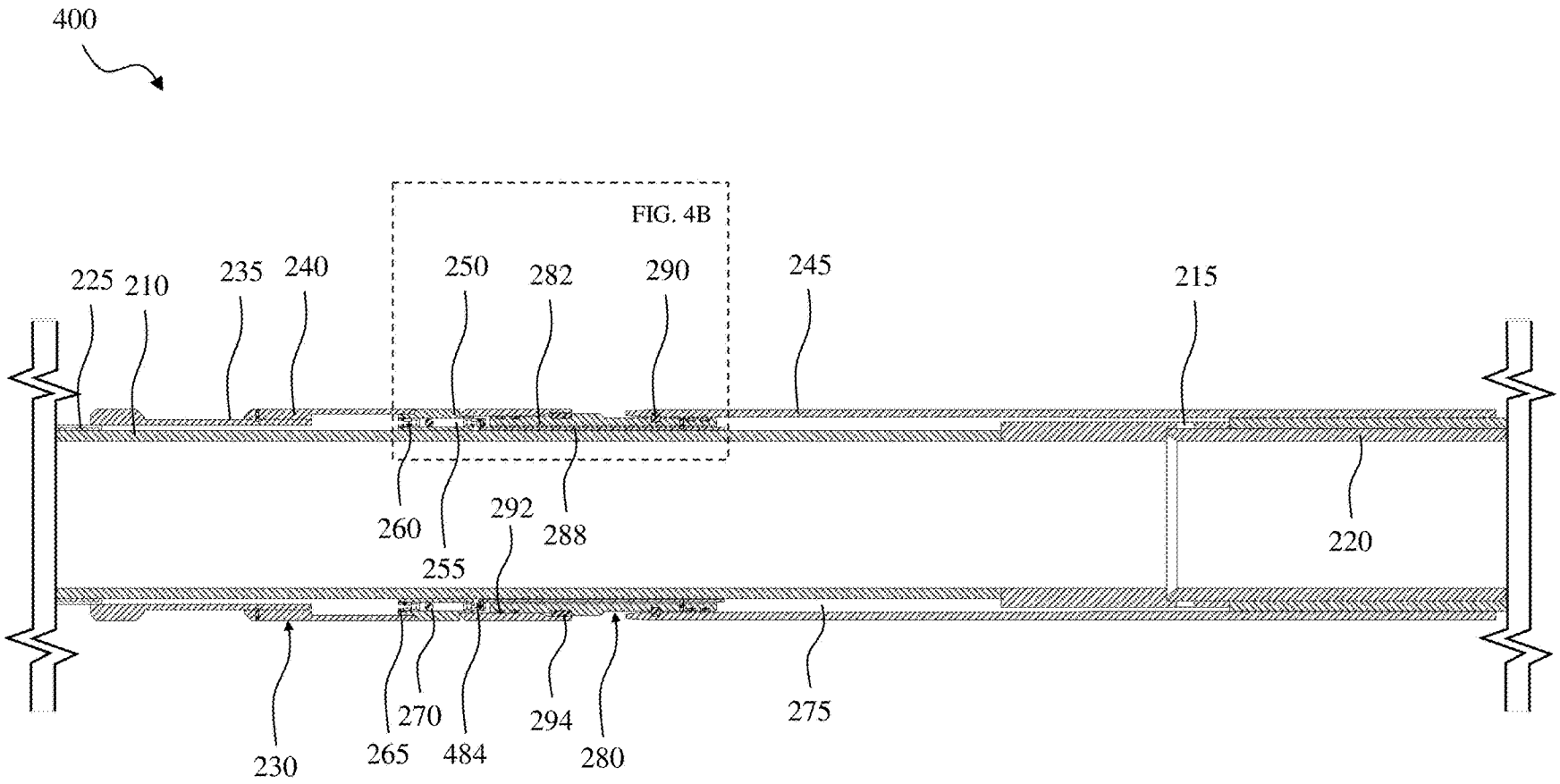
FIGS. 4A through 4C illustrate various different cross-sectional views of a flow control assembly designed, manufactured and/or operated according to one or more alternative embodiments of the disclosure.
Figure 4B:
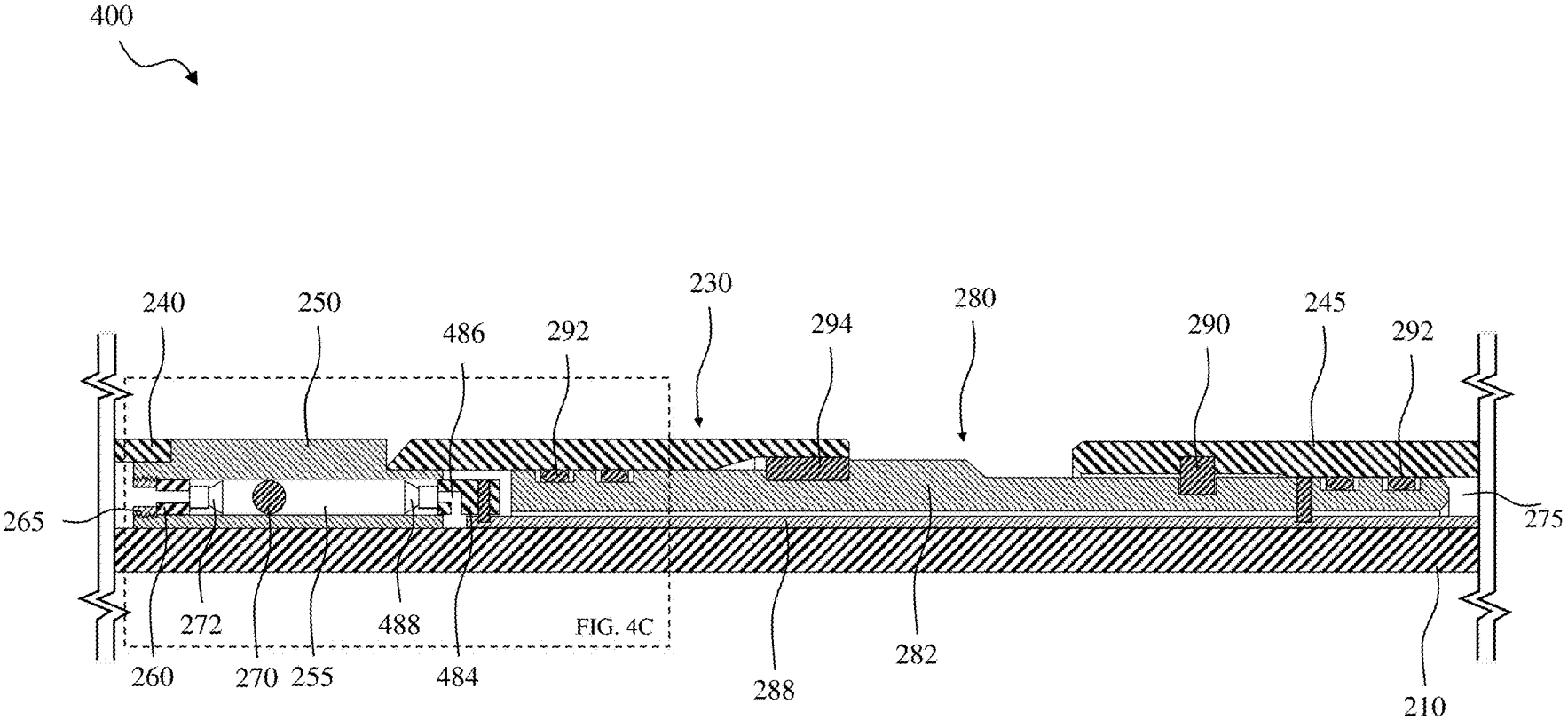
Figure 4C:
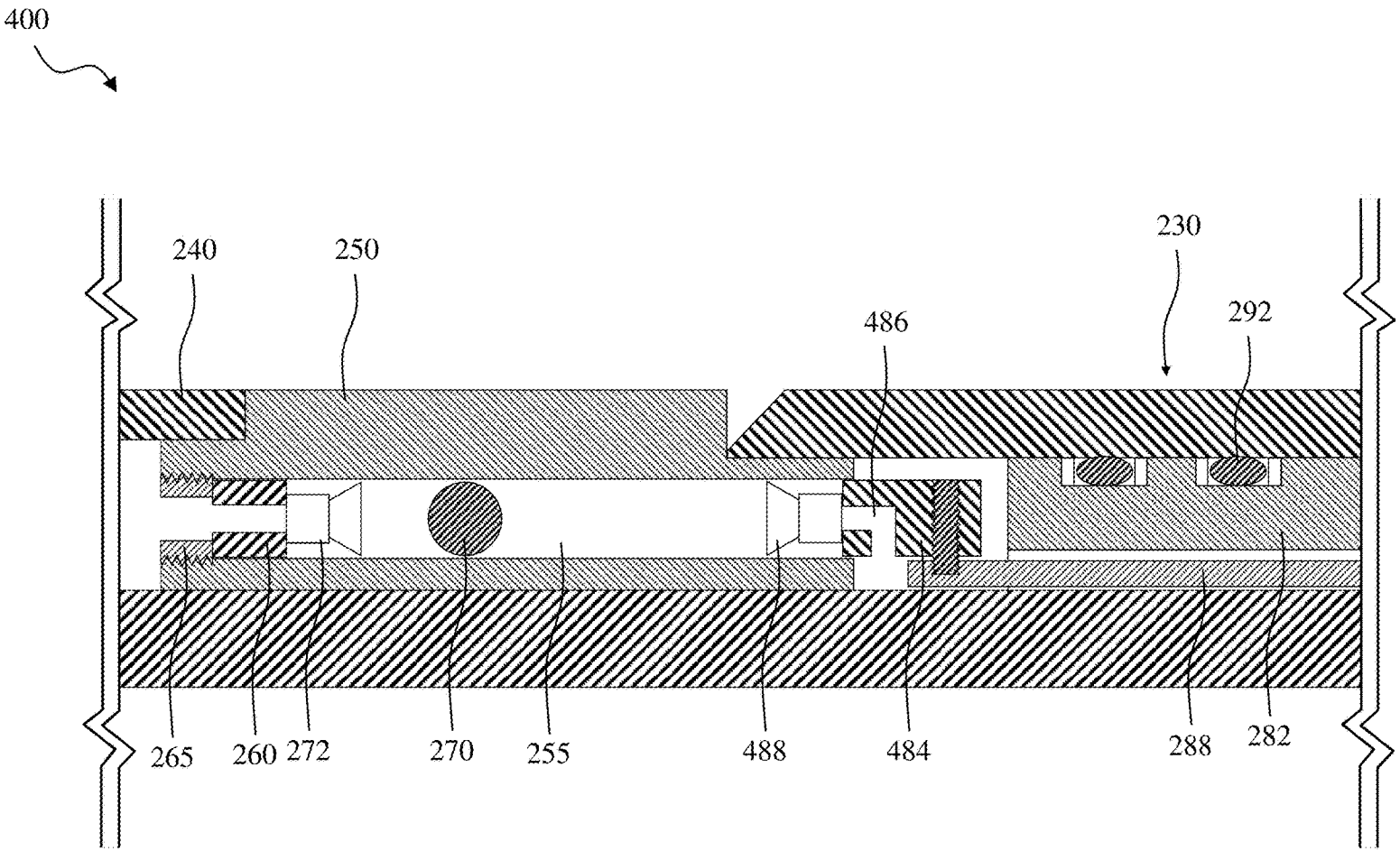

Turning to FIGS. 4A through 4C, illustrated are various different cross-sectional views of a flow control assembly 400 designed, manufactured and/or operated according to one or more alternative embodiments of the disclosure. The flow control assembly 400 of FIGS. 4A through 4C is similar in many respects to the flow control assembly 200 of FIGS. 2A through 2C. Accordingly, like reference numbers have been used to indicate similar, if not identical, features.

The flow control assembly 400 differs, for the most part, from the flow control assembly 200, in that its sliding piston assembly flow nozzle chamber stopper 484 includes an internal flow channel 486 fluidly coupling the flow control housing flow nozzle chamber 255 and the piston chamber 275. The flow control assembly 400, in at least this one embodiment, further includes a sliding piston assembly plug member seat 488 (e.g., coupled to the sliding piston assembly flow nozzle chamber stopper 484). In this one embodiment, the flow control housing plug member 270 is configured to engage with the sliding piston assembly plug member seat 488, and thereby block the internal flow channel 486, for example to prevent fluid flow from the annulus of the wellbore to the inside diameter (ID) of the downhole tubular 210 (e.g., when the sliding piston assembly 280 is in the run-in-hole state.) In at least one embodiment, the flow control assembly 400 still includes the sliding piston assembly seal features 292, but in other embodiments, the flow control assembly 400 does not still include the sliding piston assembly seal features 292.

Figure 5A:
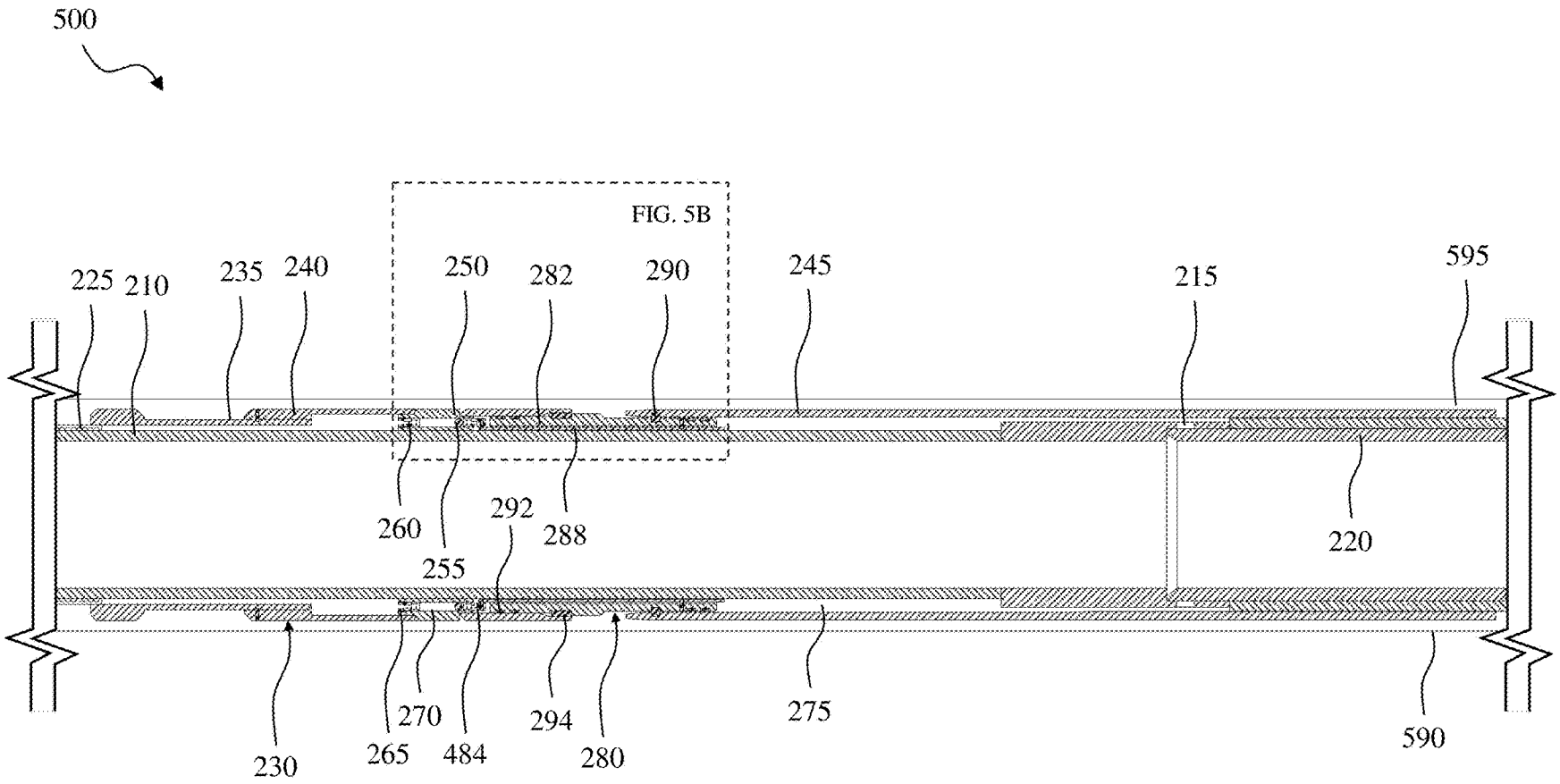
FIGS. 5A through 5R illustrate certain different cross-sectional views of a flow control assembly positioned within a wellbore at various different operational states.
Figure 5B:
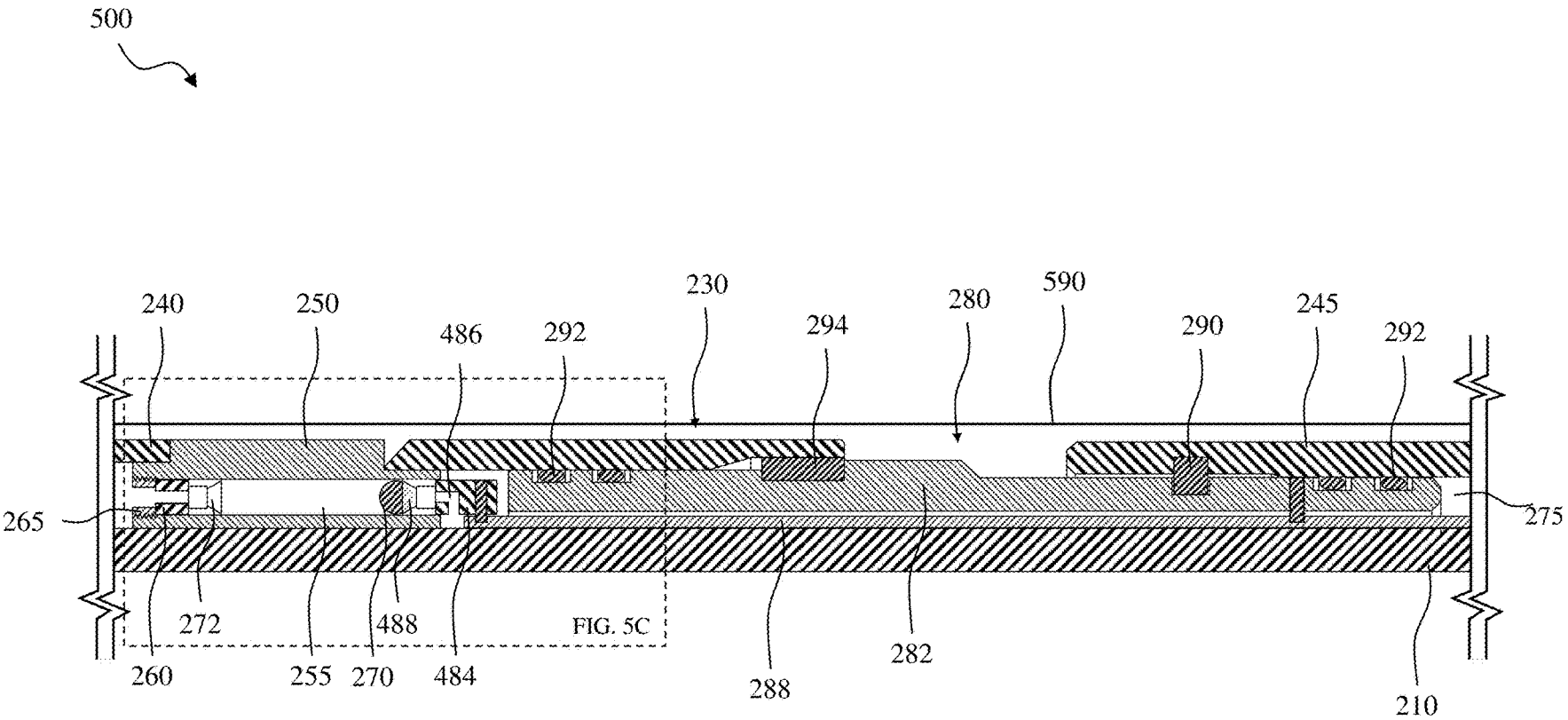
Figure 5C:
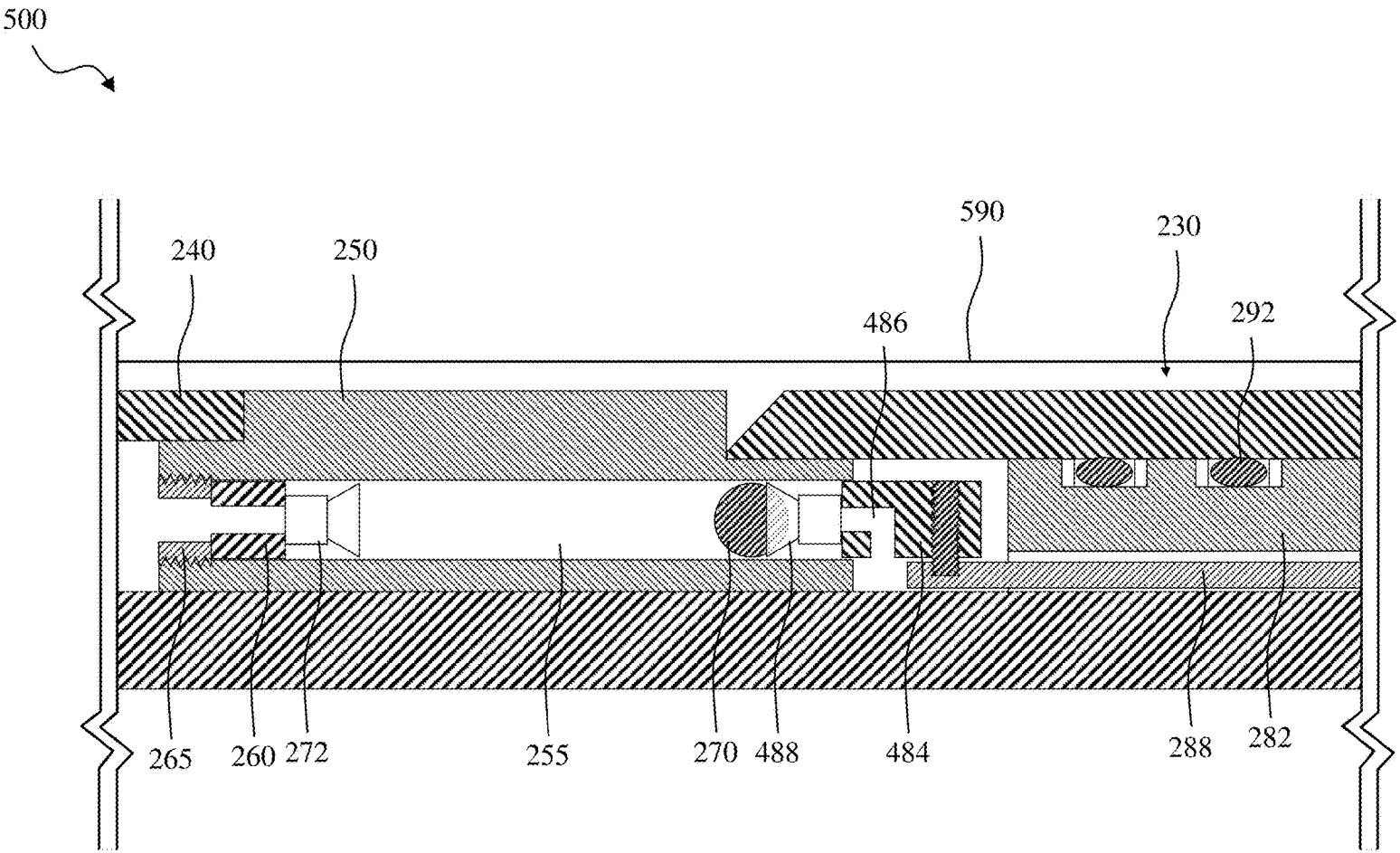
Figure 5D:
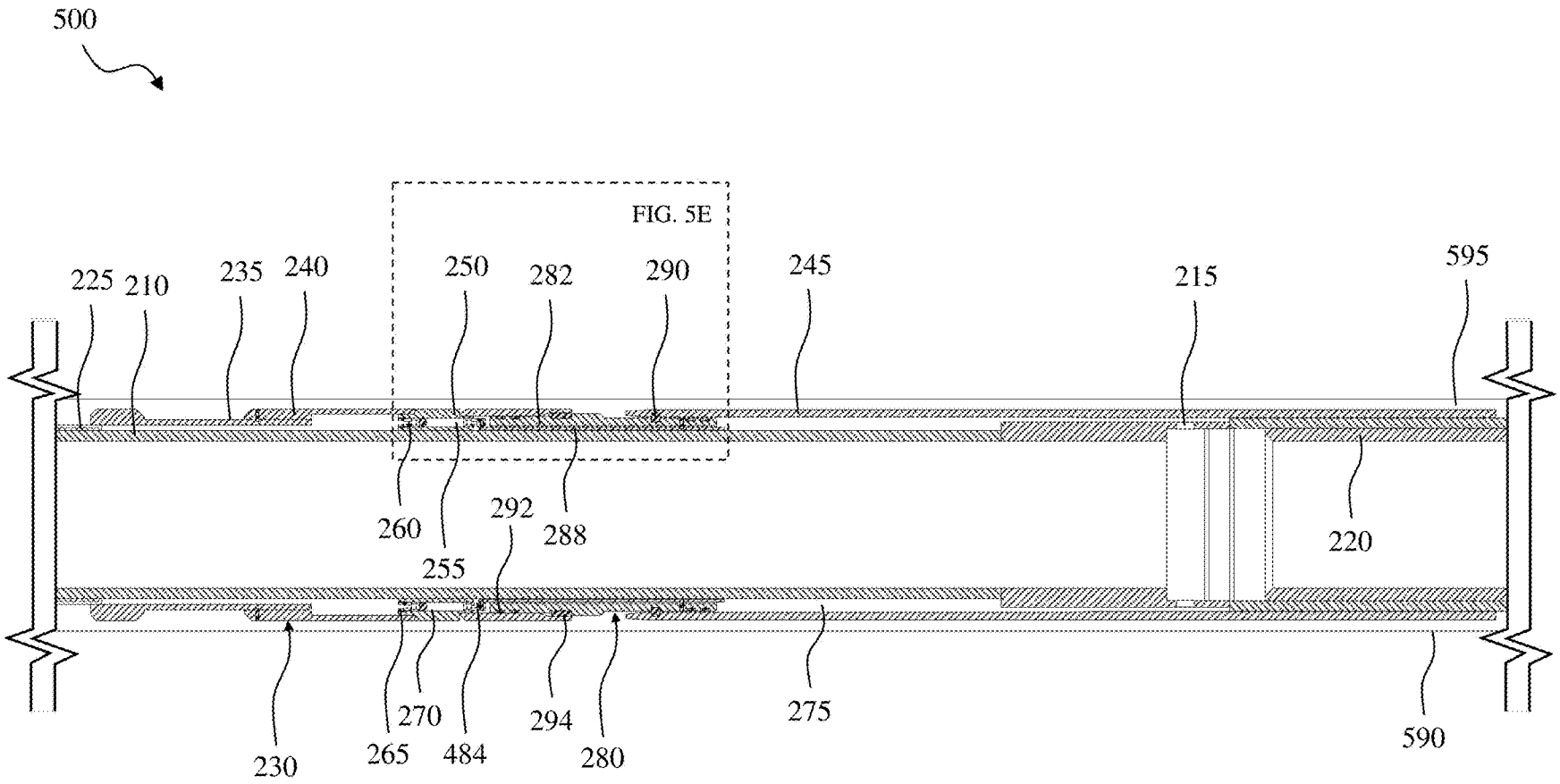
Figure 5E:
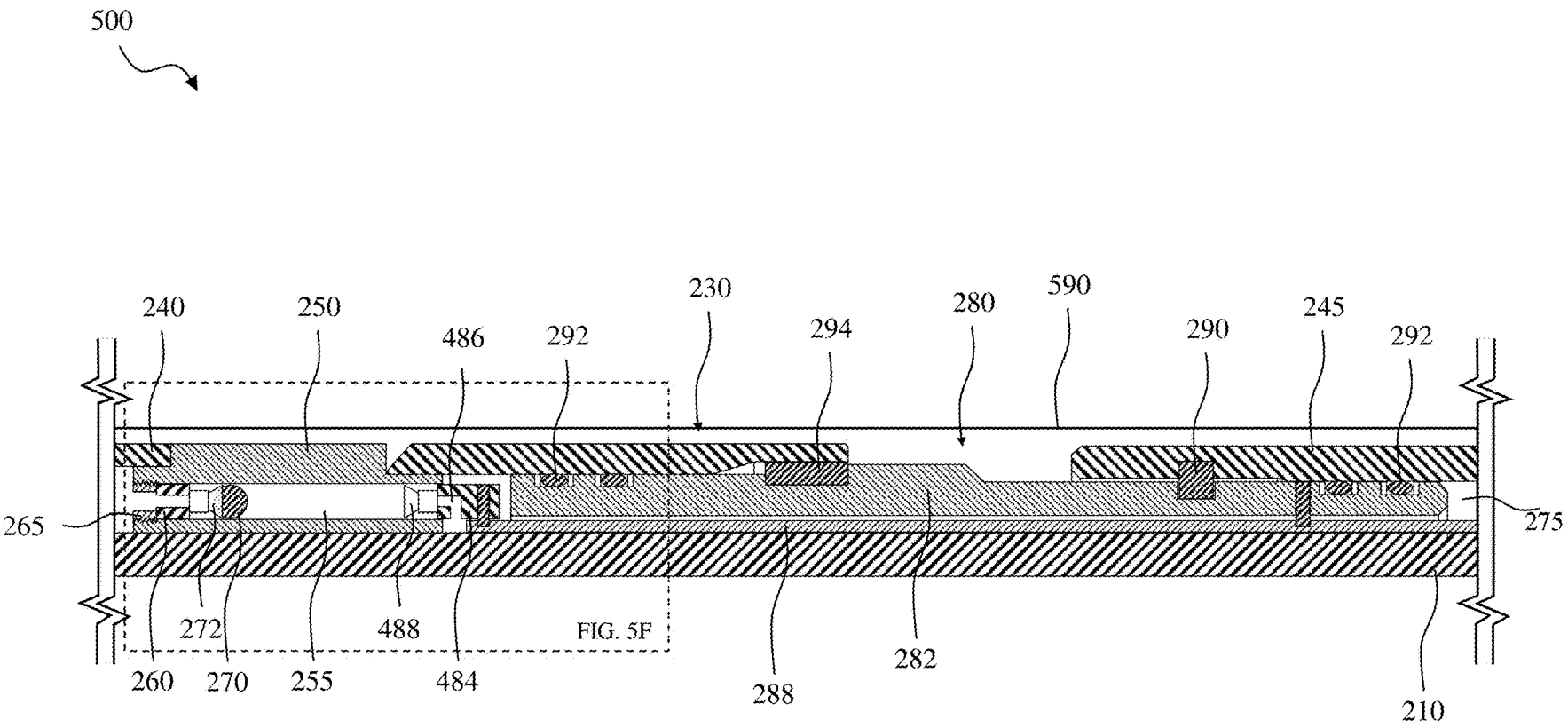
Figure 5F:
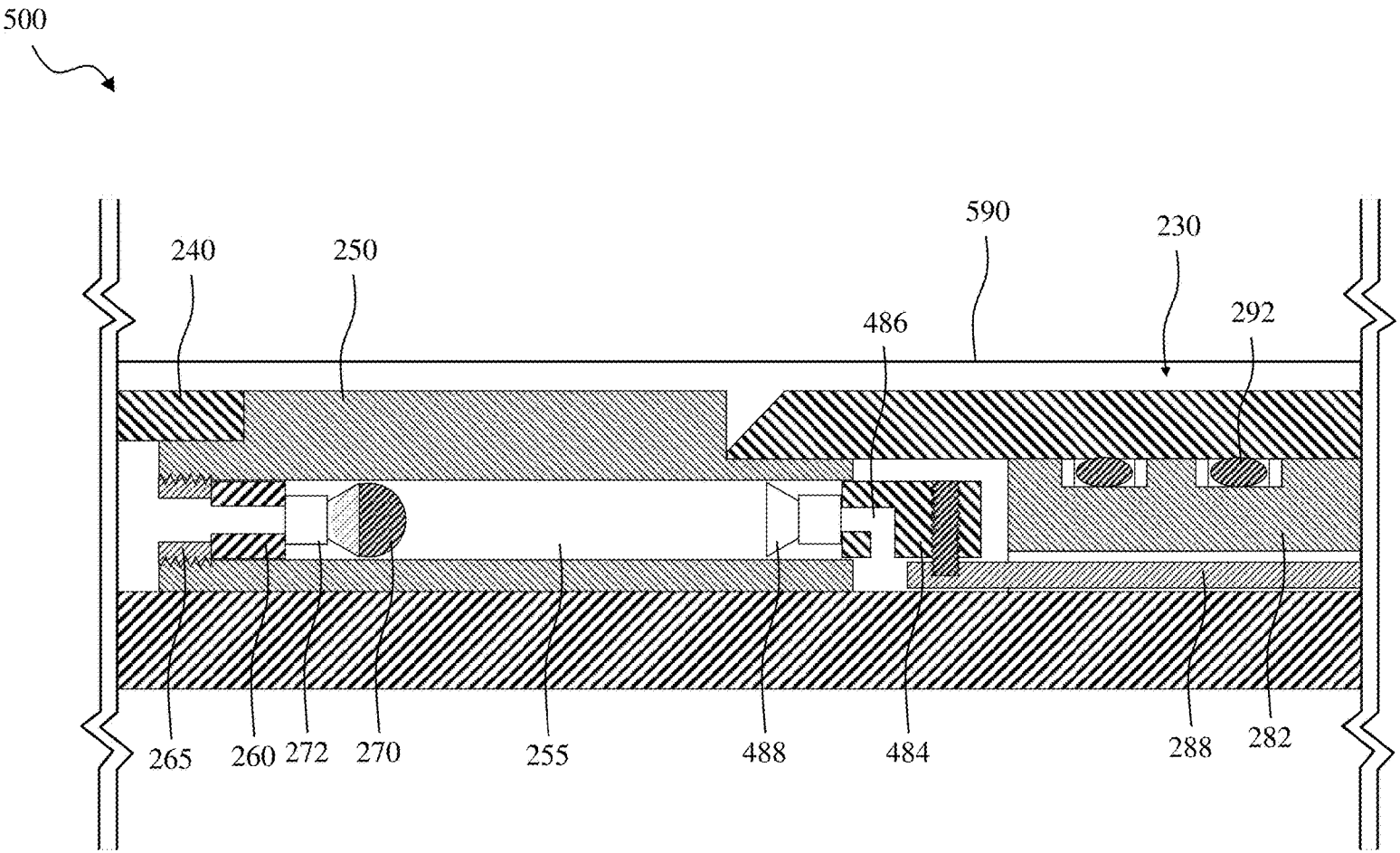
Figure 5G:
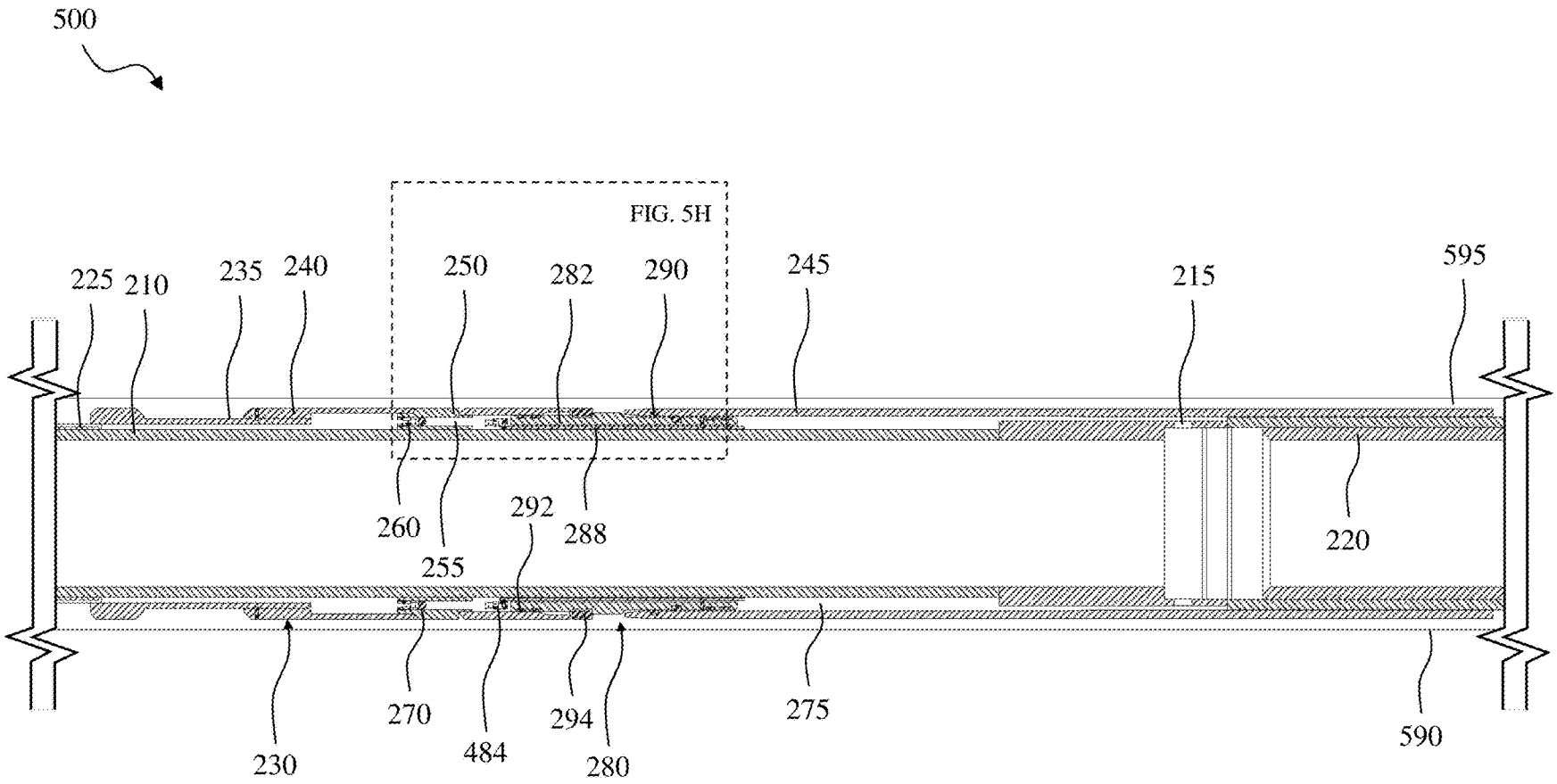
Figure 5H:
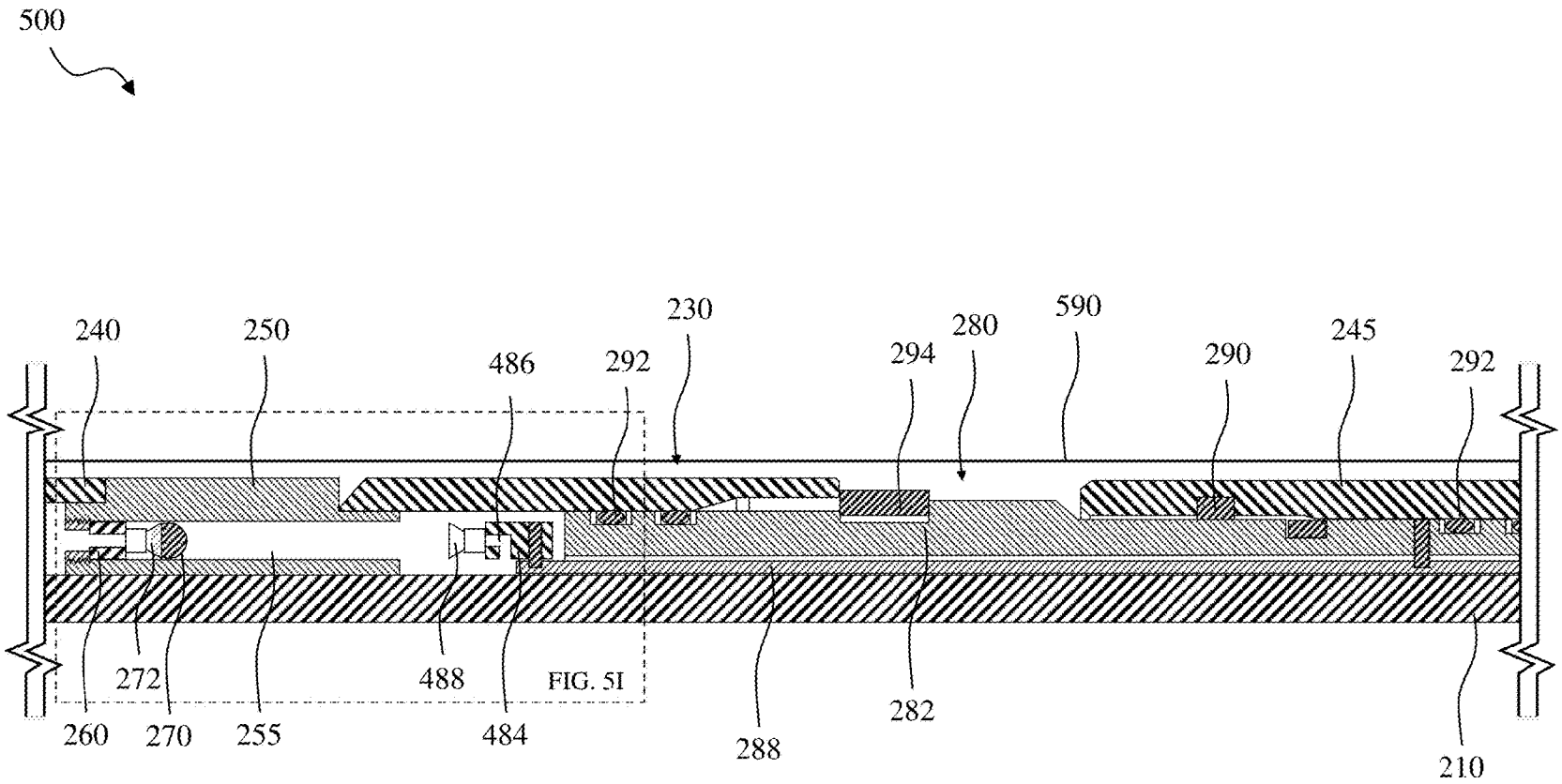
Figure 5I:
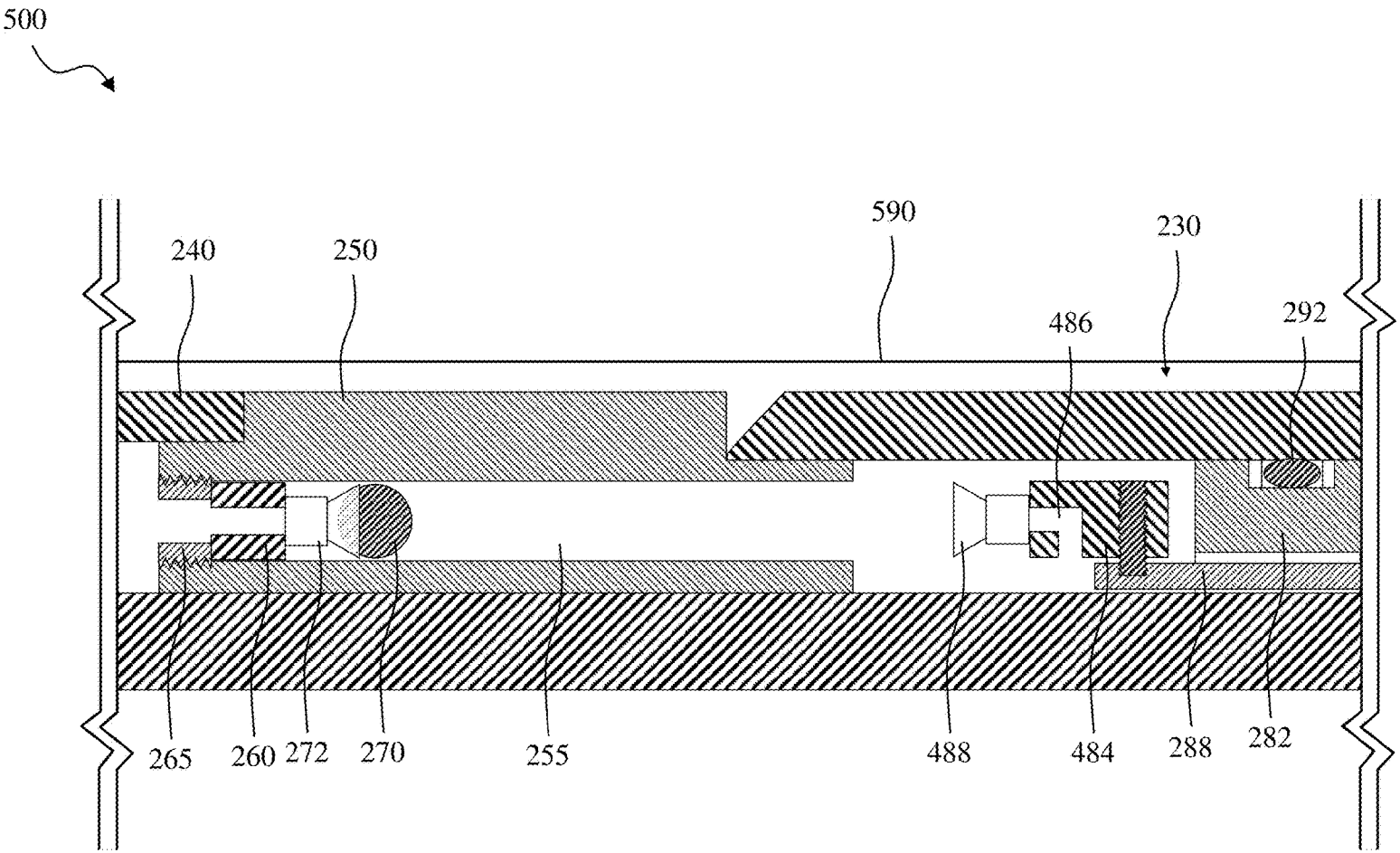
Figure 5J:
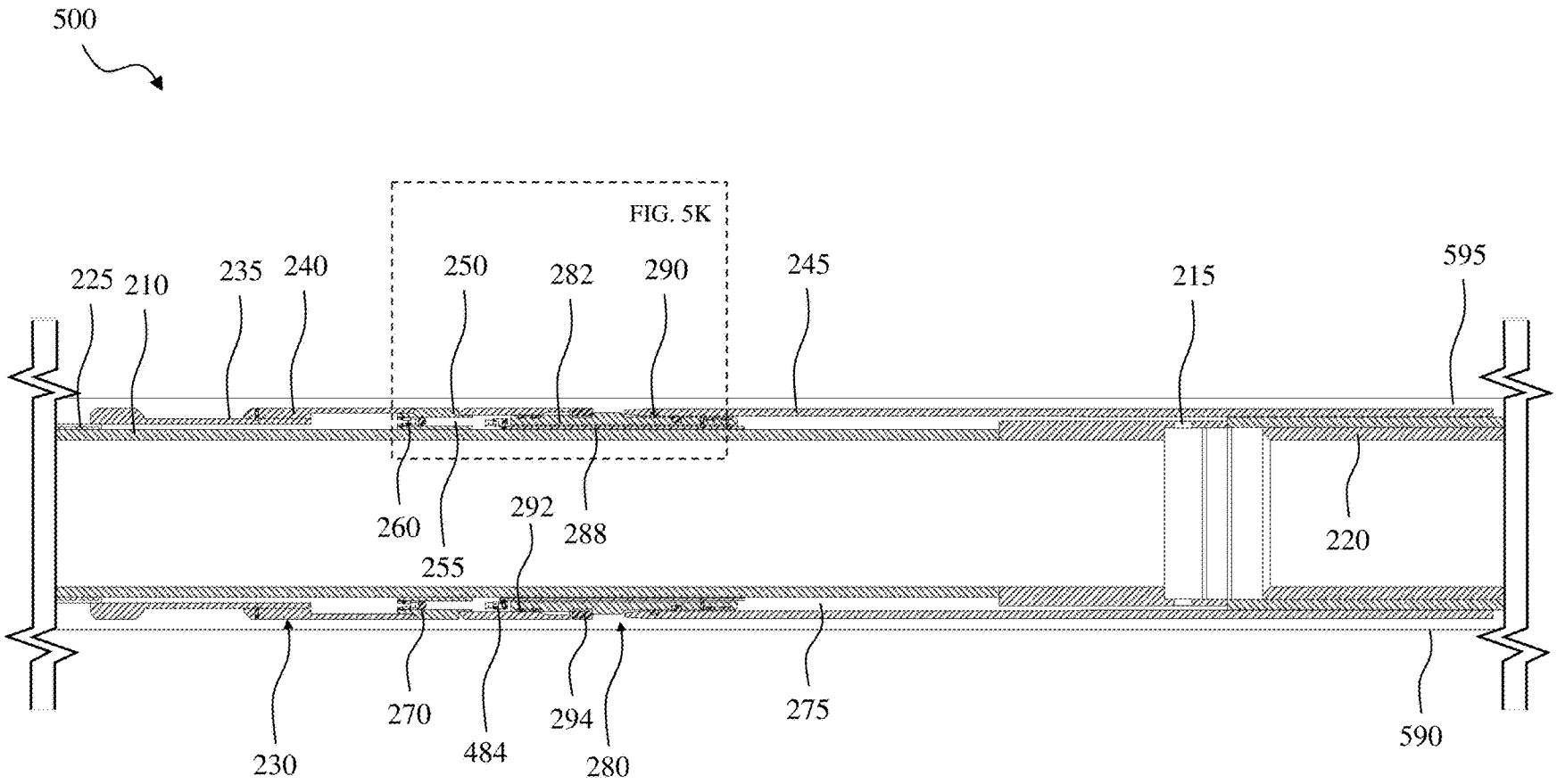
Figure 5K:
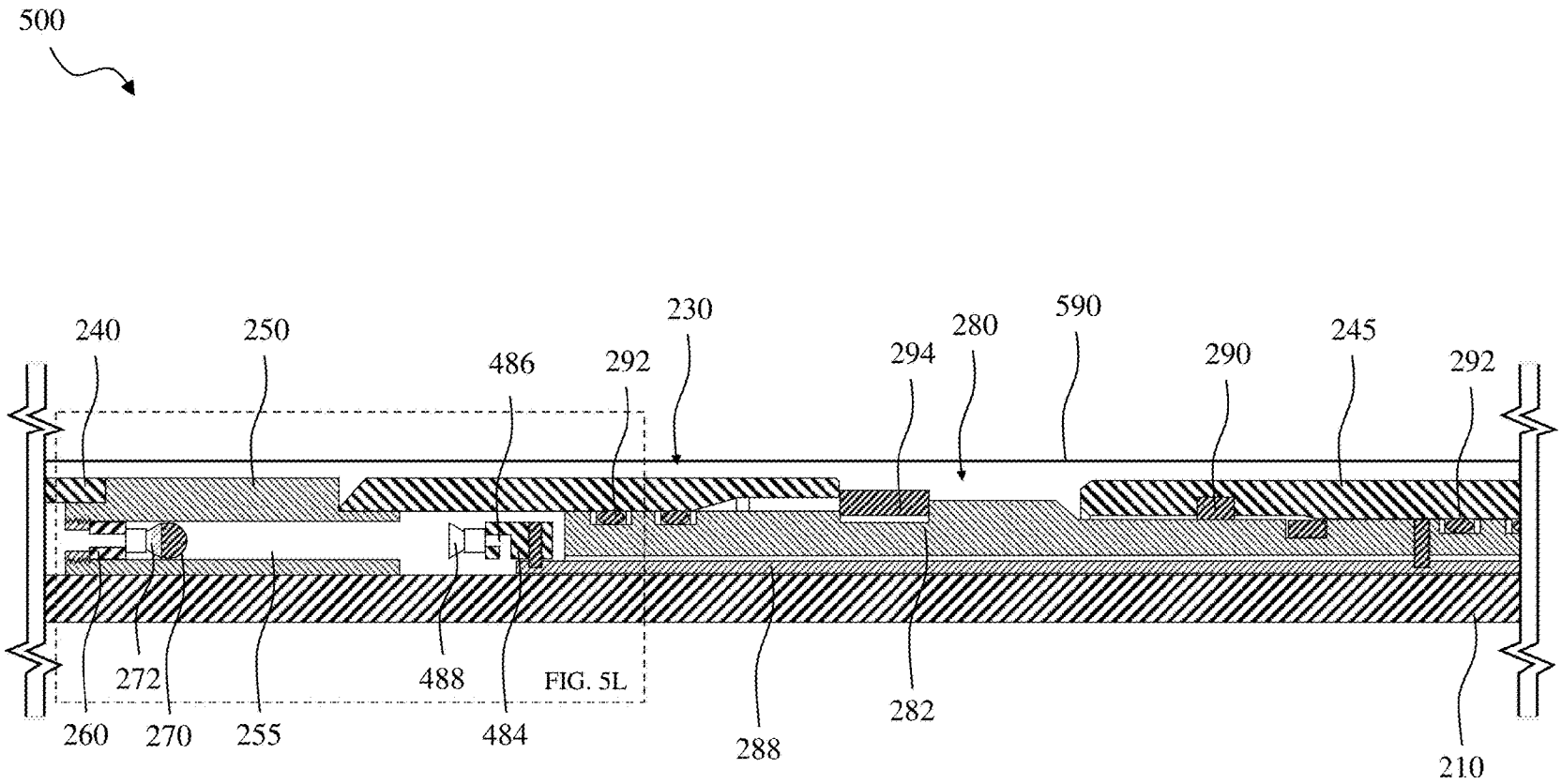
Figure 5L:
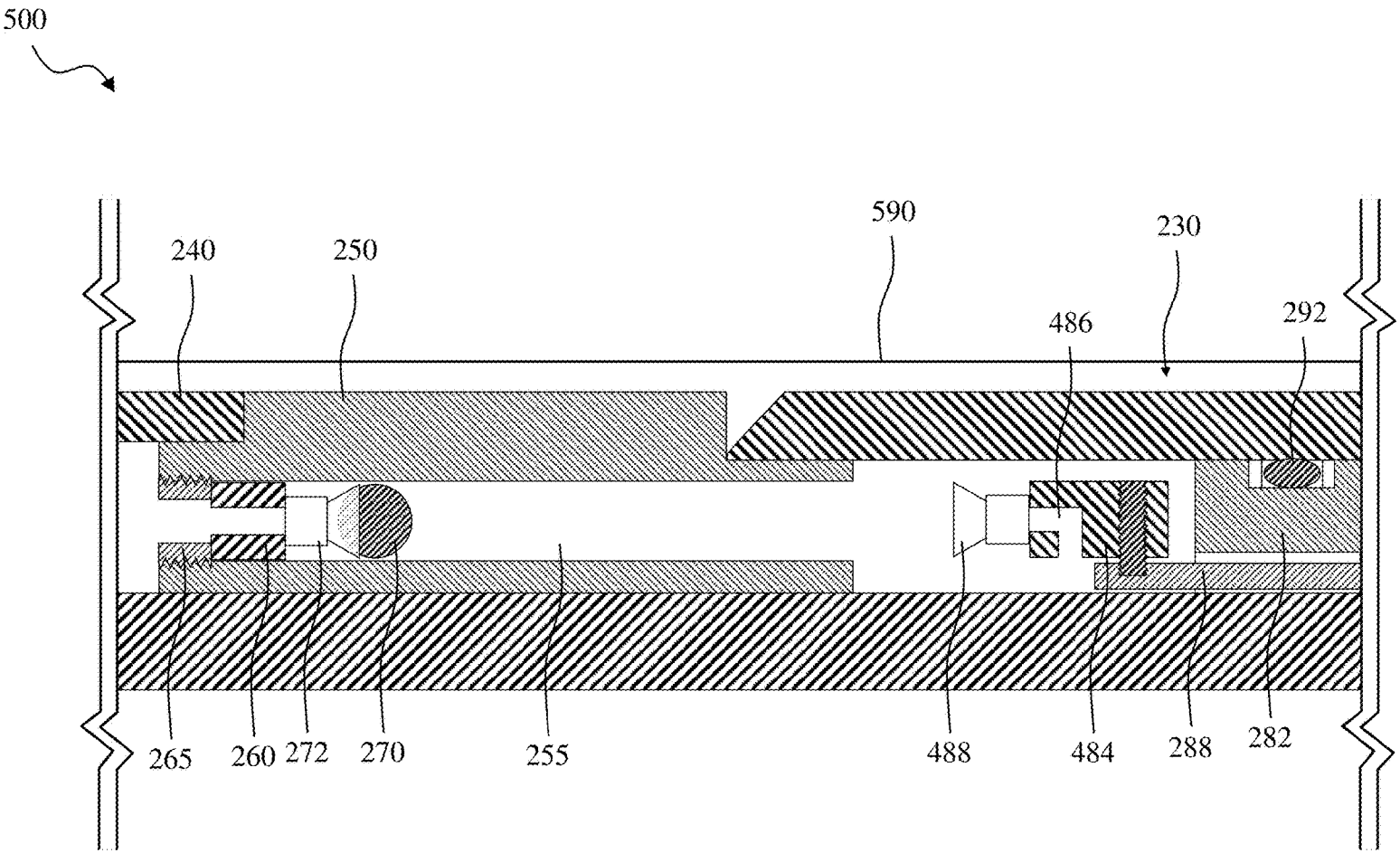
Figure 5M:
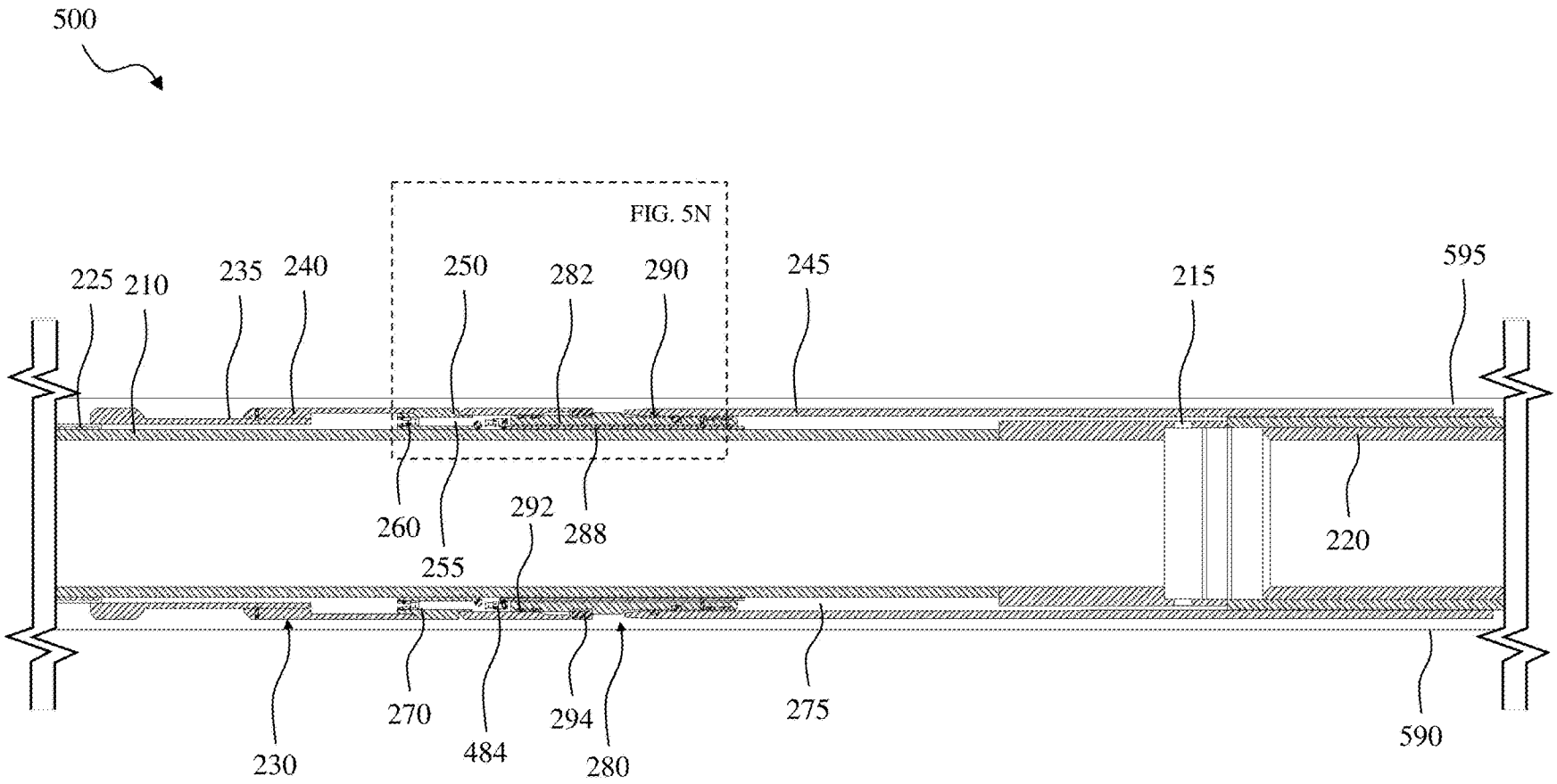
Figure 5N:
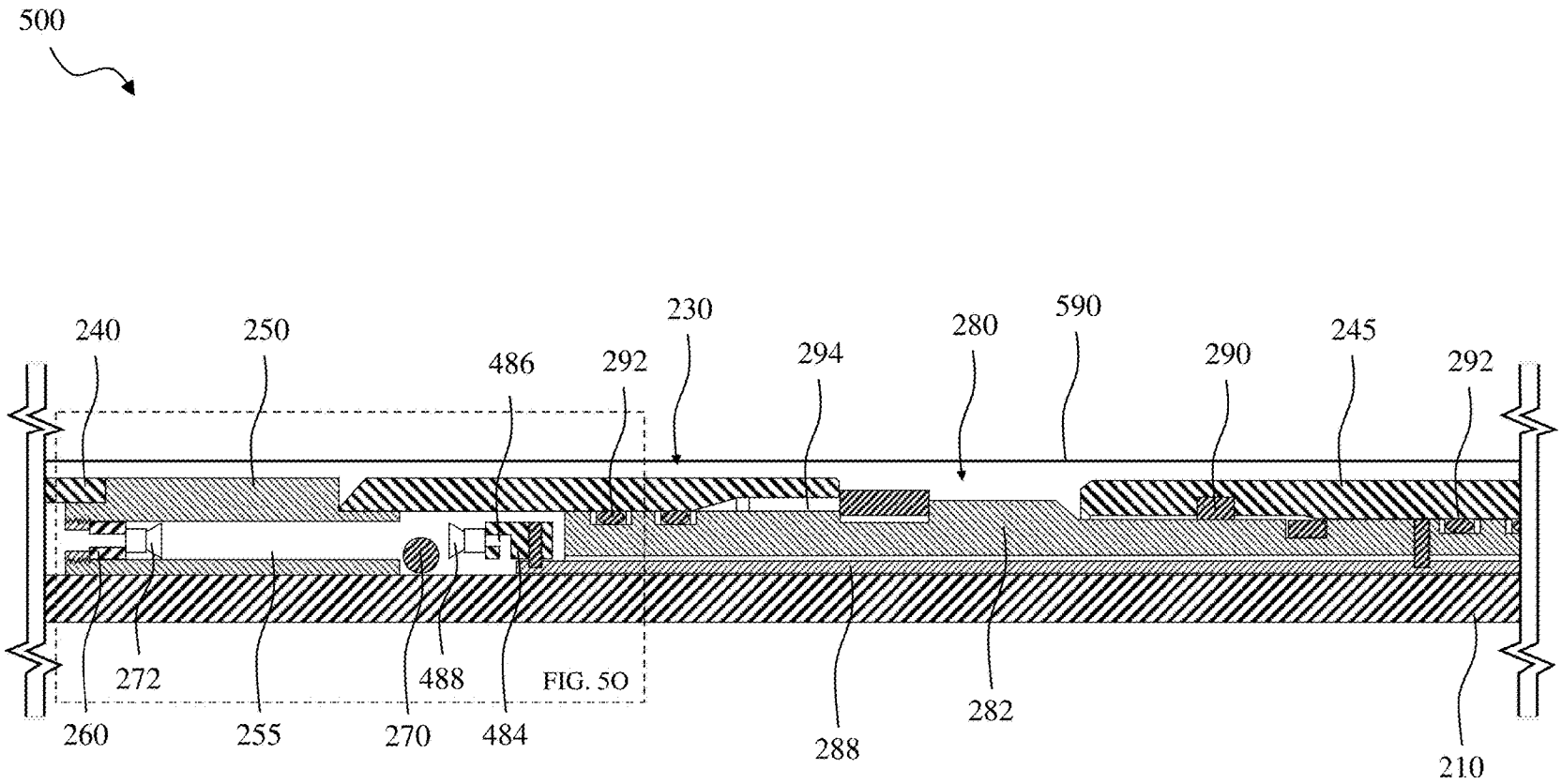
Figure 5O:
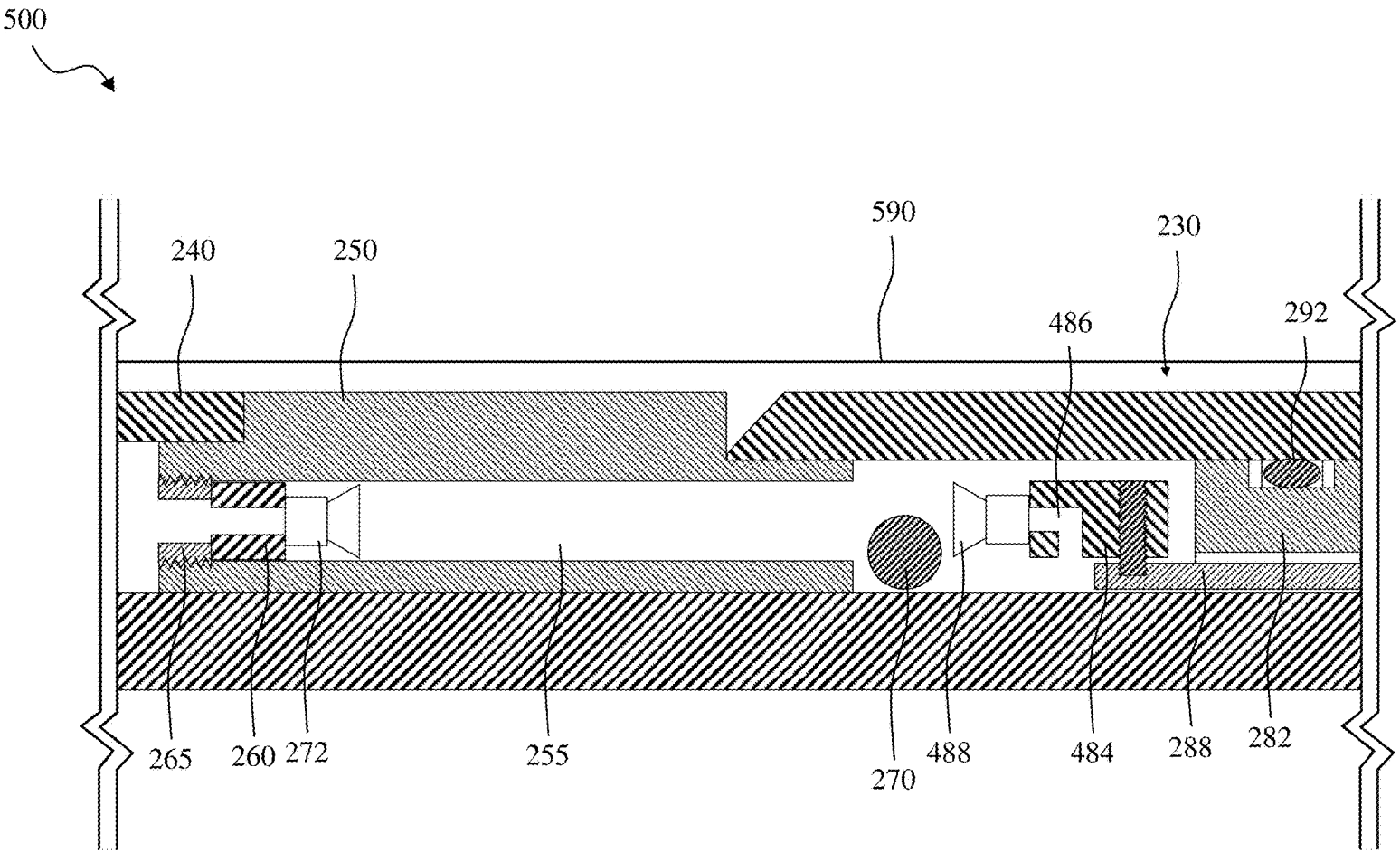
Figure 5P:
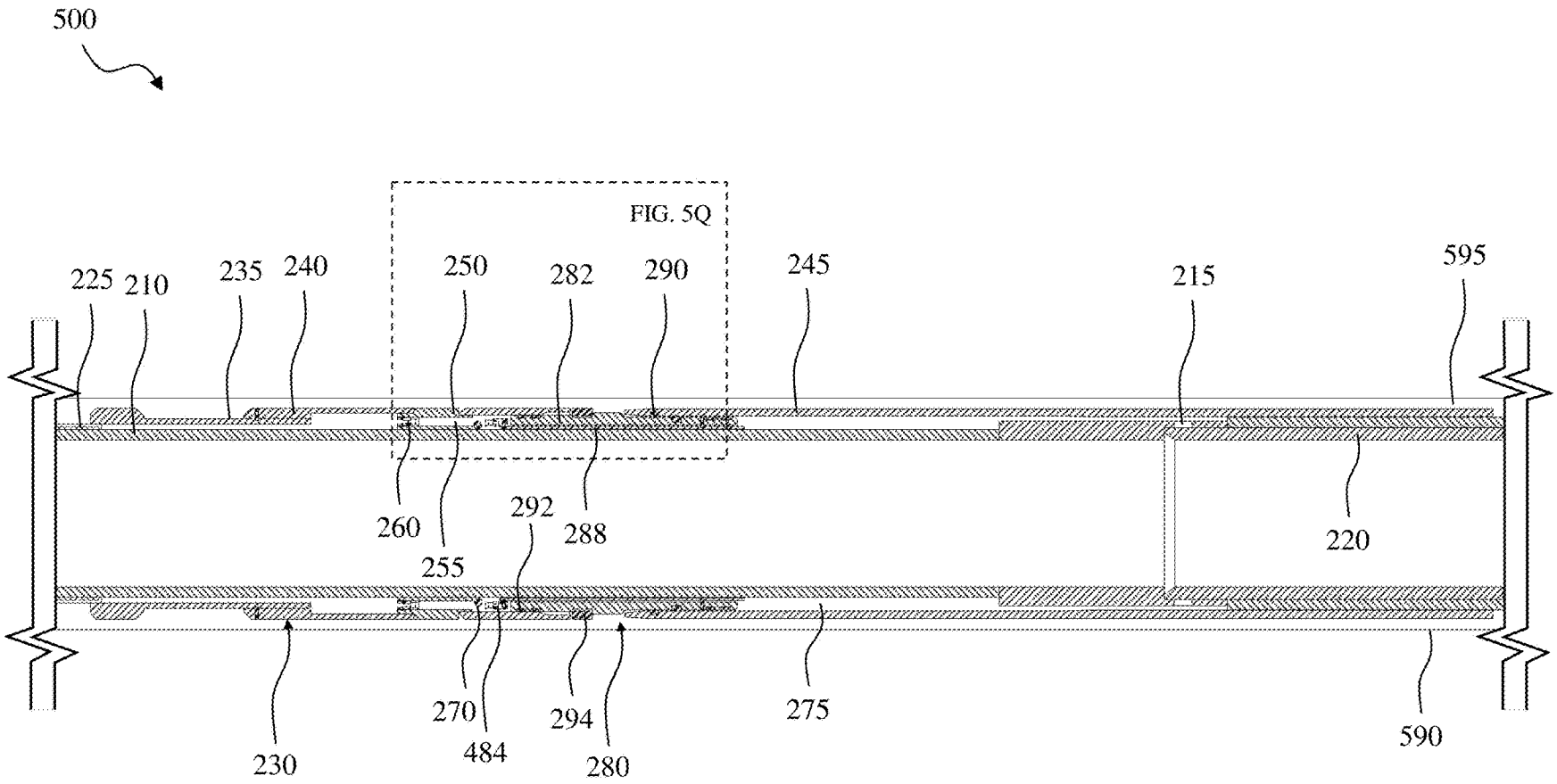
Figure 5Q:
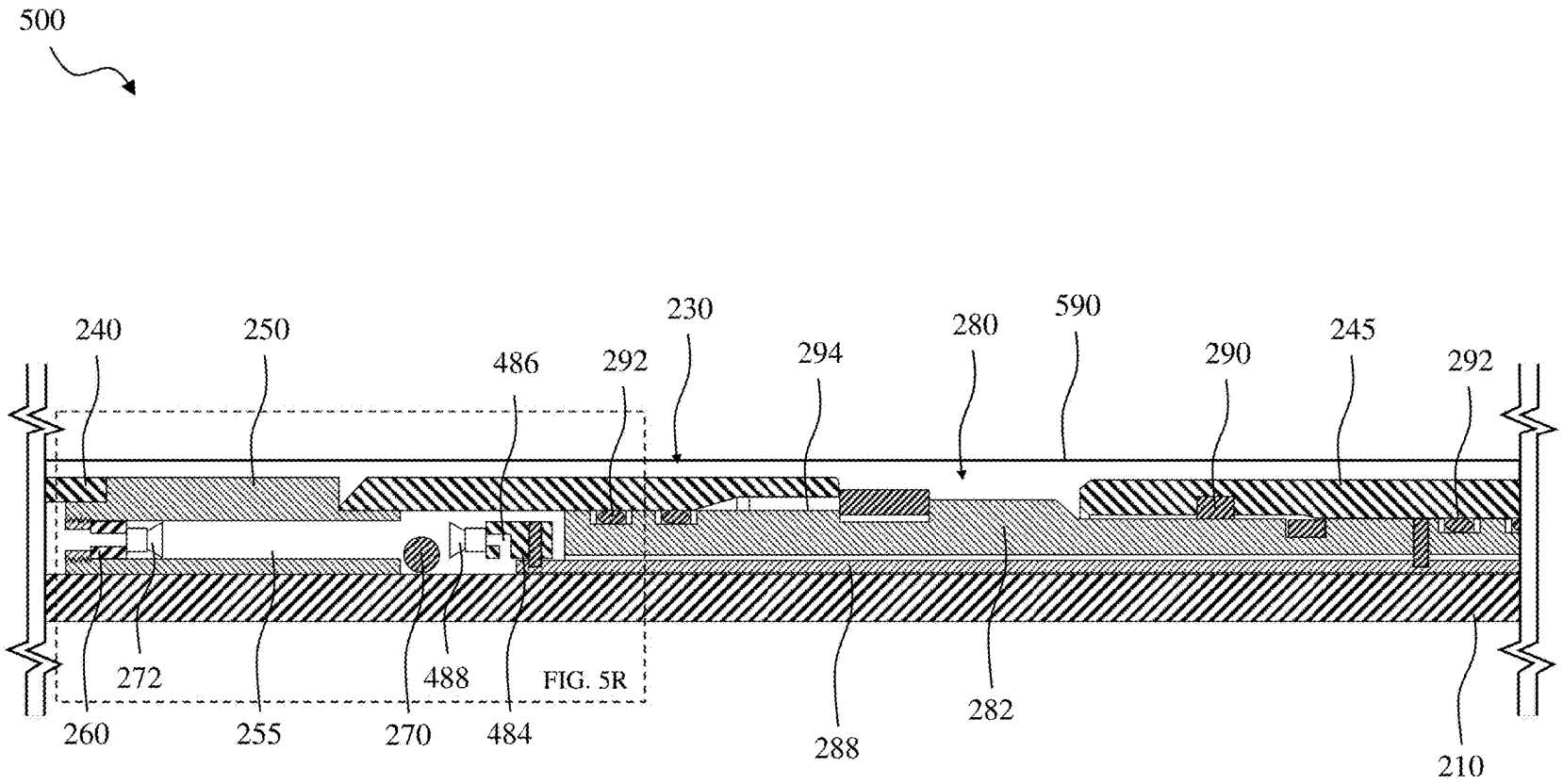
Figure 5R:
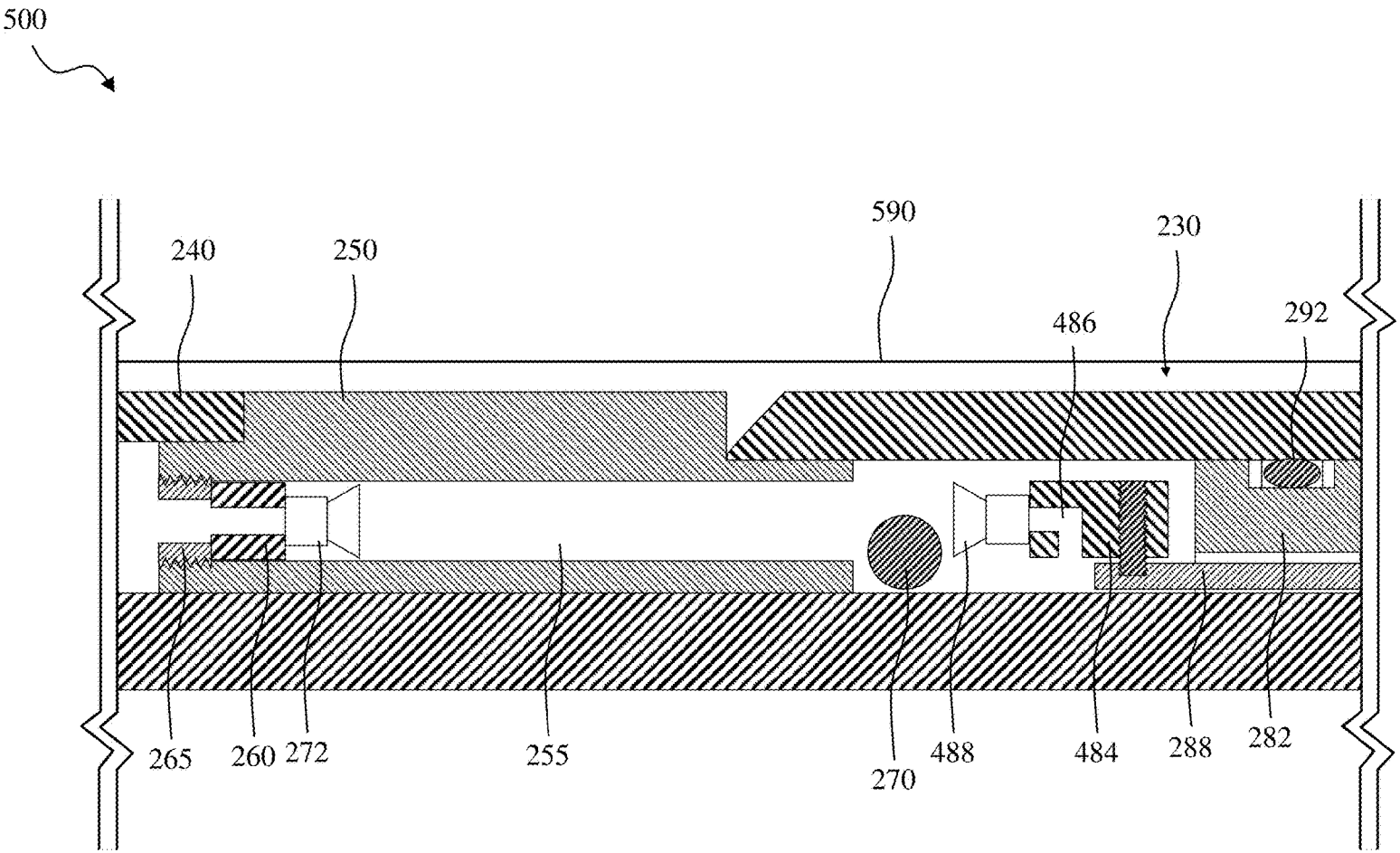

Turning now to FIGS. 5A through 5R, illustrated are certain different cross-sectional views of a flow control assembly 500 positioned within a wellbore 590 at various different operational states. The flow control assembly 500 of FIGS. 5A through 5R is similar in many respects to the flow control assembly 400 of FIGS. 4A through 4C. Accordingly, like reference numbers have been used to indicate similar, if not identical, features.

With initial reference to FIGS. 5A through 5C, illustrated is the flow control assembly 500 as it would initially be positioned within the wellbore 590 (e.g., at its run-in-hole state), for example creating an annulus 595 therebetween. As illustrated in FIGS. 5A through 5C, the sliding piston assembly 280 is in its run-in-hole state, and thus the sliding piston assembly flow nozzle chamber stopper 284 is located within and seals the flow control housing flow nozzle chamber 255. Similarly, the sliding piston assembly flow nozzle chamber stopper 284 keeps the flow control housing plug member 270 within the flow control housing flow nozzle chamber 255 and prevents fluid flow from the annulus 595 of the wellbore 590 to the inside diameter (ID) of the downhole tubular 210, for example using the flow control housing plug member 270 and the sliding piston assembly plug member seat 488.

Turning to FIGS. 5D through 5F, illustrated is the flow control assembly 500 of FIGS. 5A through 5C after subjecting the flow control assembly 500 to fluid flow from within the downhole tubular 210. In this embodiment, the fluid flow flows through the internal flow channel 486 and into the flow control housing flow nozzle chamber 255, thereby urging the flow control housing plug member 270 against the flow control housing plug member seat 272. The combination of the flow control housing plug member 270 and the flow control housing flow member seat 272 prevents fluid from flowing into the annulus 595. At this point in time, the sliding piston assembly 280 remains in the run-in-hole state of FIGS. 5A through 5C.

Turning to FIGS. 5G through 5I, illustrated is the flow control assembly 500 of FIGS. 5D through 5F after subjecting the flow control assembly 500 to a first lower predetermined threshold pressure, the first lower predetermined threshold pressure sliding the sliding piston assembly 280 from the run-in-hole state of FIGS. 5A through 5F to the activated state of FIGS. 5G through 5I. Again, as there is pressure below the flow control housing plug member 270, the flow control housing plug member 270 is urged toward the flow control housing plug member seat 272, which in turn prevents fluid flow from the inside diameter (ID) of the downhole tubular 210 to the annulus 595. Similarly, the internal flow channel 486 prevents an airlock occurring in the flow control housing flow nozzle chamber 255, which could prevent the sliding piston assembly flow nozzle chamber stopper 484 from being removed from the flow control housing flow nozzle chamber 255.

Turning to FIGS. 5J through 5L, illustrated is the flow control assembly 500 of FIGS. 5G through 5I after subjecting the flow control assembly 500 to a second higher predetermined threshold pressure. In this embodiment, the second higher predetermined threshold pressure is configured to set the one or more wellbore packers.

Turning to FIGS. 5M through 50, illustrated is the flow control assembly 500 of FIGS. 5J through 5L after reducing the pressure being applied to the flow control assembly 500, which in turn allows the flow control housing plug member 270 to traverse into the piston chamber 275 and allow fluid flow from the annulus 595 of the wellbore 590 to the inside diameter (ID) of the downhole tubular 210.

Turning to FIGS. 5P through 5R, illustrated is the flow control assembly 500 of FIGS. 5M through 50 after shifting the downhole tubular inner sleeve 220 (e.g., located radially inside of the downhole tubular 210) from the open state (e.g., exposing the downhole tubular opening 215 to allow fluid flow between the inside diameter (ID) of the downhole tubular 210 and the outside diameter (OD) of the downhole tubular 210) to the closed state (e.g., covering the downhole tubular opening 215 to prevent fluid flow between the inside diameter (ID) of the downhole tubular 210 and the outside diameter (OD) of the downhole tubular 210).

Figure 6A:
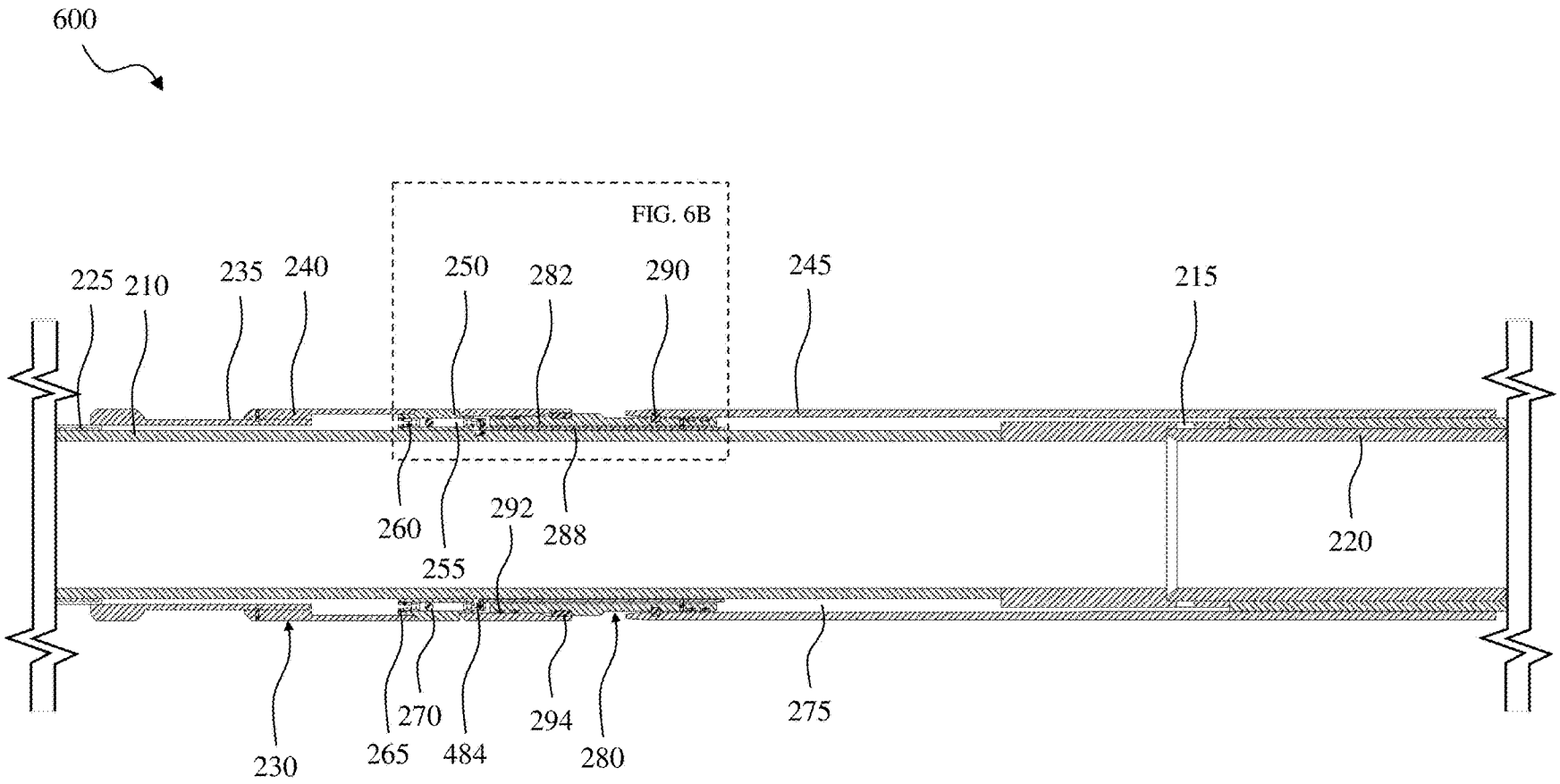
FIGS. 6A through 6C illustrate various different cross-sectional views of a flow control assembly designed, manufactured and/or operated according to one or more alternative embodiments of the disclosure.
Figure 6B:
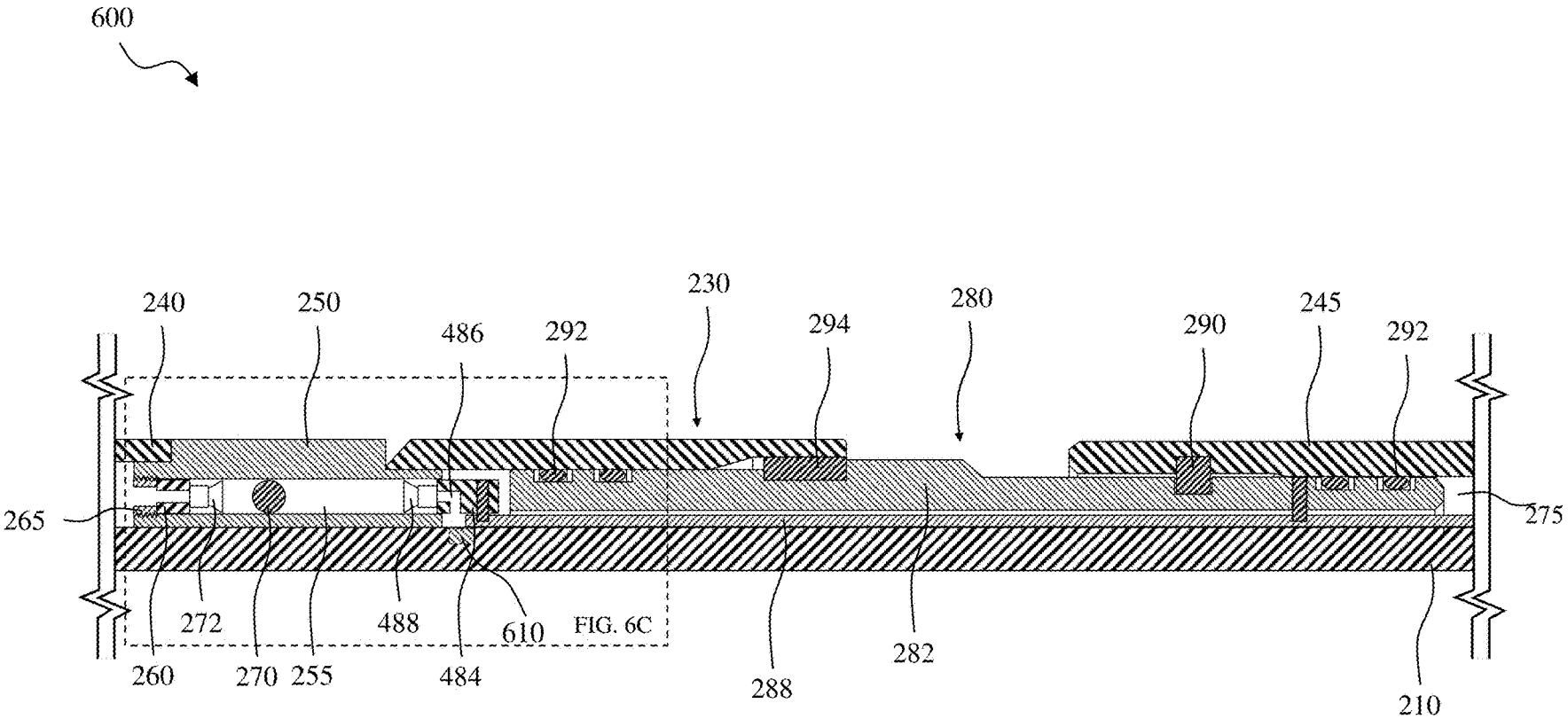
Figure 6C:
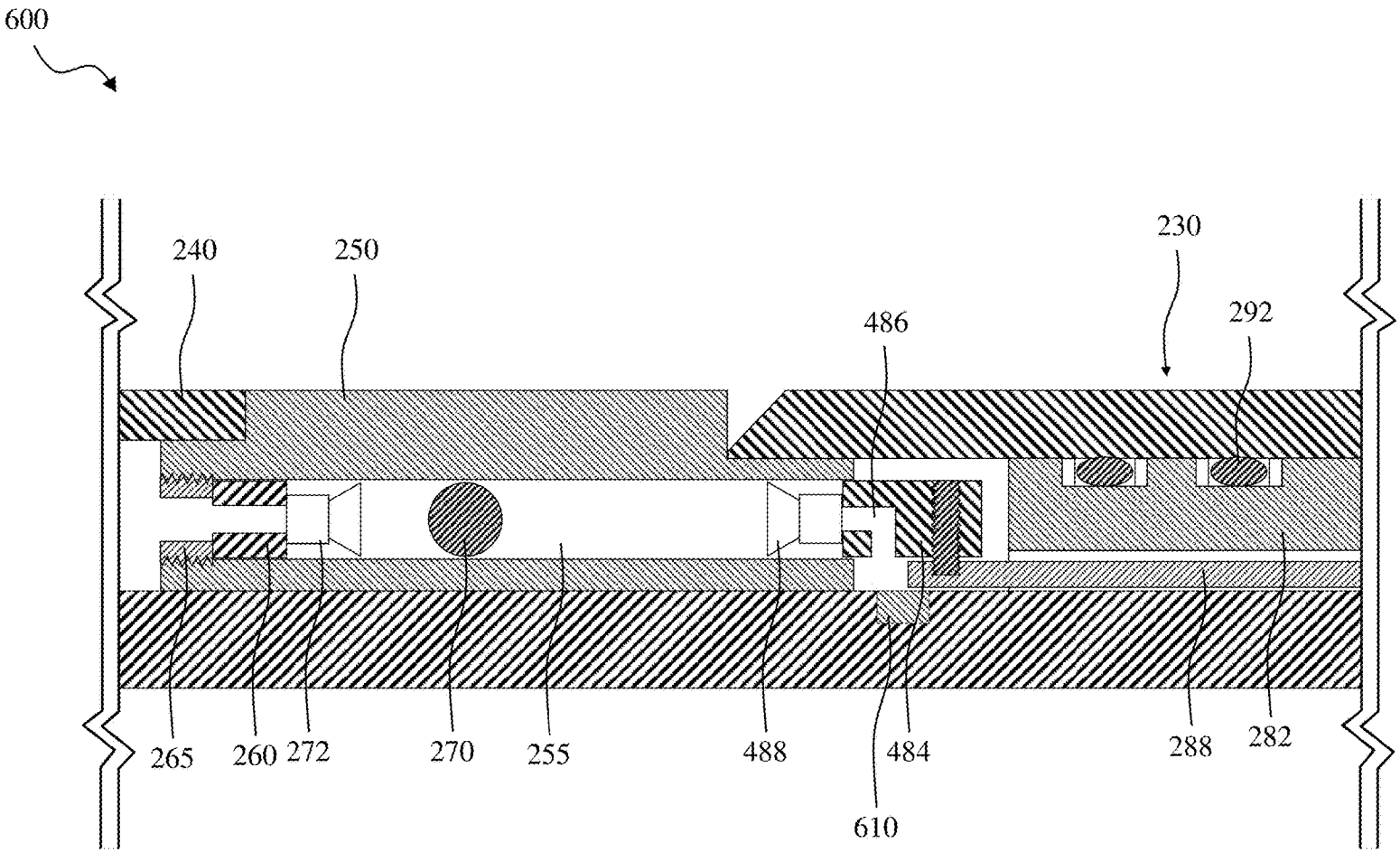

Turning to FIGS. 6A through 6C, illustrated are various different cross-sectional views of a flow control assembly 600 designed, manufactured and/or operated according to one or more alternative embodiments of the disclosure. The flow control assembly 600 of FIGS. 6A through 6C is similar in many respects to the flow control assembly 400 of FIGS. 4A through 4C. Accordingly, like reference numbers have been used to indicate similar, if not identical, features.

The flow control assembly 600 differs, for the most part, from the flow control assembly 400, in that the flow control assembly 600 includes one or more magnets 610 disposed within the piston chamber 275, for example proximate the flow control housing flow nozzle chamber 255. In this embodiment, fluid flow from the annulus 595 may also drive the flow control housing plug member 270 towards the magnet 610 disposed within the piston chamber 275. The flow control housing plug member 270, in at least one embodiment, may comprise a ferromagnetic material (e.g., ferromagnetic metal) such that the magnet 610 may hold the flow control housing plug member 270 once the flow control housing plug member 270 comes in contact with the magnet 610. The magnet 610, in one or more embodiments, may be secured proximate the inner surface of piston chamber 275 via at least one fastener (e.g., screw, pin, adhesive). Alternatively, the magnet 610 may be press-fit, welded, or otherwise secured within piston chamber 275. Moreover, the magnet 610 may include any suitable permanent magnet or electromagnet. For example, the magnet 610 may comprise a rare earth metal magnet (e.g., or samarium cobalt, neodymium, etc.), which provides the benefit of maintaining a magnetic field without an external power source. Further, the magnet 610 may be coated or otherwise isolated from the fluid traversing through piston chamber 275. In some embodiments, the magnet 610 may comprise a material that is not chemically compatible with the fluids in piston chamber 275. As such, the magnet 610 may be coated or otherwise isolated to prevent undesired chemical reactions between the magnet 610 and the fluid. While the embodiment of FIGS. 6A through 6C illustrate the use of the magnet 610, in yet another embodiment, the flow control housing plug member 270 may dissolve, or alternatively a protruding feature (e.g., a flexible tab) may be used to prevent the flow control housing plug member 270 from traversing back to the flow control housing flow nozzle chamber 255. This may allow for the flow control housing plug member 270 to traverse out of the flow control housing flow nozzle chamber 255 and prevent the flow control housing plug member 270 from traversing back into the flow control housing flow nozzle chamber 255. It should also be noted that while the magnet 610, dissolvable flow control housing plug member 270, or protruding feature are disclosed for use with the flow control assembly 600 of FIGS. 6A through 6C, similar features could be used with the flow control assemblies of FIGS. 2A through 30 without departing from the scope of the disclosure.

Figure 7A:
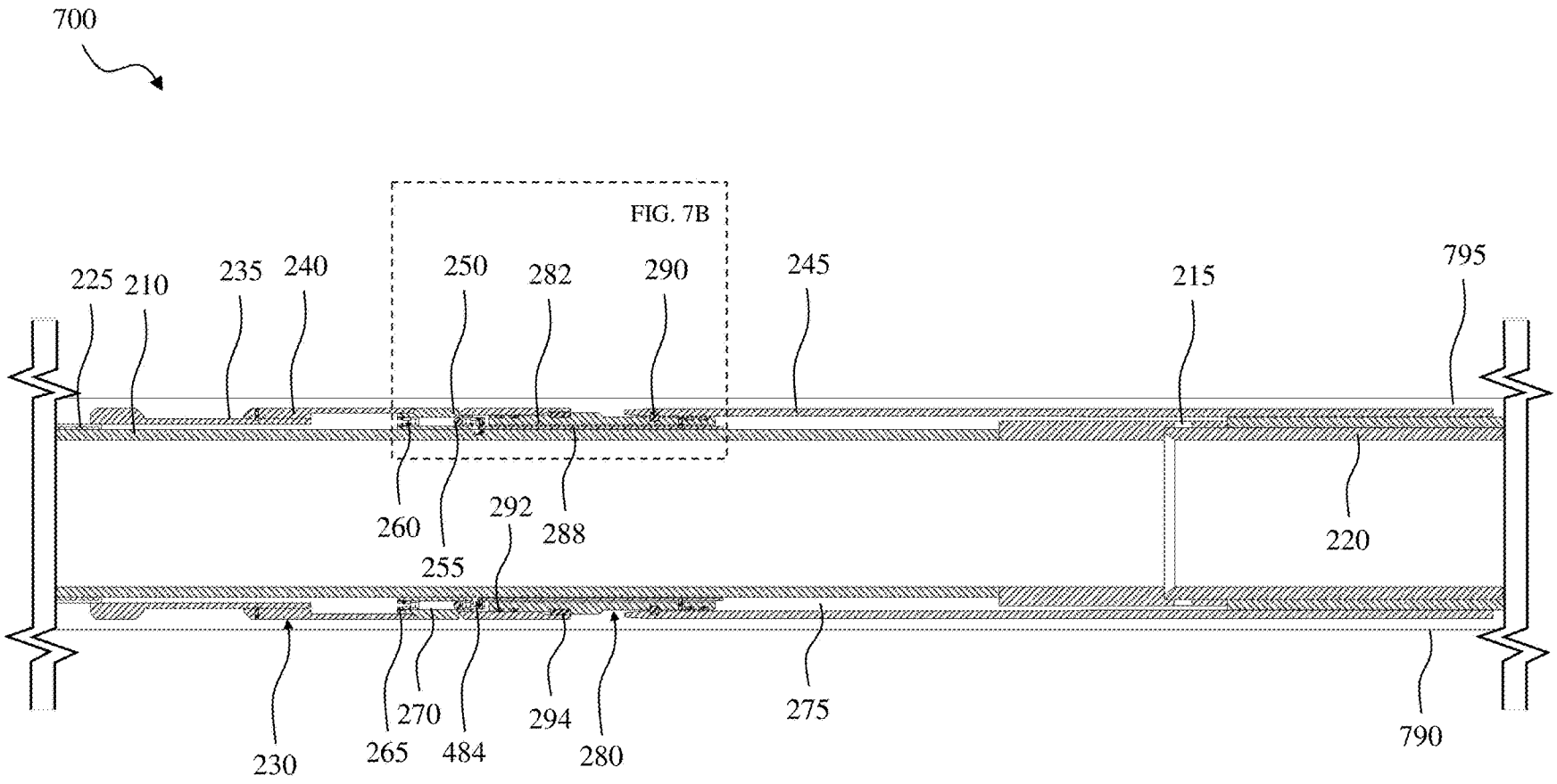
FIGS. 7A through 7R illustrate certain different cross-sectional views of a flow control assembly positioned within a wellbore at various different operational states.
Figure 7B:
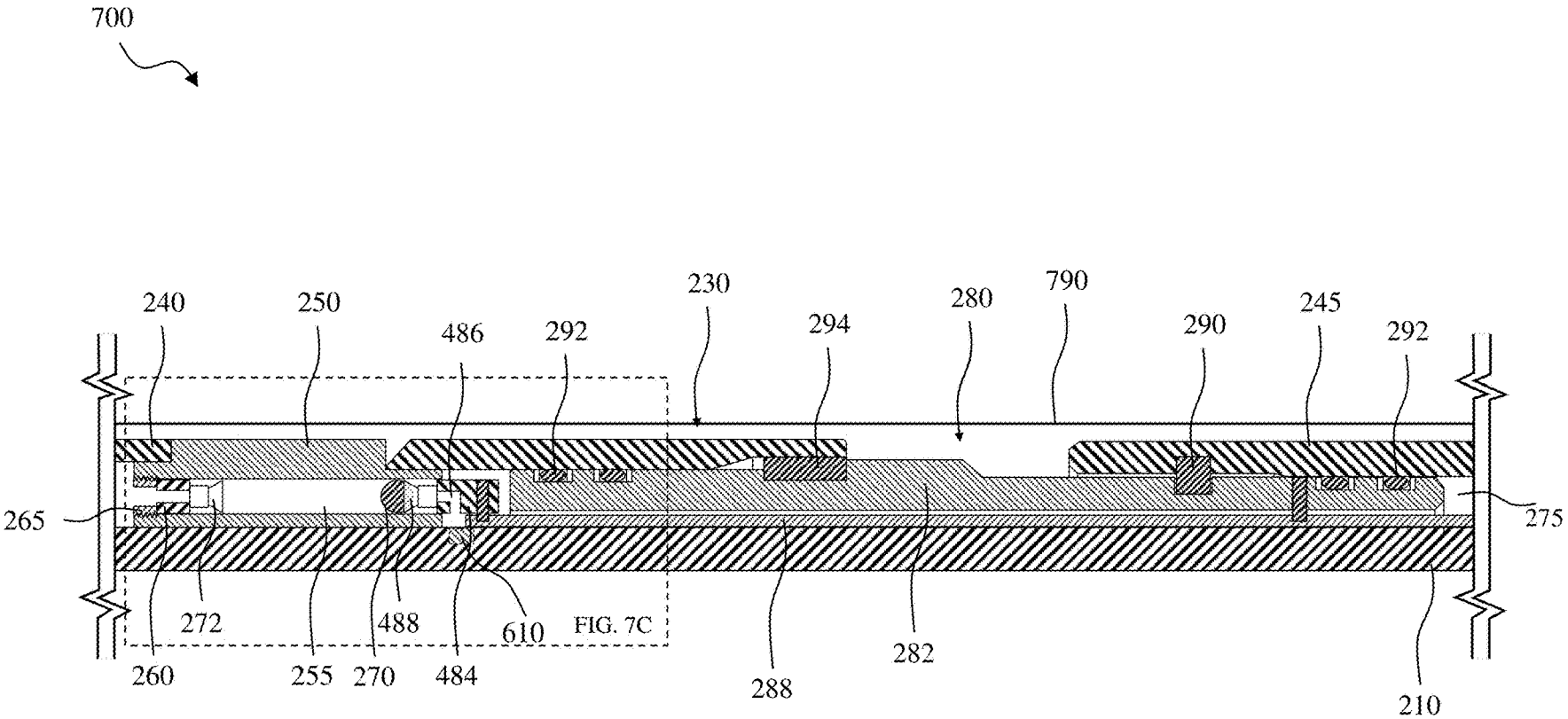
Figure 7C:
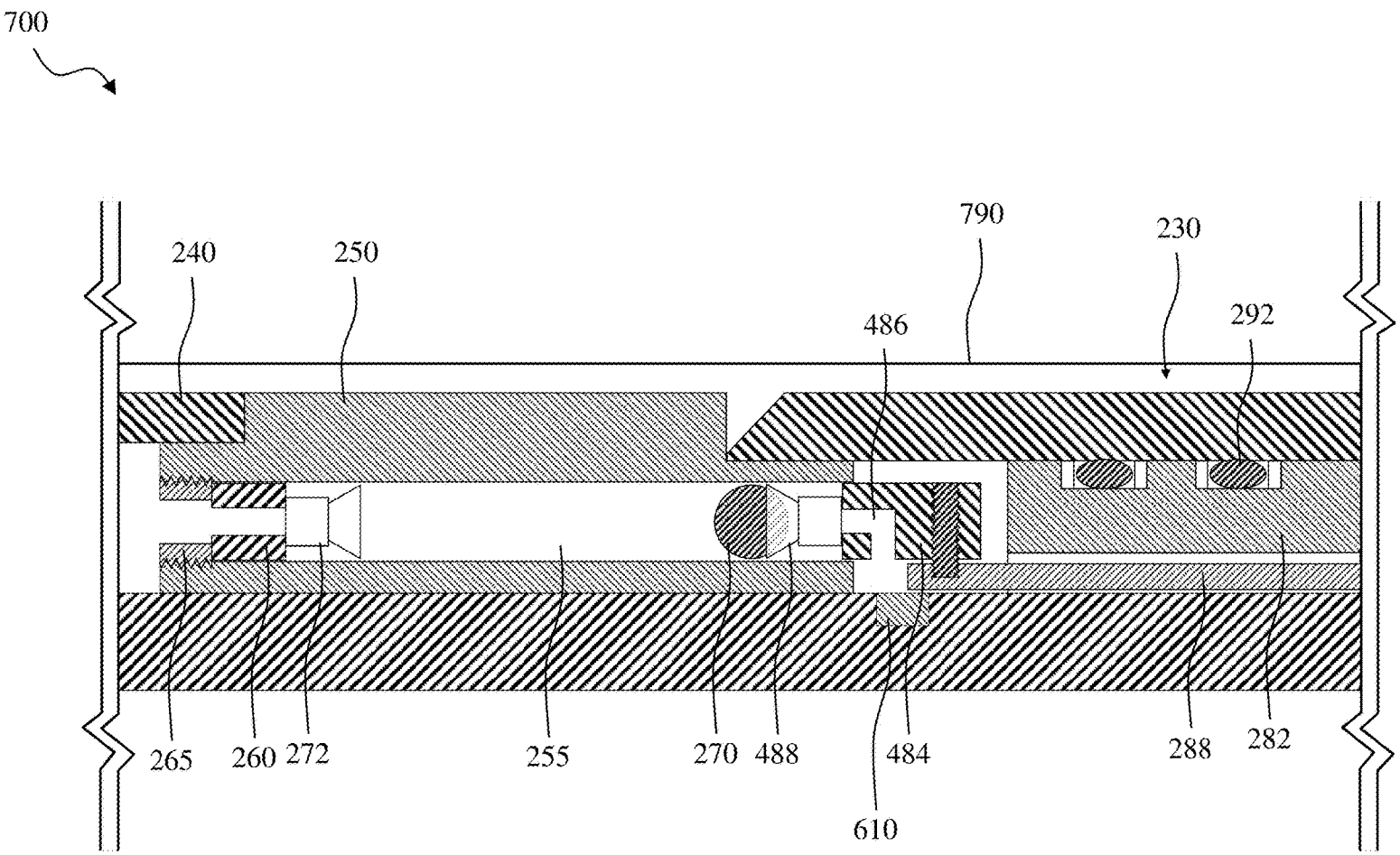
Figure 7D:
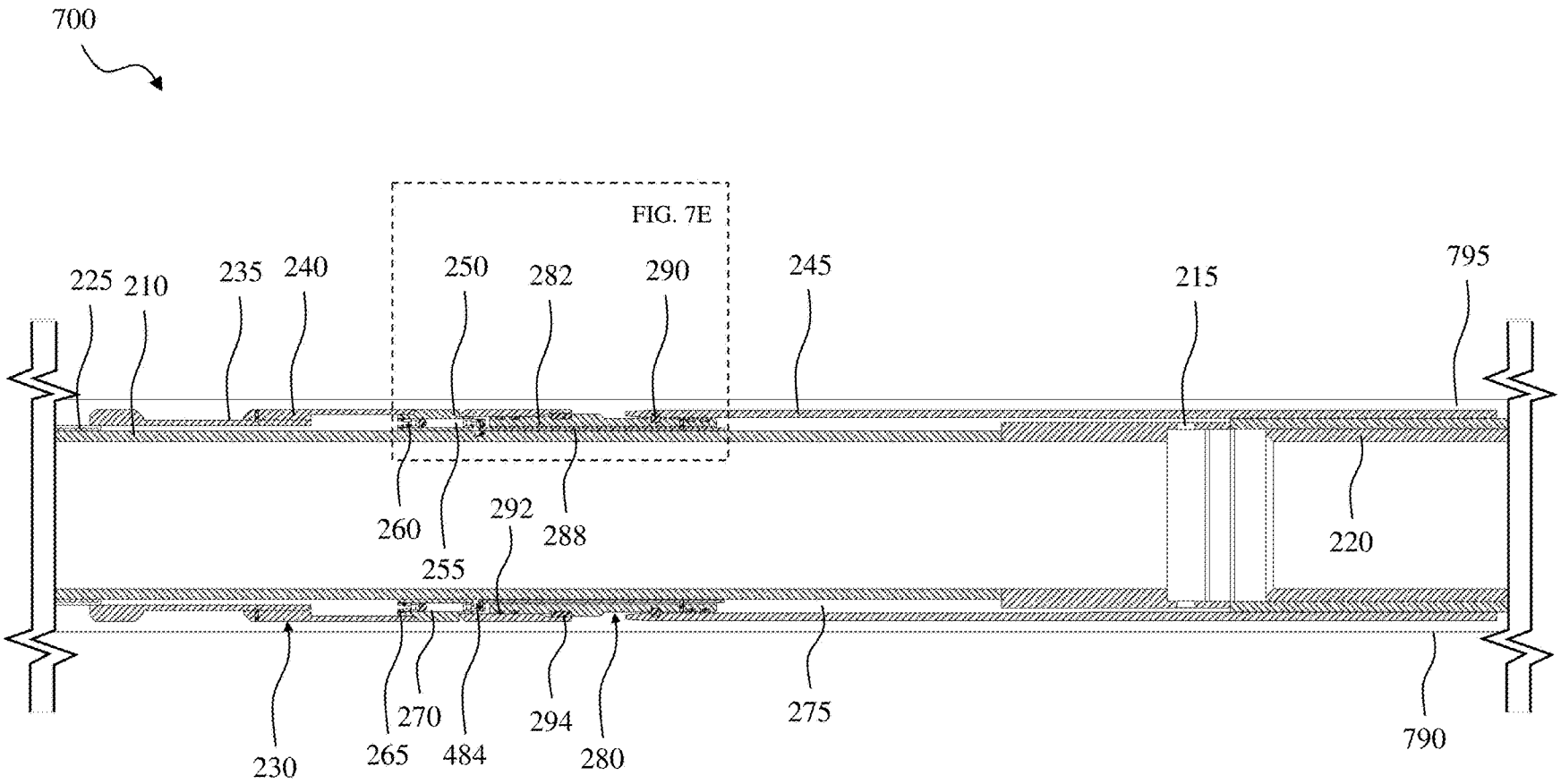
Figure 7E:
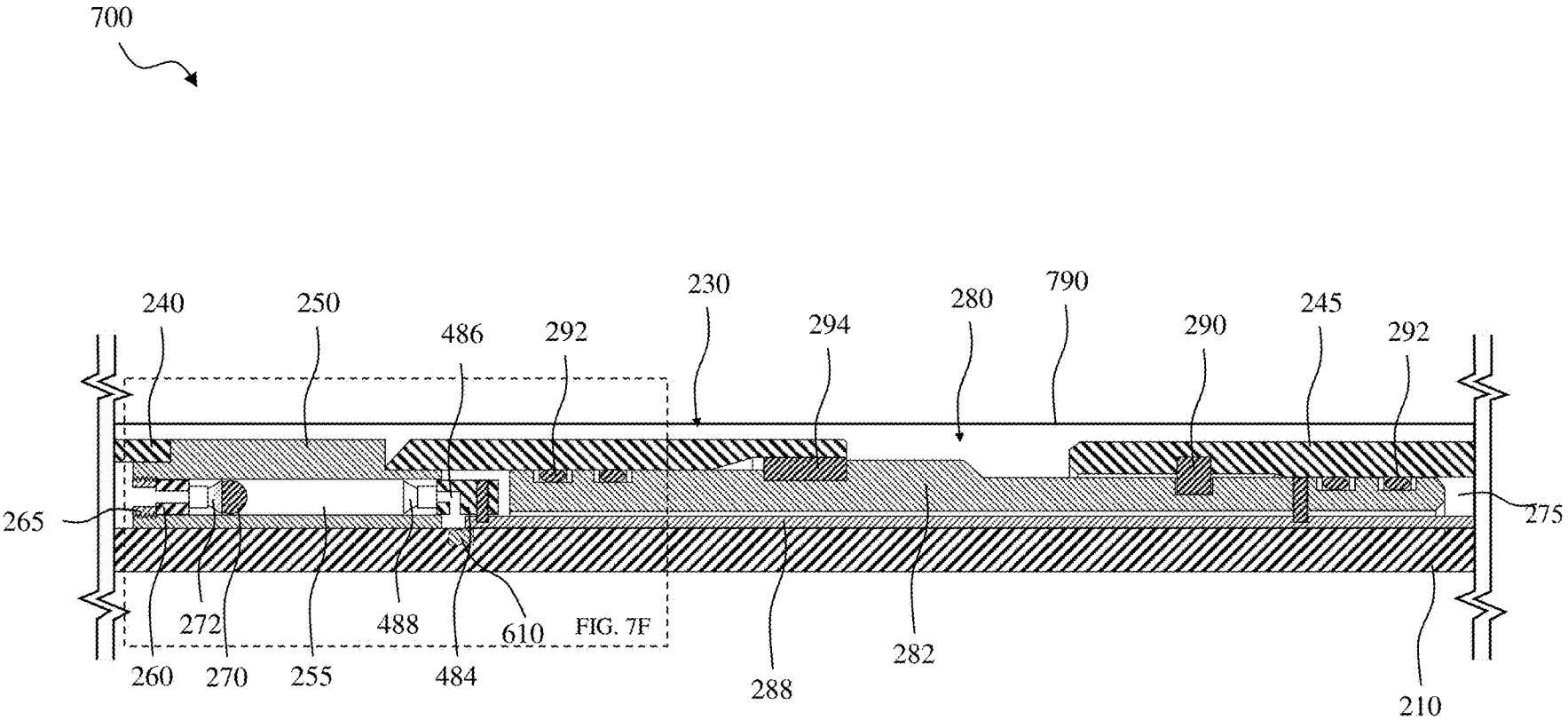
Figure 7F:
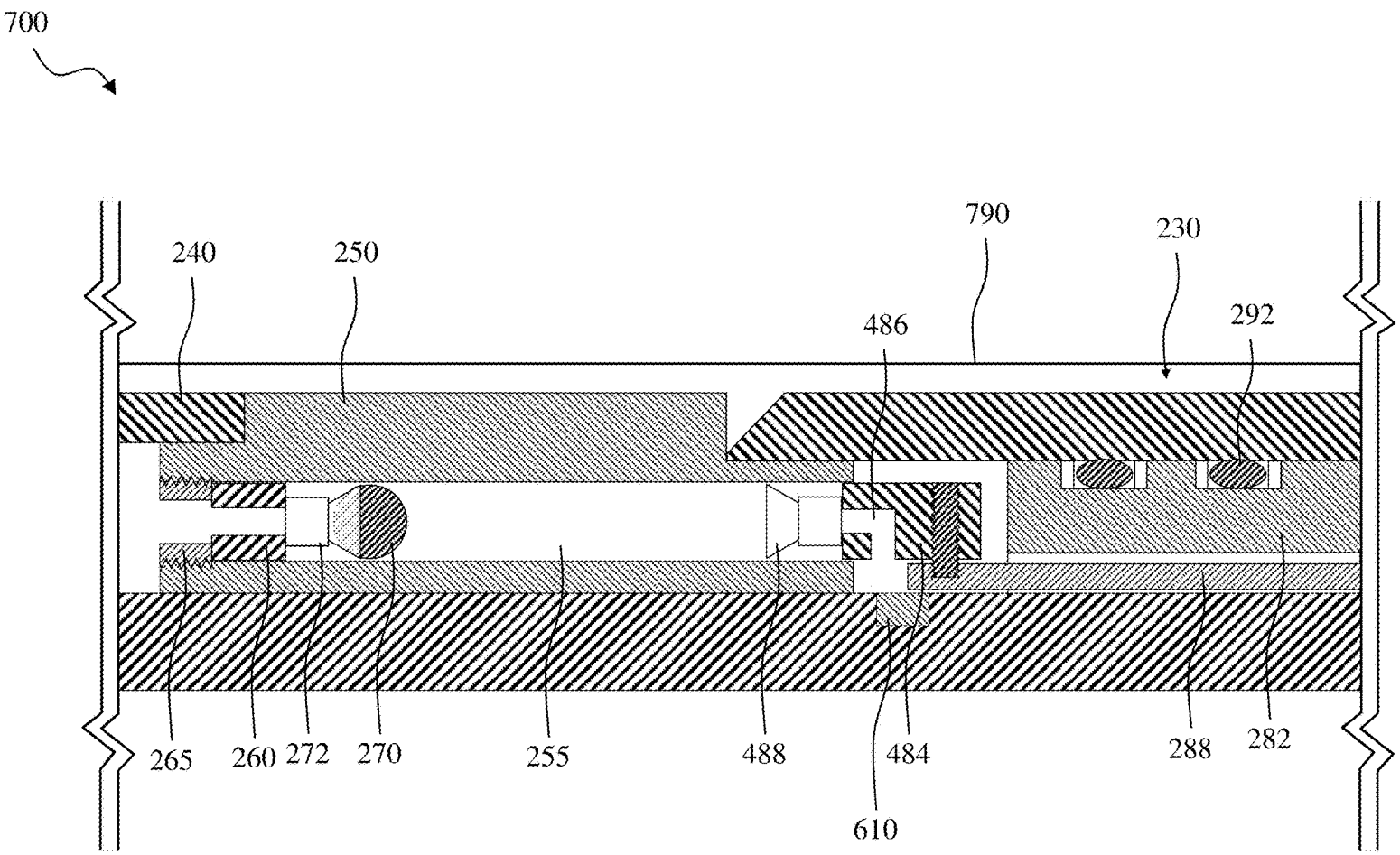
Figure 7G:
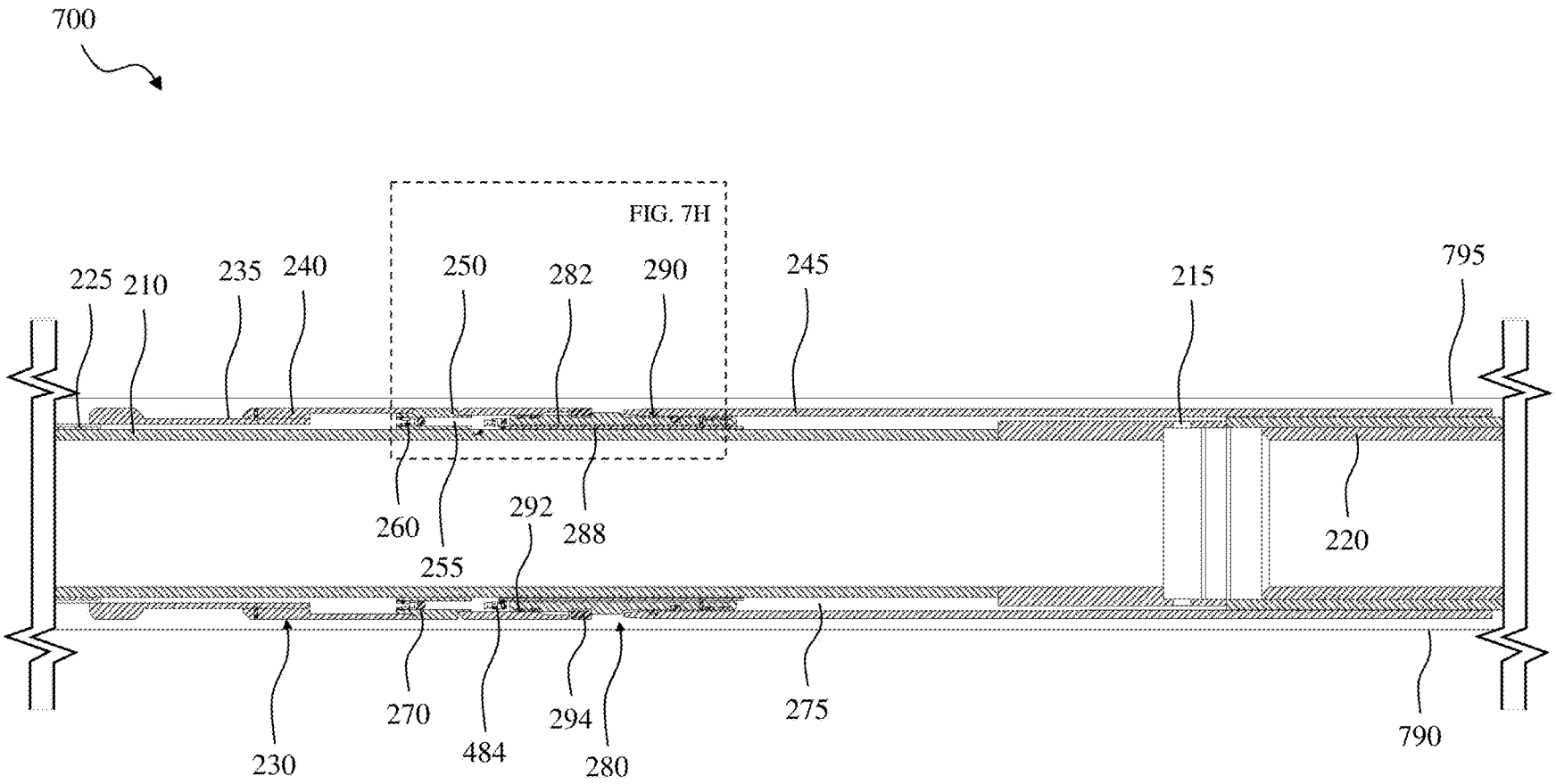
Figure 7H:
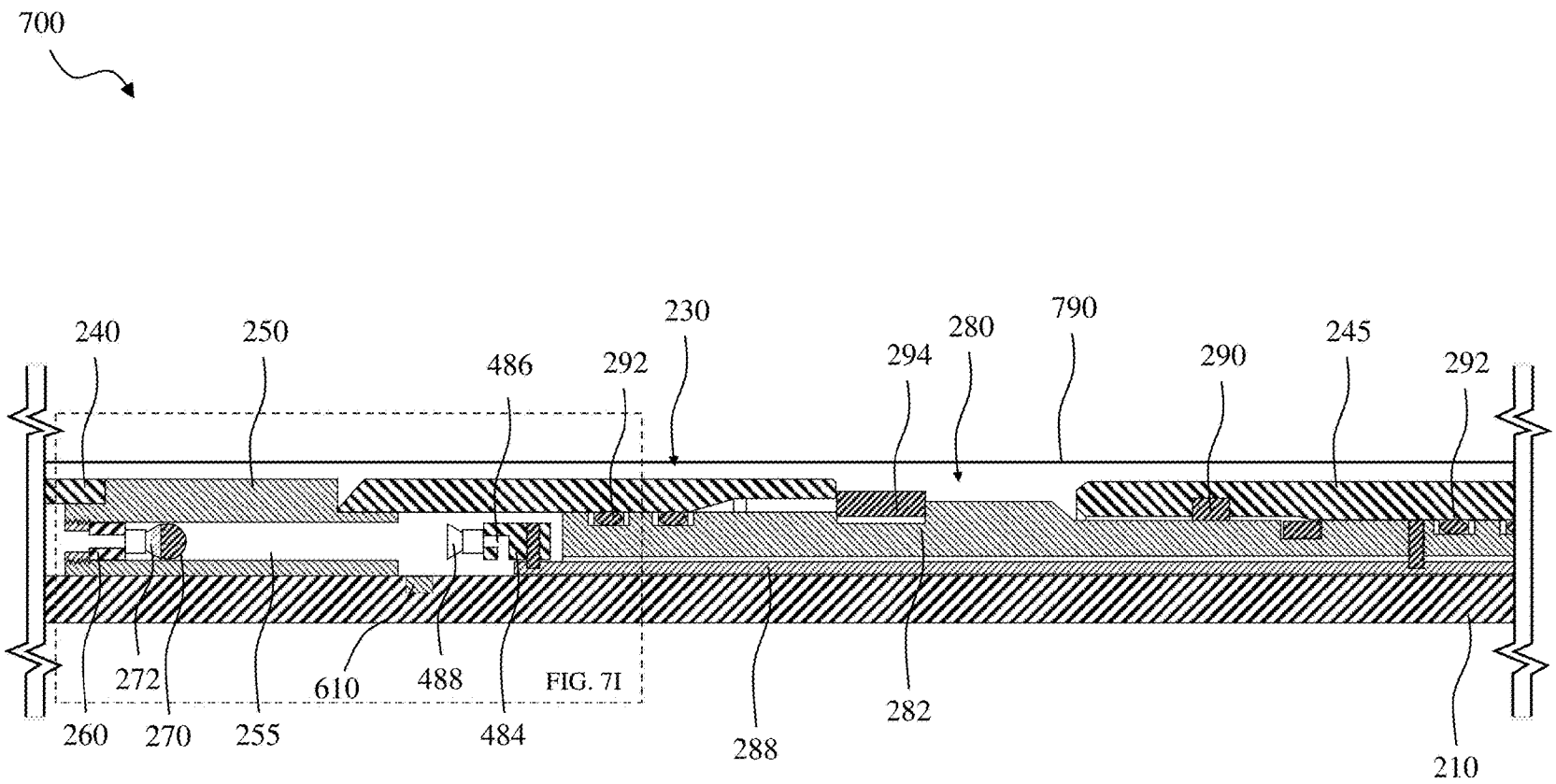
Figure 7I:
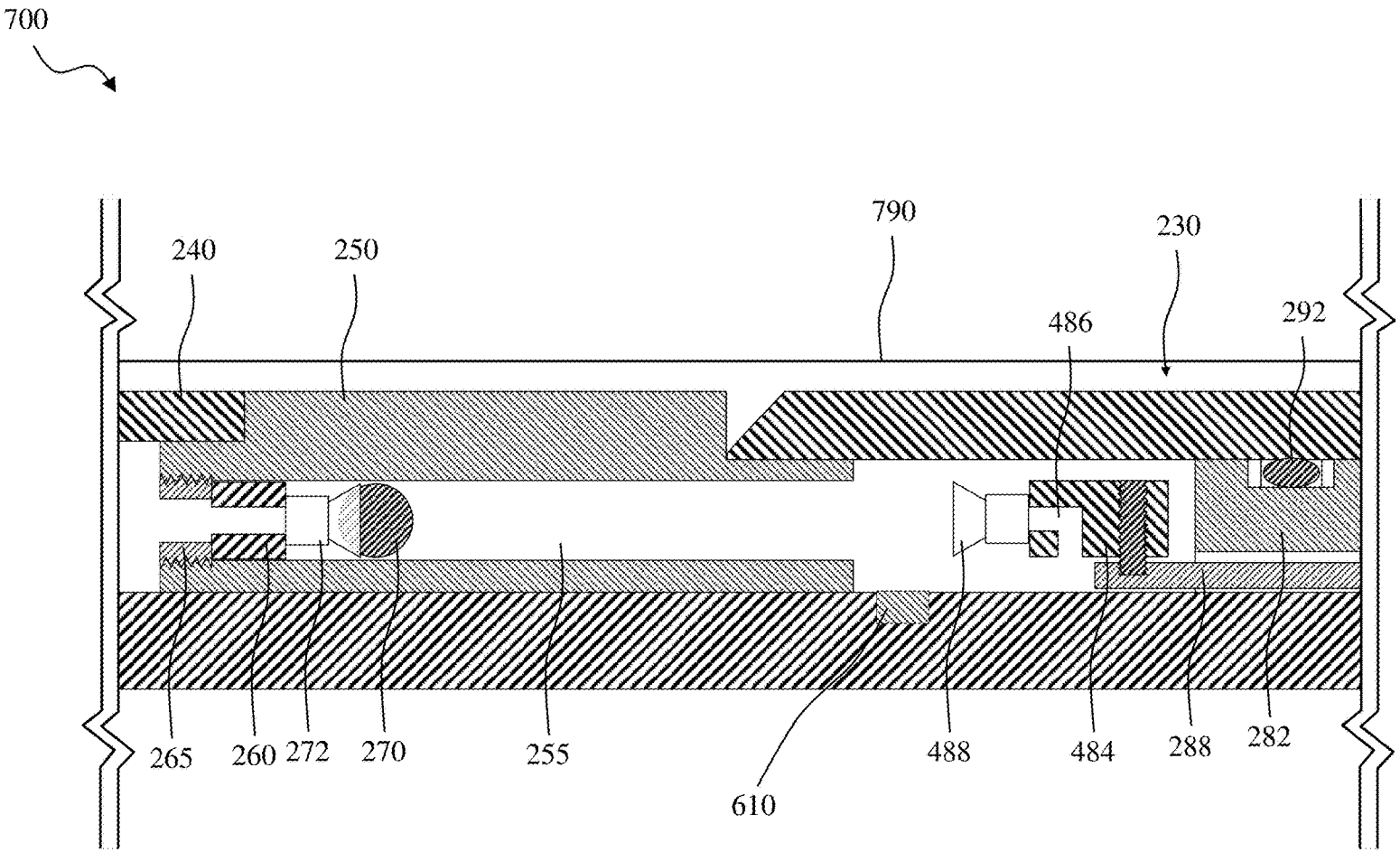
Figure 7J:
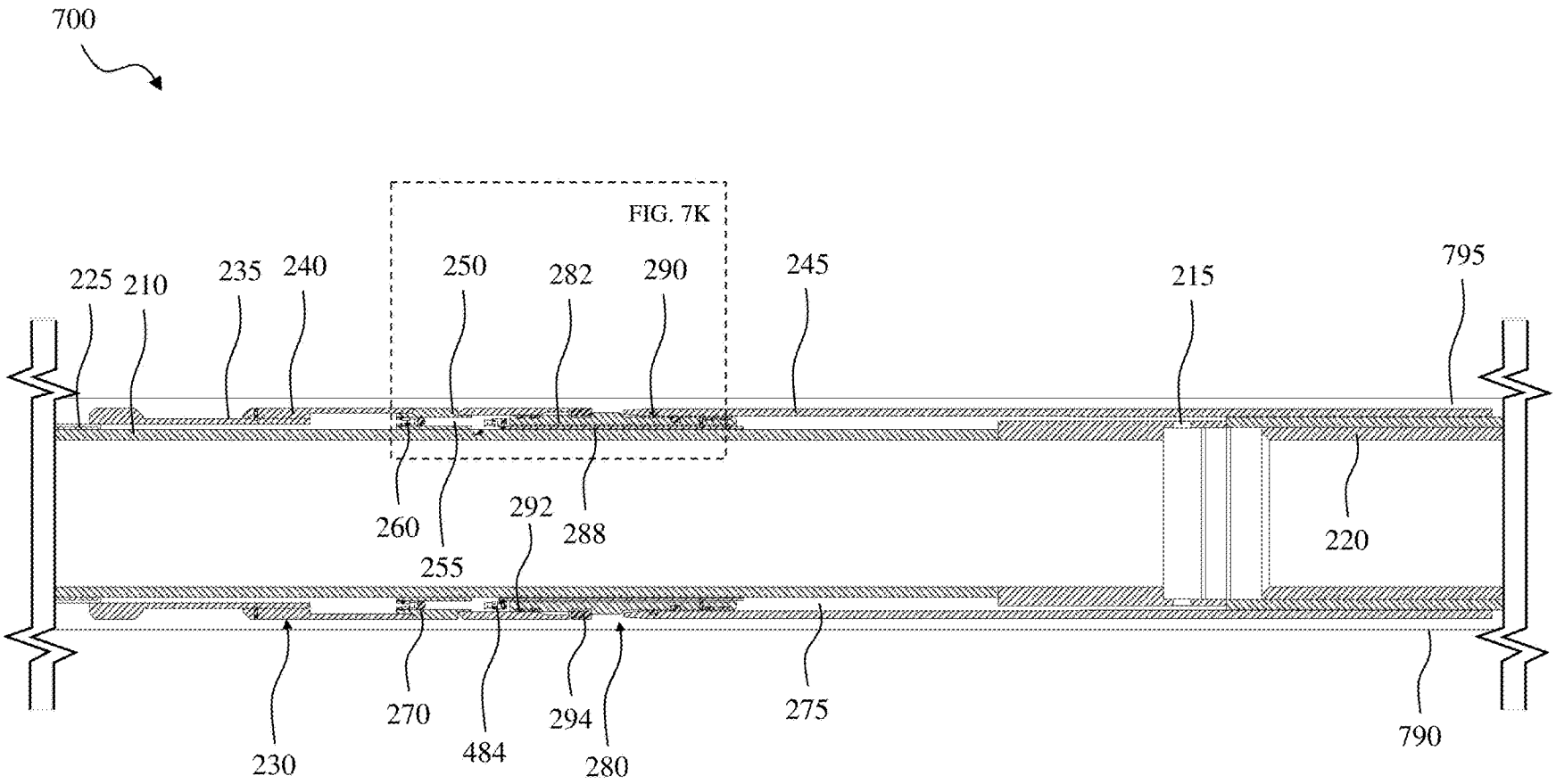
Figure 7K:
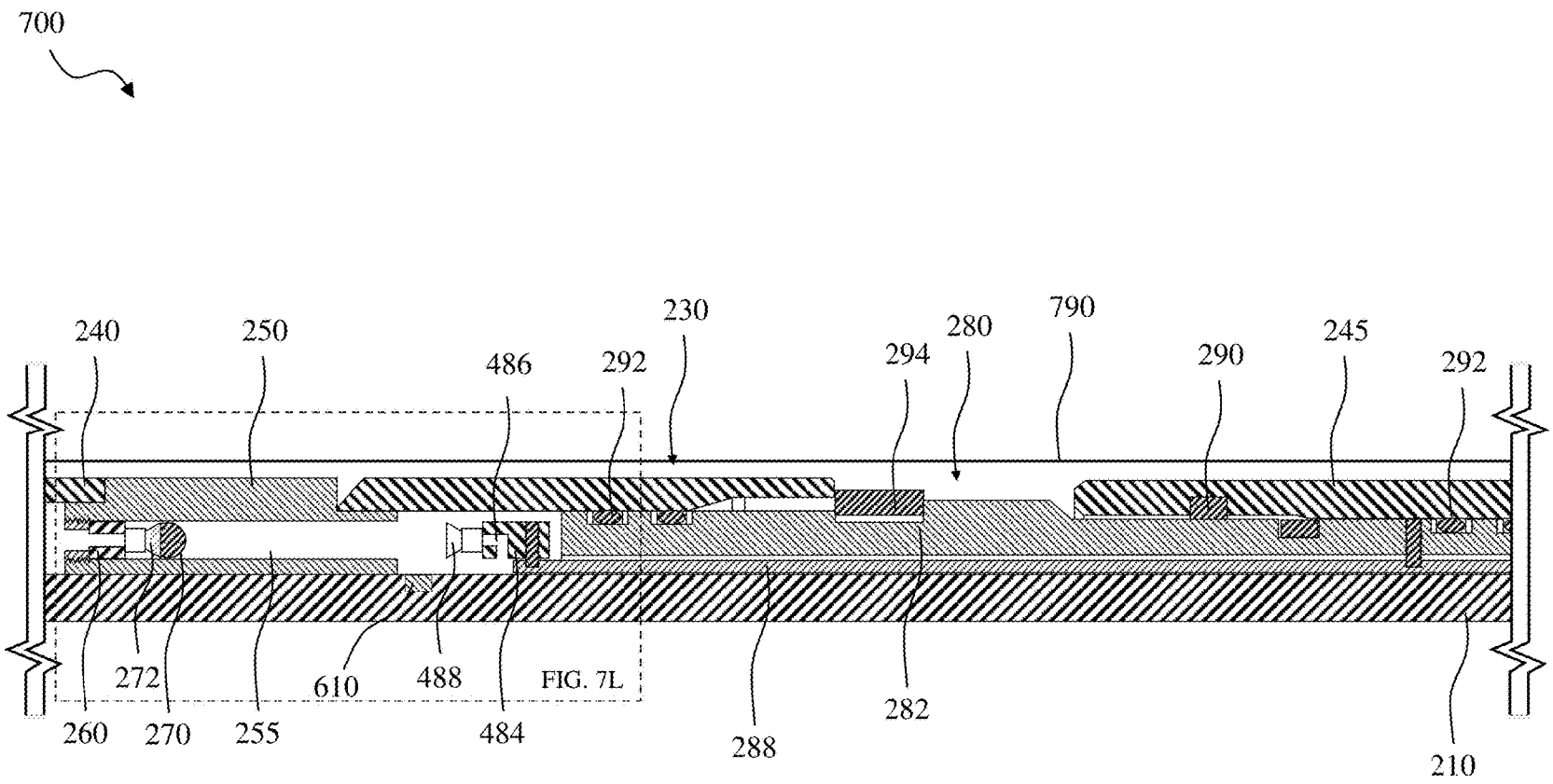
Figure 7L:
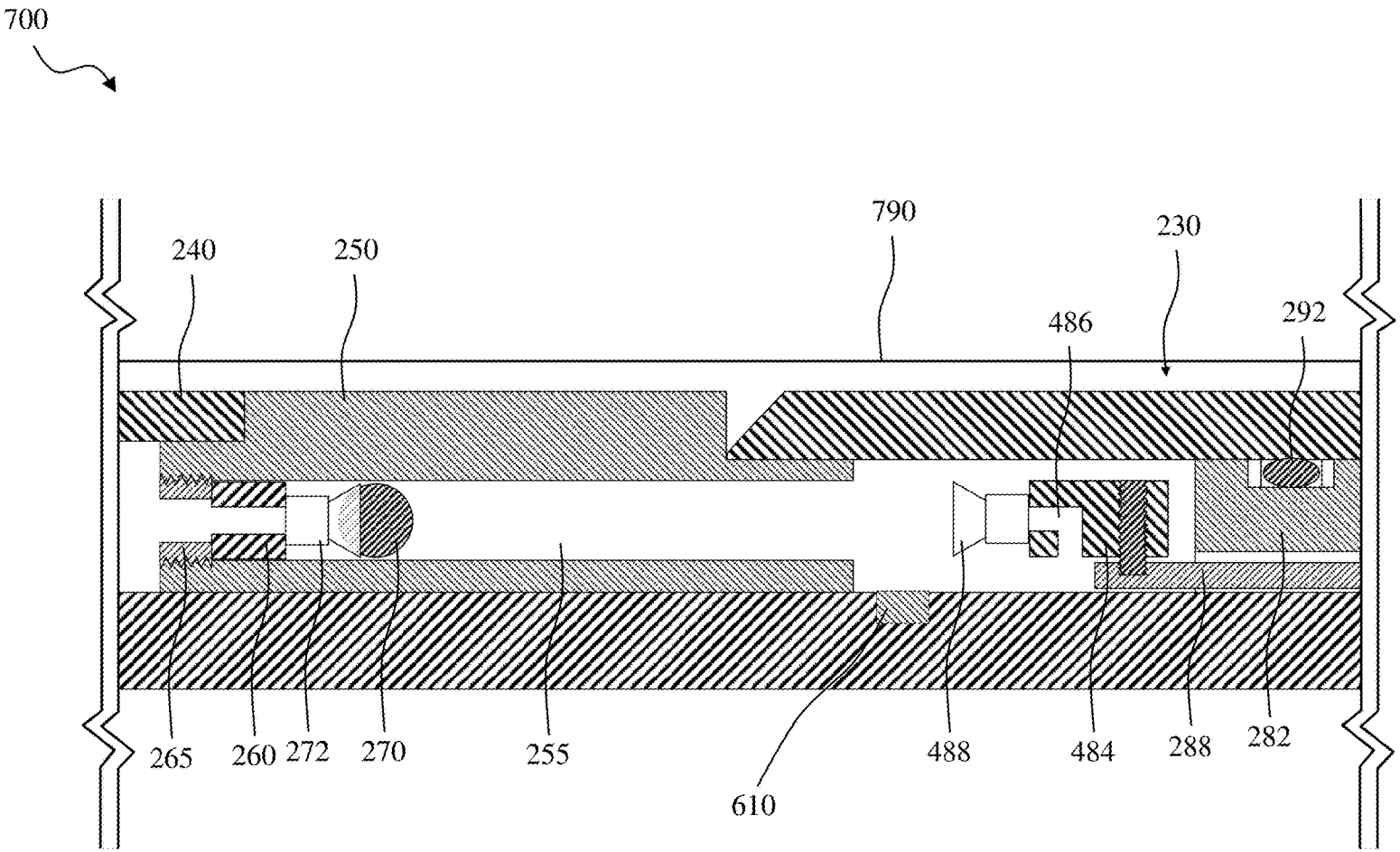
Figure 7M:
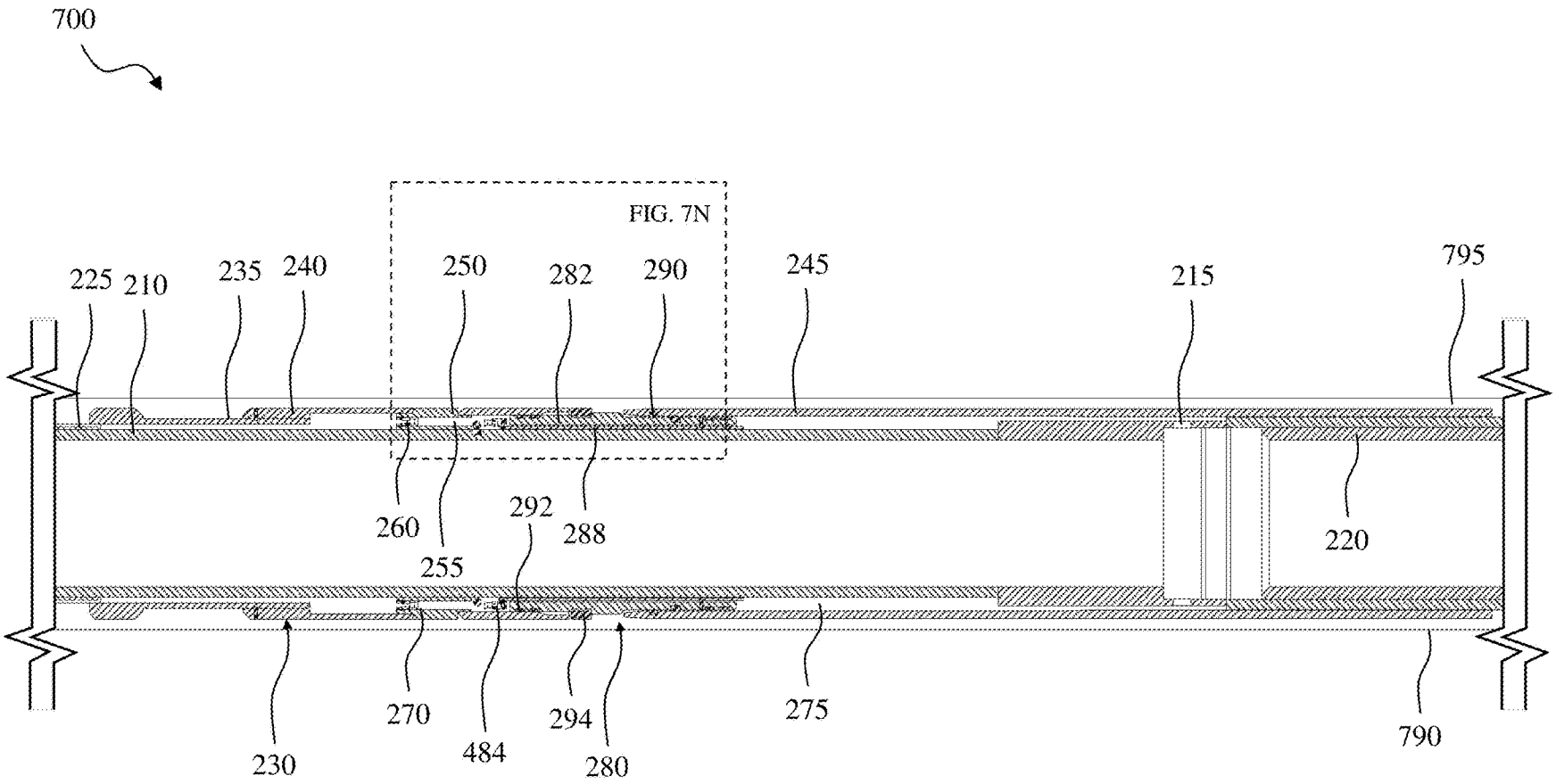
Figure 7N:
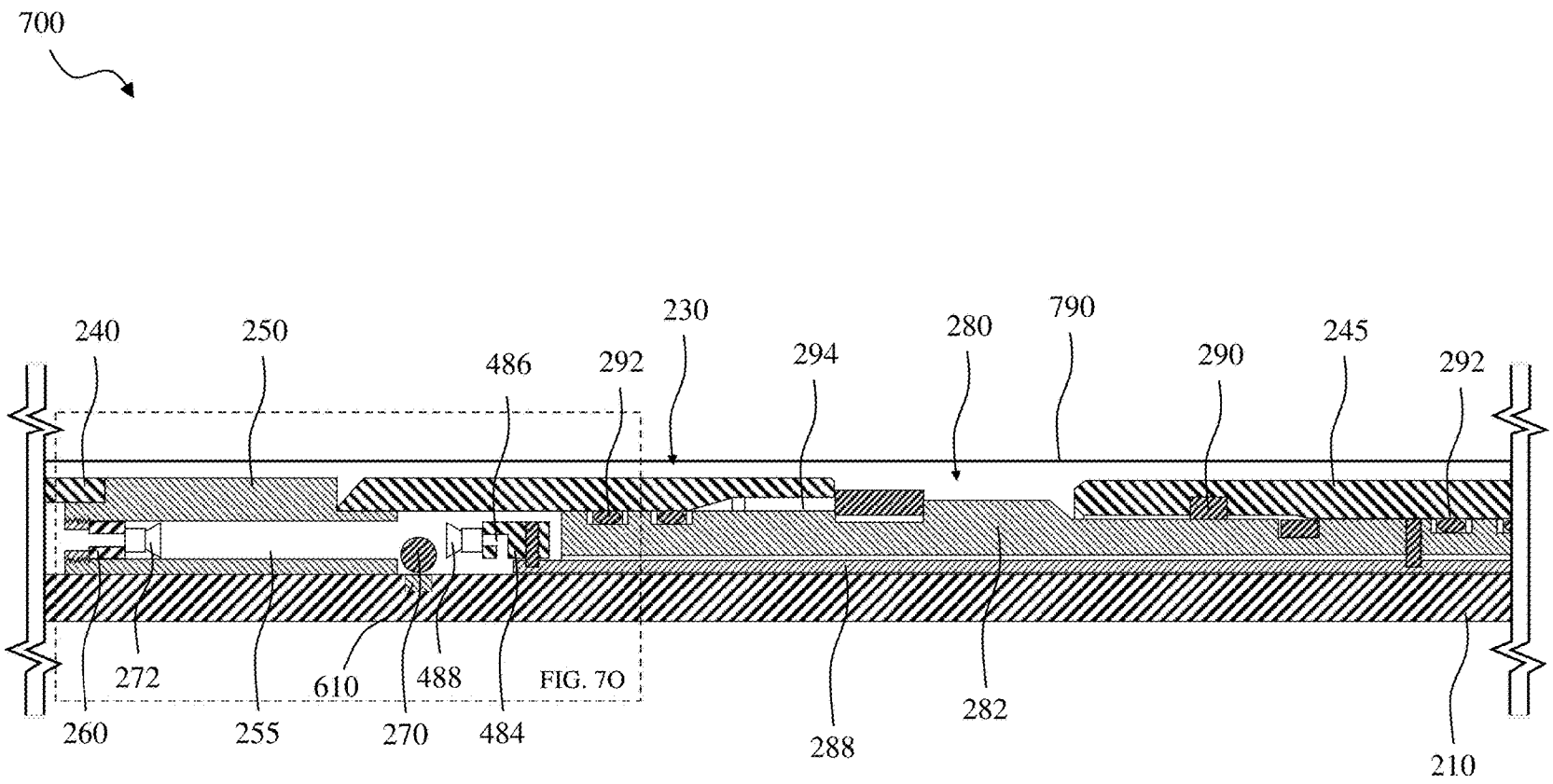
Figure 7O:
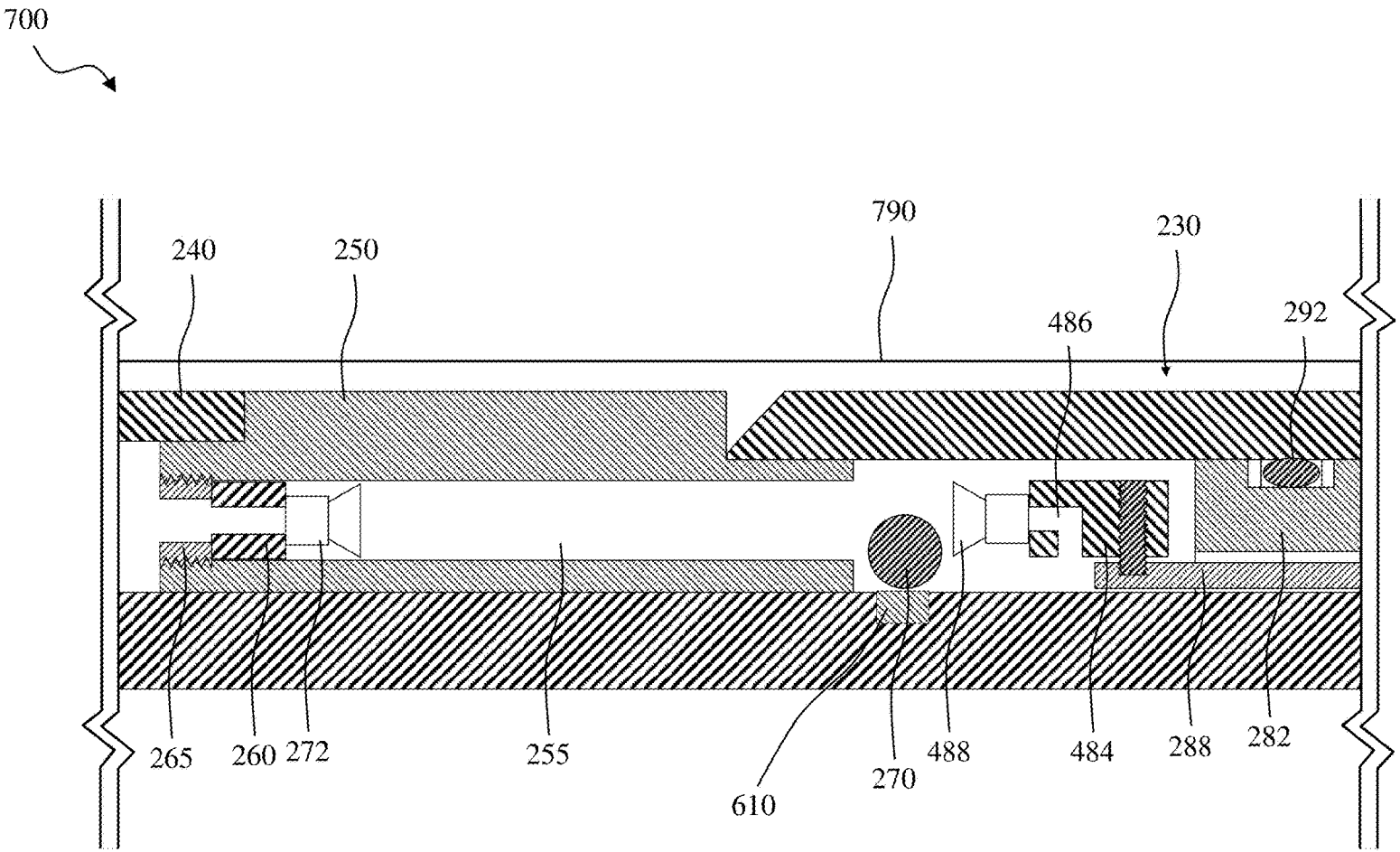
Figure 7P:
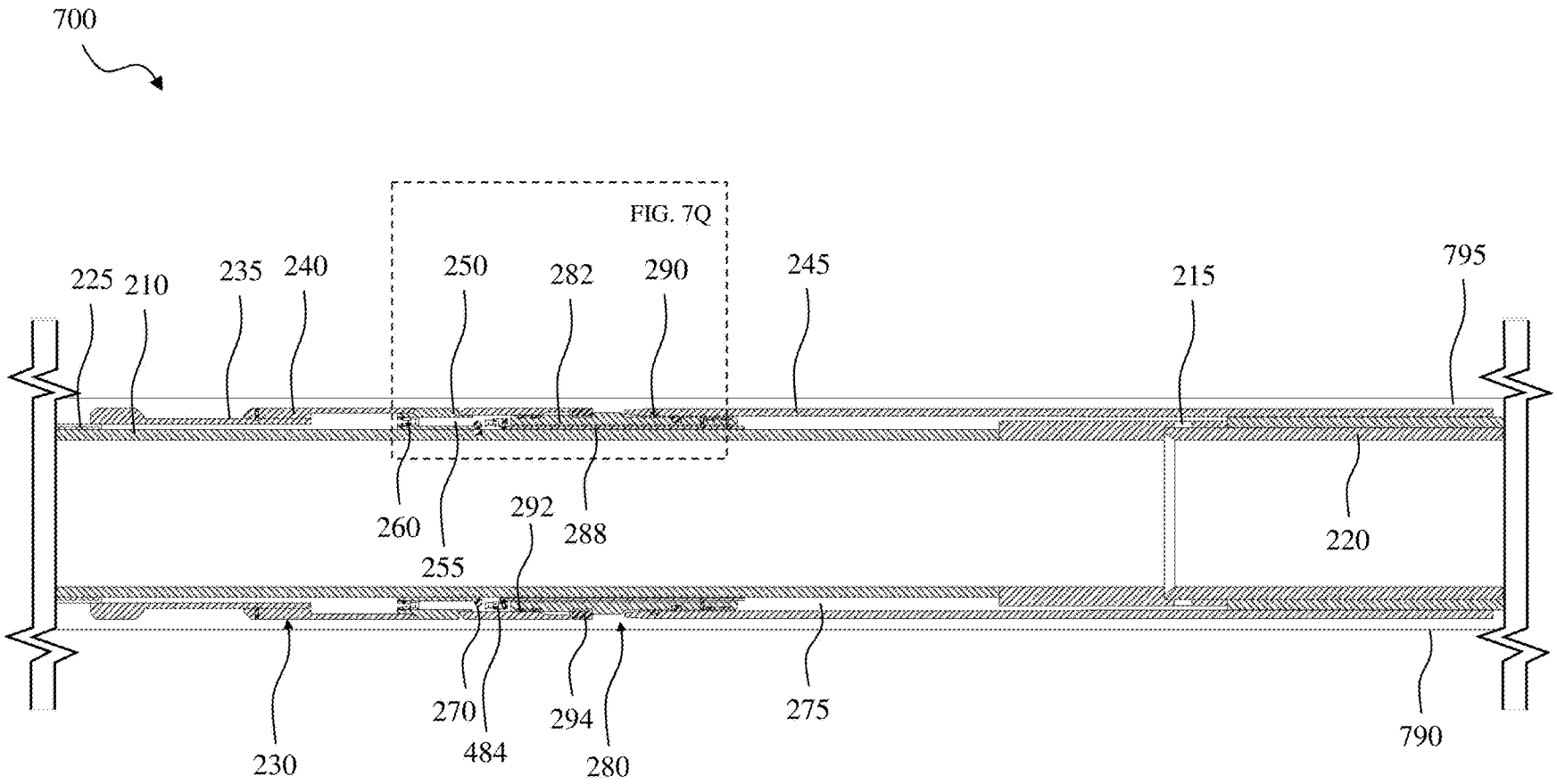
Figure 7Q:
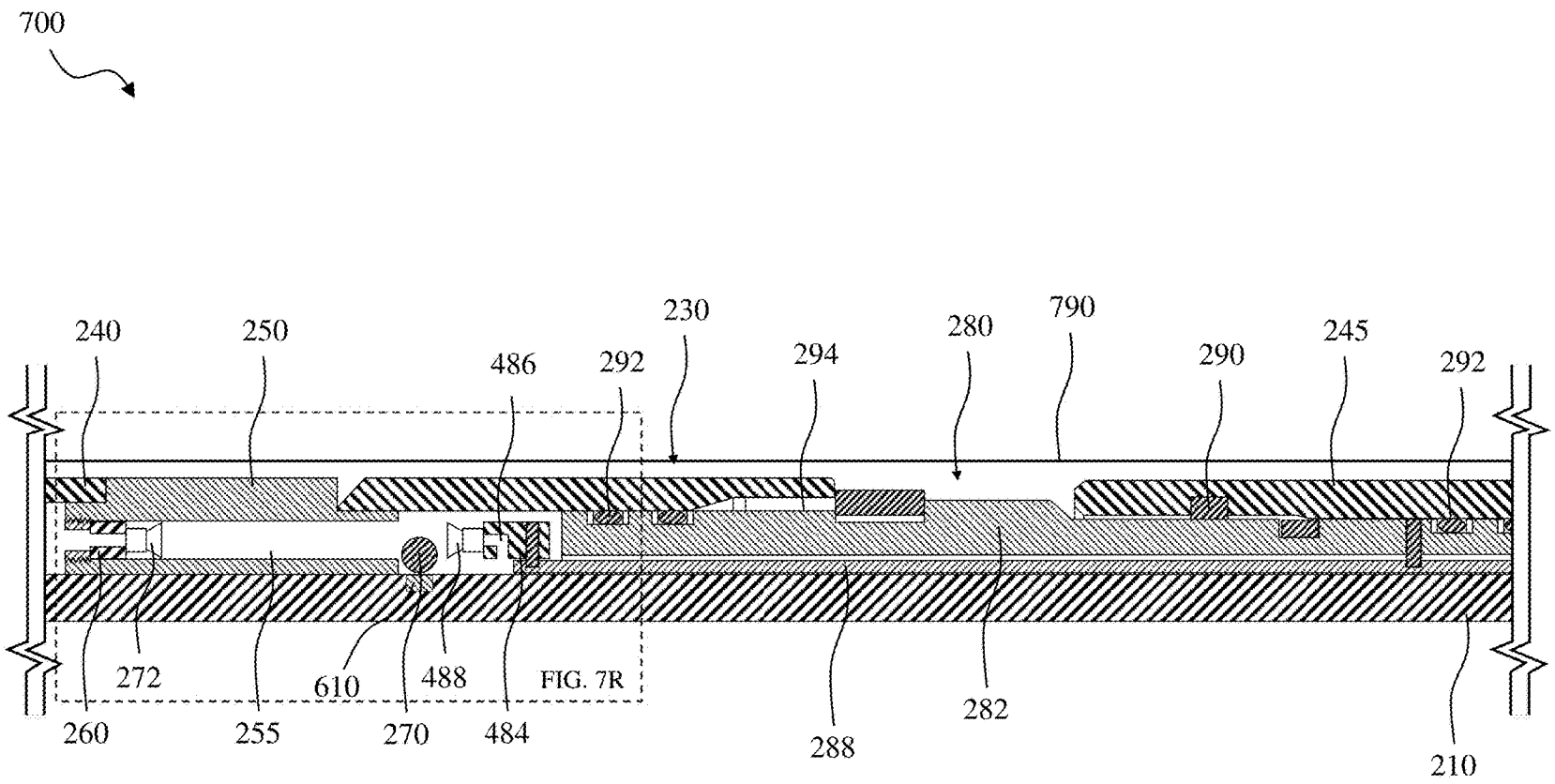
Figure 7R:
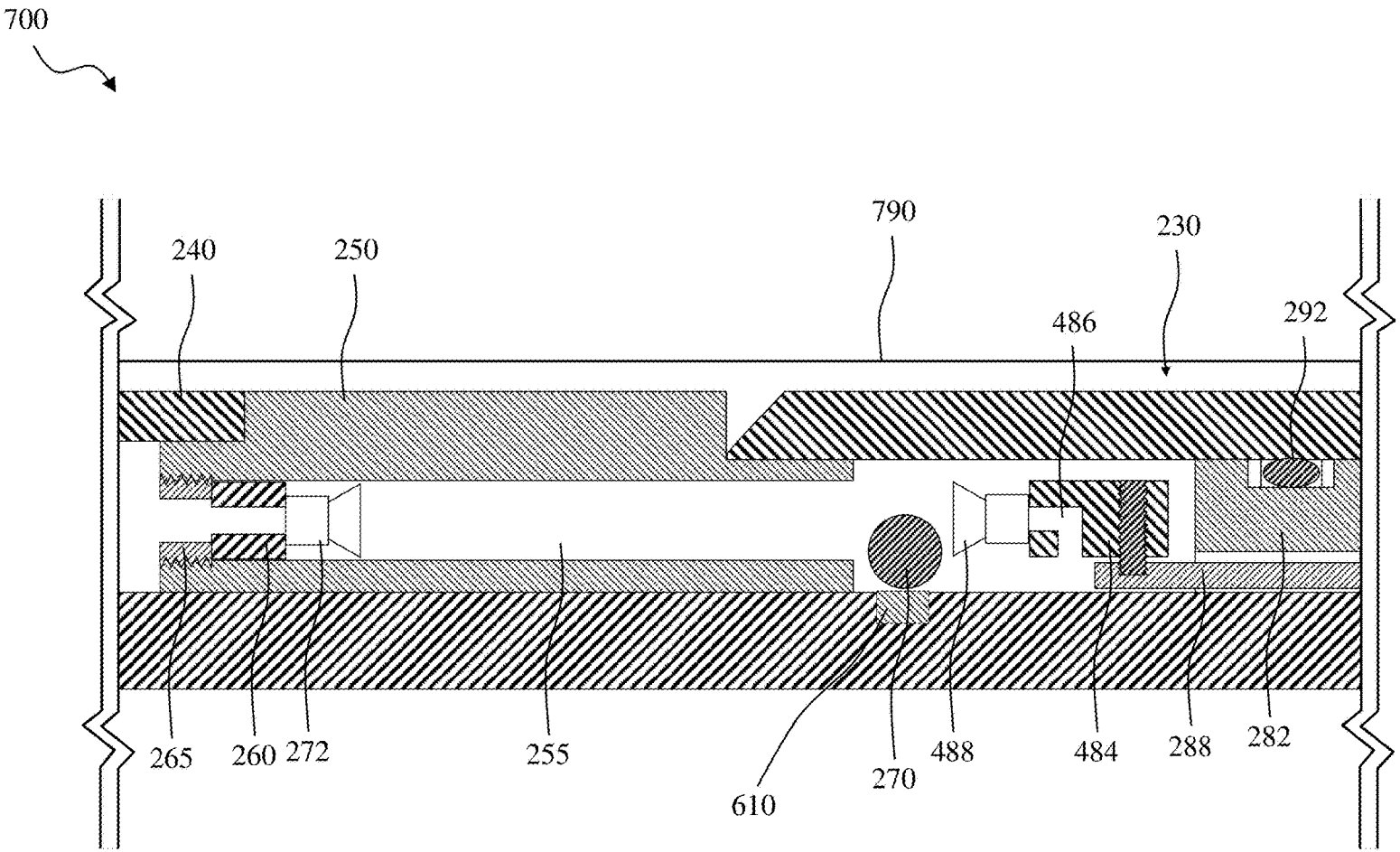

Turning now to FIGS. 7A through 7R, illustrated are certain different cross-sectional views of a flow control assembly 700 positioned within a wellbore 790 at various different operational states. The flow control assembly 700 of FIGS. 7A through 7R is similar in many respects to the flow control assembly 600 of FIGS. 6A through 6C. Accordingly, like reference numbers have been used to indicate similar, if not identical, features.

With initial reference to FIGS. 7A through 7C, illustrated is the flow control assembly 700 as it would initially be positioned within the wellbore 790 (e.g., at its run-in-hole state), for example creating an annulus 795 therebetween. As illustrated in FIGS. 7A through 7C, the sliding piston assembly 280 is in its run-in-hole state, and thus the sliding piston assembly flow nozzle chamber stopper 284 is located within and seals the flow control housing flow nozzle chamber 255. Similarly, the sliding piston assembly flow nozzle chamber stopper 284 keeps the flow control housing plug member 270 within the flow control housing flow nozzle chamber 255 and prevents fluid flow from the annulus 795 of the wellbore 790 to the inside diameter (ID) of the downhole tubular 210, for example using the flow control housing plug member 270 and the sliding piston assembly plug member seat 488.

Turning to FIGS. 7D through 7F, illustrated is the flow control assembly 700 of FIGS. 7A through 7C after subjecting the flow control assembly 700 to fluid flow from within the downhole tubular 210. In this embodiment, the fluid flow flows through the internal flow channel 486 and into the flow control housing flow nozzle chamber 255, thereby urging the flow control housing plug member 270 against the flow control housing plug member seat 272. The combination of the flow control housing plug member 270 and the flow control housing flow member seat 272 prevents fluid from flowing into the annulus 795. At this point in time, the sliding piston assembly 280 remains in the run-in-hole state of FIGS. 7A through 7C.

Turning to FIGS. 7G through 7I, illustrated is the flow control assembly 700 of FIGS. 7D through 7F after subjecting the flow control assembly 700 to a first lower predetermined threshold pressure, the first lower predetermined threshold pressure sliding the sliding piston assembly 280 from the run-in-hole state of FIGS. 7A through 7F to the activated state of FIGS. 7G through 7I. Again, as there is pressure below the flow control housing plug member 270, the flow control housing plug member 270 is urged toward the flow control housing plug member seat 272, which in turn prevents fluid flow from the inside diameter (ID) of the downhole tubular 210 to the annulus 795. Similarly, the internal flow channel 486 prevents an airlock occurring in the flow control housing flow nozzle chamber 255, which could prevent the sliding piston assembly flow nozzle chamber stopper 484 from being removed from the flow control housing flow nozzle chamber 255.

Turning to FIGS. 7J through 7L, illustrated is the flow control assembly 700 of FIGS. 7G through 7I after subjecting the flow control assembly 700 to a second higher predetermined threshold pressure. In this embodiment, the second higher predetermined threshold pressure is configured to set the one or more wellbore packers.

Turning to FIGS. 7M through 70, illustrated is the flow control assembly 700 of FIGS. 7J through 7L after reducing the pressure being applied to the flow control assembly 700, which in turn allows the flow control housing plug member 270 to traverse into the piston chamber 275 and allow fluid flow from the annulus 795 of the wellbore 790 to the inside diameter (ID) of the downhole tubular 210. In this embodiment, the magnet 610 may hold the flow control housing plug member 270 in the piston chamber 275.

Turning to FIGS. 7P through 7R, illustrated is the flow control assembly 700 of FIGS. 7M through 70 after shifting the downhole tubular inner sleeve 220 (e.g., located radially inside of the downhole tubular 210) from the open state (e.g., exposing the downhole tubular opening 215 to allow fluid flow between the inside diameter (ID) of the downhole tubular 210 and the outside diameter (OD) of the downhole tubular 210) to the closed state (e.g., covering the downhole tubular opening 215 to prevent fluid flow between the inside diameter (ID) of the downhole tubular 210 and the outside diameter (OD) of the downhole tubular 210).

Aspects disclosed herein include:

A. A flow control assembly, the flow control assembly including: 1) an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore; 2) a flow control housing flow control device positioned within the flow control housing flow nozzle chamber, the flow control housing flow control device configured to control a fluid flow rate through the flow control housing flow nozzle chamber; 3) a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore; 4) a piston chamber defined between the outer housing and the downhole tubular, the piston chamber in fluid communication with the flow control housing flow nozzle chamber and the inside diameter (ID) of the downhole tubular; and 5) a sliding piston assembly located in the piston chamber, the sliding piston assembly movable between a run-in-hole state and an activated state, the sliding piston assembly configured to: a) keep the flow control housing plug member within the flow control housing flow nozzle chamber and prevent fluid flow from the annulus of the wellbore to the inside diameter (ID) of the downhole tubular when the sliding piston assembly is in the run-in-hole state; and b) allow the flow control housing plug member to traverse into the piston chamber and allow fluid flow from the annulus of the wellbore to the inside diameter (ID) of the downhole tubular when the sliding piston assembly is in the activated state.

B. A method, the method including: 1) positioning a flow control assembly within a wellbore, the flow control assembly including: a) an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore; b) a flow control housing flow control device positioned within the flow control housing flow nozzle chamber, the flow control housing flow control device configured to control a fluid flow rate through the flow control housing flow nozzle chamber; c) a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore; d) a piston chamber defined between the outer housing and the downhole tubular, the piston chamber in fluid communication with the flow control housing flow nozzle chamber and the inside diameter (ID) of the downhole tubular; and 3) a sliding piston assembly located in the piston chamber, the sliding piston assembly movable between a run-in-hole state and an activated state, the sliding piston assembly configured to: i) keep the flow control housing plug member within the flow control housing flow nozzle chamber and prevent fluid flow from the annulus of the wellbore to the inside diameter (ID) of the downhole tubular when the sliding piston assembly is in the run-in-hole state; and ii) allow the flow control housing plug member to traverse into the piston chamber and allow fluid flow from the annulus of the wellbore to the inside diameter (ID) of the downhole tubular when the sliding piston assembly is in the activated state; and 2) applying a predetermined threshold pressure from the downhole tubular to the sliding piston assembly to move the sliding piston assembly from the run-in-hole state to the activated state.

C. A well system, the well system including: 1) a wellbore extending through one or more subterranean formations; and 2) a flow control assembly located in the wellbore, the flow control assembly including: a) an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore; b) a flow control housing flow control device positioned within the flow control housing flow nozzle chamber, the flow control housing flow control device configured to control a fluid flow rate through the flow control housing flow nozzle chamber; c) a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore; d) a piston chamber defined between the outer housing and the downhole tubular, the piston chamber in fluid communication with the flow control housing flow nozzle chamber and the inside diameter (ID) of the downhole tubular; and 3) a sliding piston assembly located in the piston chamber, the sliding piston assembly movable between a run-in-hole state and an activated state, the sliding piston assembly configured to: i) keep the flow control housing plug member within the flow control housing flow nozzle chamber and prevent fluid flow from the annulus of the wellbore to the inside diameter (ID) of the downhole tubular when the sliding piston assembly is in the run-in-hole state; and ii) allow the flow control housing plug member to traverse into the piston chamber and allow fluid flow from the annulus of the wellbore to the inside diameter (ID) of the downhole tubular when the sliding piston assembly is in the activated state.

Aspects A, B, and C may have one or more of the following additional elements in combination: Element 1: wherein the sliding piston assembly includes a sliding piston assembly sleeve located in the piston chamber, and a sliding piston assembly flow nozzle chamber stopper coupled to the sliding piston assembly sleeve, the sliding piston assembly flow nozzle chamber stopper configured to: keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state. Element 2: further including one or more sliding piston assembly flow nozzle chamber stopper seals, the one or more sliding piston assembly flow nozzle chamber stopper seals configured to form a seal between the sliding piston assembly flow nozzle chamber stopper and the flow control housing flow nozzle chamber to prevent fluid flow from the annulus of the wellbore to the inside diameter (ID) of the downhole tubular when the sliding piston assembly is in the run-in-hole state. Element 3: wherein the sliding piston assembly flow nozzle chamber stopper includes an internal flow channel fluidly coupling the flow control housing flow nozzle chamber and the piston chamber and a sliding piston assembly plug member seat, the flow control housing plug member configured to engage with the sliding piston assembly plug member seat to prevent fluid flow from the annulus of the wellbore to the inside diameter (ID) of the downhole tubular when the sliding piston assembly is in the run-in-hole state. Element 4: further including a sliding piston assembly bar located radially inside and coupled to the sliding piston assembly sleeve, the sliding piston assembly bar coupling the sliding piston assembly flow nozzle chamber stopper to the sliding assembly piston sleeve. Element 5: wherein the downhole tubular includes a downhole tubular opening coupling the inside diameter (ID) of the downhole tubular and an outside diameter (OD) of the downhole tubular. Element 6: further including a downhole tubular inner sleeve located radially inside of the downhole tubular, the downhole tubular inner sleeve configured to slide between an open state exposing the downhole tubular opening to allow fluid flow between the inside diameter (ID) of the downhole tubular and the outside diameter (OD) of the downhole tubular, and a closed state covering the downhole tubular opening to prevent fluid flow between the inside diameter (ID) of the downhole tubular and the outside diameter (OD) of the downhole tubular. Element 7: further including a screen assembly positioned in a fluid flow path between the annulus of the wellbore and the flow control housing flow nozzle chamber, the screen assembly configured to filter debris out of fluids flowing from the annulus of the wellbore toward the inside diameter (ID) of the downhole tubular. Element 8: wherein the outer housing further includes a flow ring housing, an adjustment ring housing, and a sleeve housing. Element 9: further including a flow control device retainer, the flow control device retainer configured to disengage from the flow control housing flow nozzle chamber to allow a removal and replacement of the flow control housing flow control device. Element 10: further including a sliding piston assembly shear feature, the sliding piston assembly shear feature configured to shearingly hold the sliding piston assembly in the run-in-hole state. Element 11: wherein the sliding piston assembly shear feature is configured to shear in response to a predetermined threshold pressure in the downhole tubular, the predetermined threshold pressure configured to move the sliding piston assembly from the run-in-hole state to the activated state. Element 12: further including one or more sliding piston assembly seal features positioned radially between the outer housing and the sliding piston assembly, the one or more sliding piston assembly seal features configured to provide a seal area for the predetermined threshold pressure from the downhole tubular to engage to move the sliding piston assembly from the run-in-hole state to the activated state. Element 13: further including a sliding piston assembly lock feature, the sliding piston assembly lock feature configured to allow the sliding piston assembly to move toward and then lock within the activated state.

Those skilled in the art to which this application relates will appreciate that other and further additions, deletions, substitutions and modifications may be made to the described embodiments.

What is claimed is:

1. A flow control assembly, comprising:

an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore;

a flow control housing flow control device positioned within the flow control housing flow nozzle chamber, the flow control housing flow control device configured to control a fluid flow rate through the flow control housing flow nozzle chamber;

a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore;

a piston chamber defined between the outer housing and the downhole tubular, the piston chamber in fluid communication with the flow control housing flow nozzle chamber and the inside diameter (ID) of the downhole tubular; and a sliding piston assembly located in the piston chamber, the sliding piston assembly movable between a run-in-hole state and an activated state, the sliding piston assembly configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state, wherein the sliding piston assembly includes a sliding piston assembly sleeve located in the piston chamber, and a sliding piston assembly flow nozzle chamber stopper coupled to the sliding piston assembly sleeve, the sliding piston assembly flow nozzle chamber stopper configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state.

2. The flow control assembly as recited in claim 1, further including one or more sliding piston assembly flow nozzle chamber stopper seals, the one or more sliding piston assembly flow nozzle chamber stopper seals configured to form a seal between the sliding piston assembly flow nozzle chamber stopper and the flow control housing flow nozzle chamber to prevent fluid flow from the annulus of the wellbore to the inside diameter (ID) of the downhole tubular when the sliding piston assembly is in the run-in-hole state.

3. The flow control assembly as recited in claim 1, wherein the sliding piston assembly flow nozzle chamber stopper includes an internal flow channel fluidly coupling the flow control housing flow nozzle chamber and the piston chamber and a sliding piston assembly plug member seat, the flow control housing plug member configured to engage with the sliding piston assembly plug member seat to prevent fluid flow from the annulus of the wellbore to the inside diameter (ID) of the downhole tubular when the sliding piston assembly is in the run-in-hole state.

4. The flow control assembly as recited in claim 1, further including a sliding piston assembly bar located radially inside and coupled to the sliding piston assembly sleeve, the sliding piston assembly bar coupling the sliding piston assembly flow nozzle chamber stopper to the sliding assembly piston sleeve.

5. The flow control assembly as recited in claim 1, wherein the downhole tubular includes a downhole tubular opening coupling the inside diameter (ID) of the downhole tubular and an outside diameter (OD) of the downhole tubular.

6. The flow control assembly as recited in claim 5, further including a downhole tubular inner sleeve located radially inside of the downhole tubular, the downhole tubular inner sleeve configured to slide between an open state exposing the downhole tubular opening to allow fluid flow between the inside diameter (ID) of the downhole tubular and the outside diameter (OD) of the downhole tubular, and a closed state covering the downhole tubular opening to prevent fluid flow between the inside diameter (ID) of the downhole tubular and the outside diameter (OD) of the downhole tubular.

7. The flow control assembly as recited in claim 1, further including a screen assembly positioned in a fluid flow path between the annulus of the wellbore and the flow control housing flow nozzle chamber, the screen assembly configured to filter debris out of fluids flowing from the annulus of the wellbore toward the inside diameter (ID) of the downhole tubular.

8. The flow control assembly as recited in claim 1, wherein the outer housing further includes a flow ring housing, an adjustment ring housing, and a sleeve housing.

9. The flow control assembly as recited in claim 1, further including a flow control device retainer, the flow control device retainer configured to disengage from the flow control housing flow nozzle chamber to allow a removal and replacement of the flow control housing flow control device.

10. The flow control assembly as recited in claim 1, further including a sliding piston assembly shear feature, the sliding piston assembly shear feature configured to shearingly hold the sliding piston assembly in the run-in-hole state.

11. The flow control assembly as recited in claim 10, wherein the sliding piston assembly shear feature is configured to shear in response to a predetermined threshold pressure in the downhole tubular, the predetermined threshold pressure configured to move the sliding piston assembly from the run-in-hole state to the activated state.

12. The flow control assembly as recited in claim 11, further including one or more sliding piston assembly seal features positioned radially between the outer housing and the sliding piston assembly, the one or more sliding piston assembly seal features configured to provide a seal area for the predetermined threshold pressure from the downhole tubular to engage to move the sliding piston assembly from the run-in-hole state to the activated state.

13. The flow control assembly as recited in claim 1, further including a sliding piston assembly lock feature, the sliding piston assembly lock feature configured to allow the sliding piston assembly to move toward and then lock within the activated state.

14. A method, comprising:

positioning a flow control assembly within a wellbore, the flow control assembly including:

an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore;

a flow control housing flow control device positioned within the flow control housing flow nozzle chamber, the flow control housing flow control device configured to control a fluid flow rate through the flow control housing flow nozzle chamber;

a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore;

a piston chamber defined between the outer housing and the downhole tubular, the piston chamber in fluid communication with the flow control housing flow nozzle chamber and the inside diameter (ID) of the downhole tubular; and a sliding piston assembly located in the piston chamber, the sliding piston assembly movable between a run-in-hole state and an activated state, the sliding piston assembly configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state, wherein the sliding piston assembly includes a sliding piston assembly sleeve located in the piston chamber, and a sliding piston assembly flow nozzle chamber stopper coupled to the sliding piston assembly sleeve, the sliding piston assembly flow nozzle chamber stopper configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state; and applying a predetermined threshold pressure from the downhole tubular to the sliding piston assembly to move the sliding piston assembly from the run-in-hole state to the activated state.

15. The method as recited in claim 14, further including one or more sliding piston assembly flow nozzle chamber stopper seals, the one or more sliding piston assembly flow nozzle chamber stopper seals configured to form a seal between the sliding piston assembly flow nozzle chamber stopper and the flow control housing flow nozzle chamber to prevent fluid flow from the annulus of the wellbore to the inside diameter (ID) of the downhole tubular when the sliding piston assembly is in the run-in-hole state.

16. The method as recited in claim 14, wherein the sliding piston assembly flow nozzle chamber stopper includes an internal flow channel fluidly coupling the flow control housing flow nozzle chamber and the piston chamber and a sliding piston assembly plug member seat, the flow control housing plug member configured to engage with the sliding piston assembly plug member seat to prevent fluid flow from the annulus of the wellbore to the inside diameter (ID) of the downhole tubular when the sliding piston assembly is in the run-in-hole state.

17. The method as recited in claim 14, further including a sliding piston assembly bar located radially inside and coupled to the sliding piston assembly sleeve, the sliding piston assembly bar coupling the sliding piston assembly flow nozzle chamber stopper to the sliding assembly piston sleeve.

18. The method as recited in claim 17, wherein the downhole tubular includes a downhole tubular opening coupling the inside diameter (ID) of the downhole tubular and an outside diameter (OD) of the downhole tubular.

19. The method as recited in claim 18, further including a downhole tubular inner sleeve located radially inside of the downhole tubular, the downhole tubular inner sleeve configured to slide between an open state exposing the downhole tubular opening to allow fluid flow between the inside diameter (ID) of the downhole tubular and the outside diameter (OD) of the downhole tubular, and a closed state covering the downhole tubular opening to prevent fluid flow between the inside diameter (ID) of the downhole tubular and the outside diameter (OD) of the downhole tubular.

20. The method as recited in claim 14, further including a screen assembly positioned in a fluid flow path between the annulus of the wellbore and the flow control housing flow nozzle chamber, the screen assembly configured to filter debris out of fluids flowing from the annulus of the wellbore toward the inside diameter (ID) of the downhole tubular.

21. The method as recited in claim 14, wherein the outer housing further includes a flow ring housing, an adjustment ring housing, and a sleeve housing.

22. The method as recited in claim 14, further including a flow control device retainer, the flow control device retainer configured to disengage from the flow control housing flow nozzle chamber to allow a removal and replacement of the flow control housing flow control device.

23. The method as recited in claim 14, further including a sliding piston assembly shear feature, the sliding piston assembly shear feature configured to shearingly hold the sliding piston assembly in the run-in-hole state.

24. The method as recited in claim 23, wherein the sliding piston assembly shear feature is configured to shear in response to a predetermined threshold pressure in the downhole tubular, the predetermined threshold pressure configured to move the sliding piston assembly from the run-in-hole state to the activated state.

25. The method as recited in claim 24, further including one or more sliding piston assembly seal features positioned radially between the outer housing and the sliding piston assembly, the one or more sliding piston assembly seal features configured to provide a seal area for the predetermined threshold pressure from the downhole tubular to engage to move the sliding piston assembly from the run-in-hole state to the activated state.

26. The method as recited in claim 14, further including a sliding piston assembly lock feature, the sliding piston assembly lock feature configured to allow the sliding piston assembly to move toward and then lock within the activated state.

27. A well system, comprising:

a wellbore extending through one or more subterranean formations; and a flow control assembly located in the wellbore, the flow control assembly including:

an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore;

a flow control housing flow control device positioned within the flow control housing flow nozzle chamber, the flow control housing flow control device configured to control a fluid flow rate through the flow control housing flow nozzle chamber;

a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore;

a piston chamber defined between the outer housing and the downhole tubular, the piston chamber in fluid communication with the flow control housing flow nozzle chamber and the inside diameter (ID) of the downhole tubular; and a sliding piston assembly located in the piston chamber, the sliding piston assembly movable between a run-in-hole state and an activated state, the sliding piston assembly configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state, wherein the sliding piston assembly includes a sliding piston assembly sleeve located in the piston chamber, and a sliding piston assembly flow nozzle chamber stopper coupled to the sliding piston assembly sleeve, the sliding piston assembly flow nozzle chamber stopper configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state.

28. The well system as recited in claim 27, further including a wellbore tubular located in the wellbore, the flow control assembly coupled with the wellbore tubular.

29. A flow control assembly, comprising:

an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore;

a flow control housing flow control device positioned within the flow control housing flow nozzle chamber, the flow control housing flow control device configured to control a fluid flow rate through the flow control housing flow nozzle chamber;

a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore;

a piston chamber defined between the outer housing and the downhole tubular, the piston chamber in fluid communication with the flow control housing flow nozzle chamber and the inside diameter (ID) of the downhole tubular; and a sliding piston assembly located in the piston chamber, the sliding piston assembly movable between a run-in-hole state and an activated state, the sliding piston assembly configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state, wherein the downhole tubular includes a downhole tubular opening coupling the inside diameter (ID) of the downhole tubular and an outside diameter (OD) of the downhole tubular, and further including a downhole tubular inner sleeve located radially inside of the downhole tubular, the downhole tubular inner sleeve configured to slide between an open state exposing the downhole tubular opening to allow fluid flow between the inside diameter (ID) of the downhole tubular and the outside diameter (OD) of the downhole tubular, and a closed state covering the downhole tubular opening to prevent fluid flow between the inside diameter (ID) of the downhole tubular and the outside diameter (OD) of the downhole tubular.

30. A flow control assembly, comprising:

an outer housing disposed about a downhole tubular, the outer housing including a flow control housing, the flow control housing including a flow control housing flow nozzle chamber, the flow control housing flow nozzle chamber configured to provide a fluid path between an inside diameter (ID) of the downhole tubular and an annulus of a wellbore;

a flow control housing flow control device positioned within the flow control housing flow nozzle chamber, the flow control housing flow control device configured to control a fluid flow rate through the flow control housing flow nozzle chamber;

a flow control housing plug member positioned within the flow control housing flow nozzle chamber, the flow control housing plug member moveable to plug the flow control housing flow nozzle chamber in response to fluid flow from the inside diameter (ID) of the downhole tubular towards the annulus of the wellbore;

a piston chamber defined between the outer housing and the downhole tubular, the piston chamber in fluid communication with the flow control housing flow nozzle chamber and the inside diameter (ID) of the downhole tubular; and a sliding piston assembly located in the piston chamber, the sliding piston assembly movable between a run-in-hole state and an activated state, the sliding piston assembly configured to:

keep the flow control housing plug member within the flow control housing flow nozzle chamber and prevent fluid flow from the annulus of the wellbore to the inside diameter (ID) of the downhole tubular when the sliding piston assembly is in the run-in-hole state; and allow the flow control housing plug member to traverse into the piston chamber and allow fluid flow from the annulus of the wellbore to the inside diameter (ID) of the downhole tubular when the sliding piston assembly is in the activated state, wherein the outer housing further includes a flow ring housing, an adjustment ring housing, and a sleeve housing.

* * * * *